US006257324B1

(12) United States Patent
Osakabe et al.

(10) Patent No.: US 6,257,324 B1
(45) Date of Patent: Jul. 10, 2001

(54) COOLING APPARATUS BOILING AND CONDENSING REFRIGERANT

(75) Inventors: Hiroyuki Osakabe, Chita-gun; Kunihiro Kamiya, Anjo; Takahide Ohara, Okazaki, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/333,151

(22) Filed: Jun. 14, 1999

(30) Foreign Application Priority Data

| | | |
|---|---|---|
| Jun. 30, 1998 | (JP) | 10-184877 |
| Aug. 20, 1998 | (JP) | 10-233732 |
| Sep. 30, 1998 | (JP) | 10-278279 |
| Oct. 6, 1998 | (JP) | 10-284503 |
| Jan. 13, 1999 | (JP) | 11-005993 |
| Jan. 13, 1999 | (JP) | 11-006022 |
| Jan. 13, 1999 | (JP) | 11-006849 |
| Jan. 13, 1999 | (JP) | 11-006934 |
| Jan. 13, 1999 | (JP) | 11-006997 |
| Jan. 14, 1999 | (JP) | 11-007498 |

(51) Int. Cl.[7] ..... F28D 15/00; H01L 23/34; H05K 7/20

(52) U.S. Cl. ..... 165/104.33; 165/104.21; 361/700; 257/715

(58) Field of Search ..... 165/104.14, 104.21, 165/104.33, 80.4; 257/715; 361/699, 700

(56) References Cited

U.S. PATENT DOCUMENTS

| | | | | |
|---|---|---|---|---|
| 4,705,102 | * | 11/1987 | Kanda et al. | 165/104.33 |
| 5,647,430 | * | 7/1997 | Tajima | 165/104.33 |
| 5,713,413 | * | 2/1998 | Osakabe et al. | 165/104.33 |
| 5,823,248 | * | 10/1998 | Kadota et al. | 165/104.33 |
| 6,073,683 | * | 6/2000 | Osakabe et al. | 165/104.33 |

FOREIGN PATENT DOCUMENTS

| | | | |
|---|---|---|---|
| 41 08 981 A1 | | 3/1991 | (DE) . |
| 43 39 936 A1 | | 11/1993 | (DE) . |
| 0 409 179 A1 | | 1/1991 | (EP) . |
| 0 821 468 A2 | | 1/1998 | (EP) . |
| 57-204156 | * | 12/1982 | (JP) . |
| 08 029041 | | 2/1996 | (JP) . |
| 8-126125 | | 5/1996 | (JP) . |
| 8-204075 | | 8/1996 | (JP) . |
| 08204075 | * | 12/1996 | (JP) . |
| 09 102691 | | 4/1997 | (JP) . |
| 09 126617 | | 5/1997 | (JP) . |
| 9-126617 | | 5/1997 | (JP) . |
| 10-50909 | | 2/1998 | (JP) . |

* cited by examiner

*Primary Examiner*—Ira S. Lazarus
*Assistant Examiner*—Tho Duong
(74) *Attorney, Agent, or Firm*—Harness, Dickey & Pierce, PLC

(57) ABSTRACT

This cooling apparatus can improve a radiation performance by increasing the boiling area and make it difficult to cause the burnout on boiling faces by filling the boiling faces with a refrigerant necessary for the boiling. In refrigerant chambers for reserving a refrigerant, there are inserted corrugated fins for increasing the boiling area. These corrugated fins are composed of lower corrugated fins arranged to correspond to the lower sides of the boiling faces for receiving the heat of a heating body, and upper corrugated fins arranged to correspond to the upper sides of the boiling faces, and these lower and upper corrugated fins and are individually held in thermal contact with the boiling faces of the refrigerant chambers. The lower corrugated fins and the upper corrugated fins are given a common fin pitch P and are individually inserted vertically in the individual refrigerant chambers to define the individual passages further into a plurality of small passage portions. However, the lower corrugated fins and the upper corrugated fins are inserted such that their crests and valleys are staggered from each other in the transverse direction of the refrigerant chambers.

23 Claims, 73 Drawing Sheets

COOLING APPARATUS BOILING AND CONDENSING REFRIGERANT

CROSS REFERENCE TO THE RELATED APPLICATIONS

This application is based on Japanese Patent Application Nos. Hei. 10-184877 filed on Jun. 30, 1998, Hei. 10-233732 filed on Aug. 20, 1998, Hei. 10-278279 filed on Sep. 30, 1998, Hei. 10-284503 filed on Oct. 6, 1998, Hei. 11-5993 filed on Jan. 13, 1999, Hei. 11-6022 filed on Jan. 13, 1999, Hei. 11-6849 filed on Jan. 13, 1999, Hei. 11-6934 filed on Jan. 13, 1999, Hei. 11-6997 filed on January 13, and Hei. 11-7498 filed on Jan. 14, 1999, the contents of which are incorporated herein by reference.

BACKGROUND OF THE INVENTION

1. Field of the Invention

The present invention relates to a cooling apparatus for cooling a heating body by boiling and condensing a refrigerant repeatedly.

2. Description of Related Art

A conventional cooling apparatus is disclosed in Japanese Patent Application Laid-Open No. 8-236669. In this cooling apparatus, as shown in FIG. 10, a boiling area in a refrigerant tank 1100 for reserving a refrigerant is increased to improve the radiation performance by attaching a heating body 1110 to the surface of the refrigerant tank 1100 and by arranging fins 1120 to correspond to the boiling face in the refrigerant tank 1100 for receiving the heat of the heating body.

Here, in the above-specified cooling apparatus, the fins 1120 arranged in the refrigerant tank 1100 form a plurality of passage portions 1130, in which the vaporized refrigerant (or bubbles), as boiled by the heat of the heating body 1110, rises. At this time, as referred to FIG. 5, some of the individual passage portions 1130 have more and less numbers of bubbles in dependence upon the position of the heating portion of the heating body 1110, and the number of bubbles increases the more for the higher position of the passage portions 1130 so that the small bubbles join together to form larger bubbles. In the passages of more bubbles, therefore, the boiling faces are covered with the more bubbles to lower the boiling heat transfer coefficient. As a result, the boiling face is likely to cause an abrupt temperature rise (or burnout).

Especially when the fin pitch is reduced to retain a larger boiling area, the passage portions 1130 are reduced in their average open area and are almost filled with the bubbles to reduce the quantity of refrigerant seriously so that the burnout may highly probably occur on the boiling faces.

Furthermore, in the cooling apparatus shown in FIG. 10, the fins 1120 arranged in the boiling portion form a plurality of passage portions 1130, through which vapor (or bubbles), as boiled by the radiation of a heating body, rises in the boiling portion. At this time, the quantity of generated vapor becomes the more as the vapor rises to the higher level. When the boiling portion is vertically long so that the fins 1120 arranged in the boiling portion are long or when the heat generated by the heating body increases although the fins 1120 are not vertically long, therefore, the vapor (or bubbles) is hard to come out from the passage portions 1130 formed by the fins 1120. As a result, the burnout becomes liable to occur on the upper side of the boiling portion so that the using range (or radiation) of the refrigerant tank 1100 is restricted.

Another conventional cooling apparatus is disclosed in Japanese Patent Application Laid-Open No. 8-204075. This cooling apparatus uses the principle of thermo-siphon and is constructed to include an evaporation portion 2100 for reserving a refrigerant and a condensation portion 2110 disposed over the evaporation portion 2100, as shown in FIG. 43. The vaporized refrigerant, as boiled in the evaporation portion 2100 by receiving heat of a heating body, flows into the condensation portion 2110. After that, the refrigerant is cooled and liquefied by the heat exchange with the external fluid, and is recycled to the evaporation portion 2100. By thus repeating the evaporation and condensation of the refrigerant, the heat of the heating body is transferred in the evaporation portion 2100 to the refrigerant and further to the condensation portion 2110 so that it is released to the external fluid at the condensation portion 2110.

In the cooling apparatus in FIG. 43, however, the condensed liquid, as liquefied in the condensation portion 2110, is returned to the evaporation portion 2100 via passages 2101 or returning passages 2102 of the evaporation portion 2100. In the passages 2101 within the mounting range of the heating body, however, the vaporized refrigerant, as boiled by the heat of the heating body, rises so that the condensed liquid and the vaporized refrigerant interfere as the counter flows. As a result, the vaporized refrigerant becomes hard to leave the evaporation portion 2100, and the condensed liquid flowing from the condensation portion 2110 into the evaporation portion 2100 is blown up by the vaporized refrigerant rising from the evaporation portion 2100 so that it becomes hard to return to the evaporation portion 2100. As a result, a burnout (or an abrupt temperature rise) is liable to occur on the boiling faces of the evaporation portion 2100, thus the radiation performance drops. By this problem, the drop in the radiation performance due to the burnout becomes the more liable to occur as the evaporation portion 2100 is thinned the more to reduce the quantity of precious refrigerant to be contained, from the demand for reducing the cost.

Still another conventional cooling apparatus is disclosed in Japanese Patent Application Laid-Open No. 9-126617. This cooling apparatus is used as a radiating device for an electric vehicle, and arranged inside a hood. Therefore, as shown in FIG. 56, in consideration of a mountability of inside hook in which arrangement space in a vertical direction is limited, a radiator 3100 is perpendicularly assembled to a refrigerant tank 3110 via a lower tank 3120, and the refrigerant tank 3110 is arranged at a large inclination.

In the still another cooling apparatus in FIG. 56, since the refrigerant tank 3110 is largely inclined, a liquid refrigerant in the refrigerant tank 3110 may flows back to the radiator side when, for example, the vehicle stops suddenly or ascends a uphill road. Therefore, it is difficult for a boiling face of the refrigerant tank 3110 to be stably filled with liquid refrigerant. In such a situation, the boiling face is likely to occur a burnout (abrupt temperature rising), a radiation performance may largely decrease. Especially when the condensed liquid amount becomes the less as the refrigerant tank 3110 is thinned the more, the burnout of the boiling faces are likely occur.

Furthermore, in the still another cooling apparatus in FIG. 56, a plurality of heating bodies 3130 are attached in the longitudinal direction of the refrigerant tank 3110. As bubbles are generated on the individual heating body mounting faces and sequentially flow downstream (to the radiator 3100), therefore, the bubbles are the more in the refrigerant tank 3110 as they approach the closer to the radiator 3100. This makes the more liable for the burnout to occur on the heating body mounting face the closer to the radiator 3100. In order to prevent this burnout on the heating body mounting face closer to the radiator 3100, on the other hand, it is necessary to enlarge the thickness size of the refrigerant tank 3110 thereby to increase its capacity. This increases the quantity of refrigerant to be reserved in the refrigerant tank 3110, thus causing a problem to invite a high cost.

Further still another conventional cooling apparatus is disclosed in Japanese Patent Application Laid-Open No. 8-236669. This cooling apparatus forms a vaporized refrigerant outlet 4120 and a condensed liquid inlet 4130 by arranging a refrigerant control plate 4110 obliquely in the upper portion of a refrigerant tank 4100, as shown in FIG. 81. Thus, the vaporized refrigerant, as boiled in the refrigerant tank 4100, can flow out along the refrigerant flow control plate 4110 from the outlet 4120, and the condensed refrigerant, as liquefied in a radiator arranged in the upper portion of the refrigerant tank 4100, can flow from the inlet 4130 into the refrigerant tank 4100. As a result, the interference between the vaporized refrigerant to flow out from the refrigerant tank 4100 and the condensed liquid to flow into the refrigerant tank 4100 can be reduced to improve the refrigerant circulation in the refrigerant tank 4100.

In the further still another cooling apparatus in FIG. 81 using the refrigerant control plate 4110, however, the vaporized refrigerant outlet 4120 is opened obliquely upward so that the condensed liquid dripping from a radiator cannot wholly flow from the inlet 4130 into the refrigerant tank 4100. That is, any portion of the condensed liquid dripping from the radiator will flow in any event from the outlet 4120 into the refrigerant tank 4100 to establish the interference between the vaporized refrigerant and the condensed liquid. As the radiation rises, therefore, the interference between the vaporized refrigerant and the condensed liquid becomes serious so that a reduction in the radiation performance may occur.

SUMMARY OF THE INVENTION

The invention has been conceived in view of the background thus far described and its first object is to improve the radiation performance by increasing the boiling area and to make it difficult to cause the burnout on boiling faces by filling the boiling faces with a refrigerant necessary for the boiling.

A second object is to provide a cooling apparatus which is enabled to improve the radiation performance and make it easy for a vaporized refrigerant to leave the boiling portions of a refrigerant tank by enlarging a boiling area, thereby to make it difficult to cause the burnout.

A third object is to provide a cooling apparatus which is improved in the circulation performance of the refrigerant by reducing the interference in the refrigerant chamber between the condensed liquid and the vaporized refrigerant.

A fourth object is to provide a cooling apparatus, in which a refrigerant tank is assembled in a vehicle at in an inclination, which can restrain a liquid refrigerant in the refrigerant tank from spilling to the radiator side when the vehicle stops suddenly or ascends an uphill road.

A fifth object is to provide a cooling apparatus capable of preventing the burnout on heating body mounting faces close to a radiator without increasing the quantity of refrigerant excessively.

A sixth object is to provide a cooling apparatus, which is enabled to keep a high radiation performance even when a radiation rises, by suppressing an interference in a refrigerant chamber between a vaporized refrigerant and a condensed liquid.

According to the present invention, a cooling apparatus comprises boiling area increasing means disposed in the refrigerant tank for defining the inside of the refrigerant tank into a plurality of vertically extending passage portions to increase the boiling area, and the plurality of passage portions, which are defined by the boiling area increasing means, communicate with each other. According to this construction, even if some of the plurality of passage portions have more and less bubbles in accordance with the position of the heating portion of the heating body, the individual passage portions communicate with each other so that the bubbles rising in a passage portion can advance into other passage portions. As a result, the distributions of bubbles in the individual passage portions are substantially homogenized to make it liable for the boiling face to be filled with the refrigerant. This makes it difficult for the burnout to occur especially over the boiling face where the number of bubbles increase.

According to another aspect of the present invention, the vapor outlet and the liquid inlet are opened in the connecting tank, and the liquid inlet is opened at a lower position than that of the vapor outlet. According to this construction, the condensed liquid having dripped from the radiating portion into the connecting tank can flow preferentially into the liquid inlet opened at a lower position than that of the vapor outlet. As a result, since the condensed liquid flowing from the vapor outlet into the refrigerant chamber can be reduced, it can reduce the interference in the refrigerant chamber between the condensed liquid and the vaporized refrigerant.

According to still another aspect of the present invention, an upper end portion of the refrigerant tank is connected to the connecting tank with the refrigerant tank inclining, and a part of an upper end opening that opening into said connecting tank is covered by a back flow prevention plate. Therefore, even if the refrigerant tank is assembled at an inclination in the vehicle, it can prevent the liquid refrigerant in the refrigerant tank from spilling from the upper end opening when the vehicle stops suddenly or ascends the uphill road. Hence, the boiling can be stably filled with the liquid refrigerant.

According to further still another aspect of the present invention, the refrigerant tank is inclined at its two wall faces in the thickness direction at a predetermined direction from a vertical direction to a horizontal direction with respect to the radiator. The heating body is attached to the lower side wall face of the refrigerant tank in the thickness direction. The refrigerant tank is formed into such a shape in at least its range, in which the heating body is attached, in its longitudinal direction that its thickness size becomes gradually larger as the closer to the radiator. According to this construction, when the plurality of heating bodies are attached in the longitudinal direction of the refrigerant tank, for example, the bubbles, as generated on the individual heating body mounting faces, sequentially flow downstream (to the radiator). Even with this bubble flow, the bubbles can be prevented from filling up the heating body mounting face closer to the radiator because the thickness size of the refrigerant tank is made gradually larger. Since the number of bubbles to flow in the refrigerant tank becomes the smaller as the farther from the radiator, on the other hand, the burnout on the heating body mounting face close to the radiator can be prevented without increasing the quantity of refrigerant excessively, by reducing the thickness size of the refrigerant tank (in a taper shape) more far from the radiator than near the radiator.

BRIEF DESCRIPTION OF THE DRAWINGS

Additional objects and advantages of the present invention will be more readily apparent from the following detail description of preferred embodiments thereof when taken together with the accompanying drawings in which:

FIGS. 94A–94B are diagrams illustrating a shape of a partition plate provided in a refrigerant tank;

FIGS. 95A–95B are diagrams illustrating a shape of a refrigerant control plate provided in a lower tank;

FIG. 96 is a side view of a cooling apparatus (Twenty-eight Embodiment);

FIG. 97 is a plan view of the cooling apparatus;

FIG. 98 is a side view of a cooling apparatus (Twenty-ninth Embodiment); and FIG. 99 is a plan view of the cooling apparatus.

DETAILED DESCRIPTION OF THE PREFERRED EMBODIMENTS

Next, embodiments of the present inventions will be described with reference to the accompanying drawings.

[First Embodiment]

Figure 1:
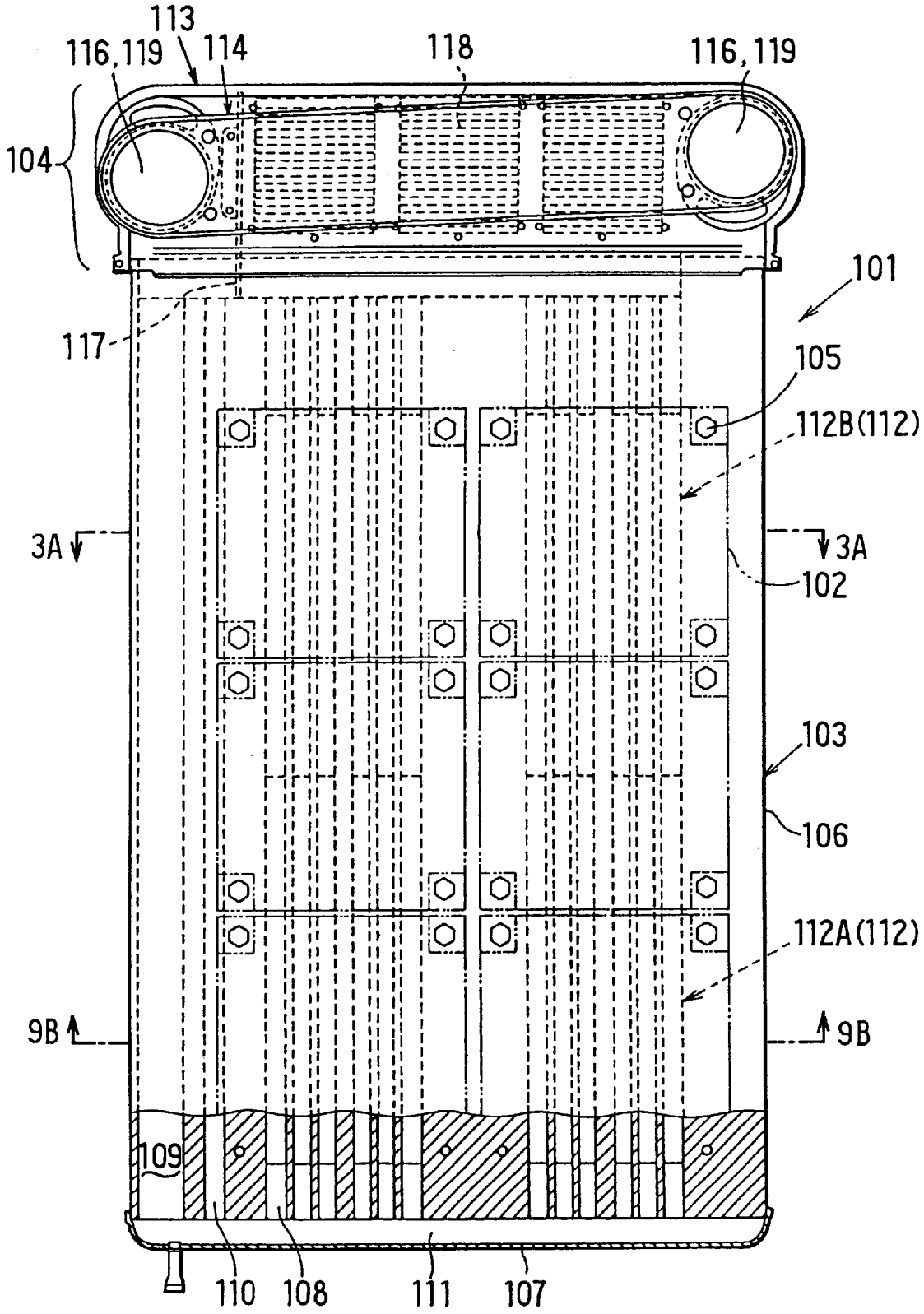
FIG. 1 is a plan view of a cooling apparatus (First Embodiment)

FIG. 1 is a plan view of a cooling apparatus 101.

The cooling apparatus 101 of this embodiment cools a heating body 102 by boiling and condensing a refrigerant repeatedly and is manufactured, by an integral soldering, of a refrigerant tank 103 for reserving a liquid refrigerant therein and a radiator 104 assembled over the refrigerant tank 103.

Figure 2:
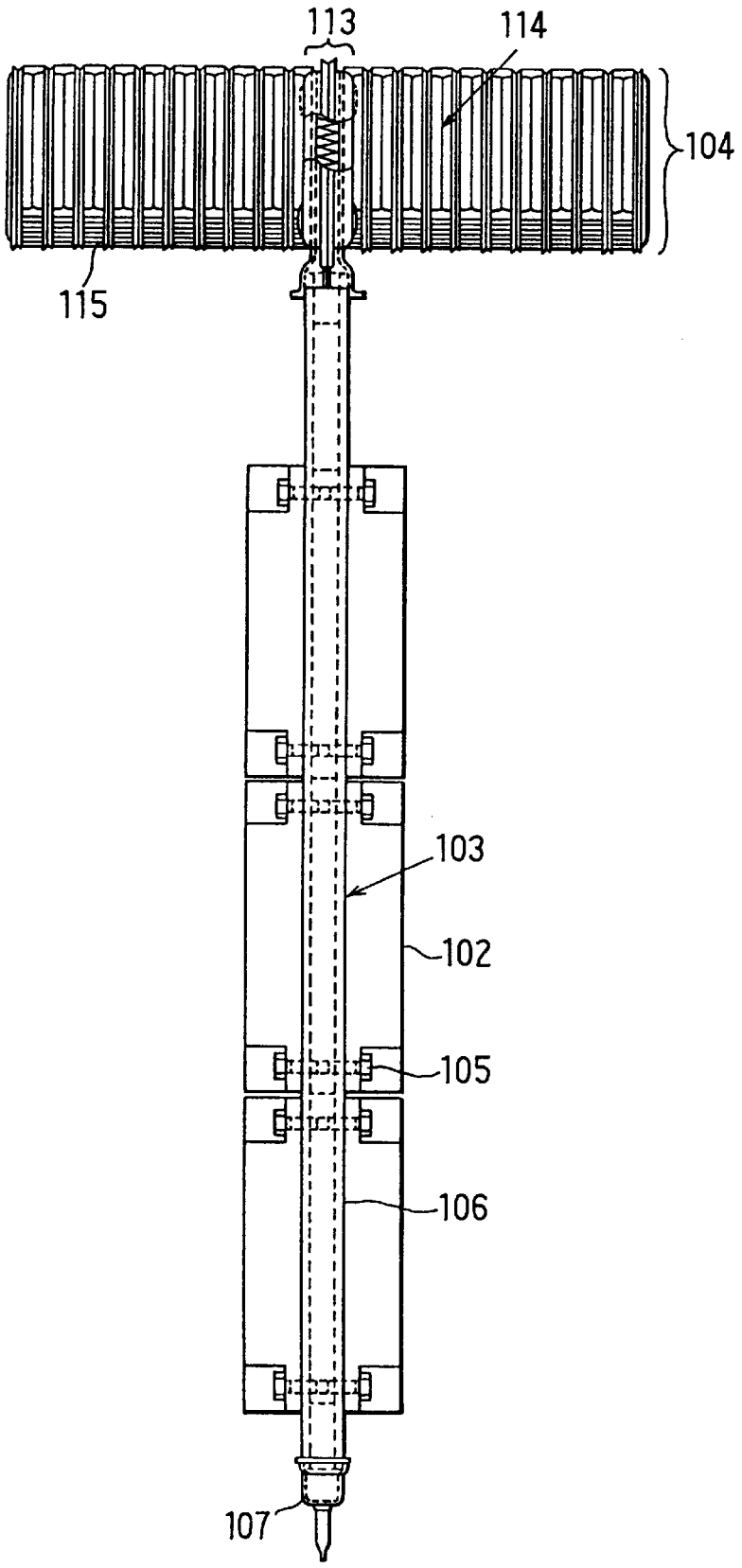
FIG. 2 is a side view of the cooling apparatus.

The heating body 102 is exemplified by an IGBT module constructing the inverter circuit of an electric vehicle and is fixed in close contact on the surface of the refrigerant tank 103 by such as bolts 105, as shown in FIG. 2.

The refrigerant tank 103 is composed of a hollow member 106 and an end cup 107 and is provided therein with refrigerant chambers 108, liquid returning passages 109, thermal insulation passages 110 and a communication passage 111 (as referred to FIG. 1).

Figure 3A:
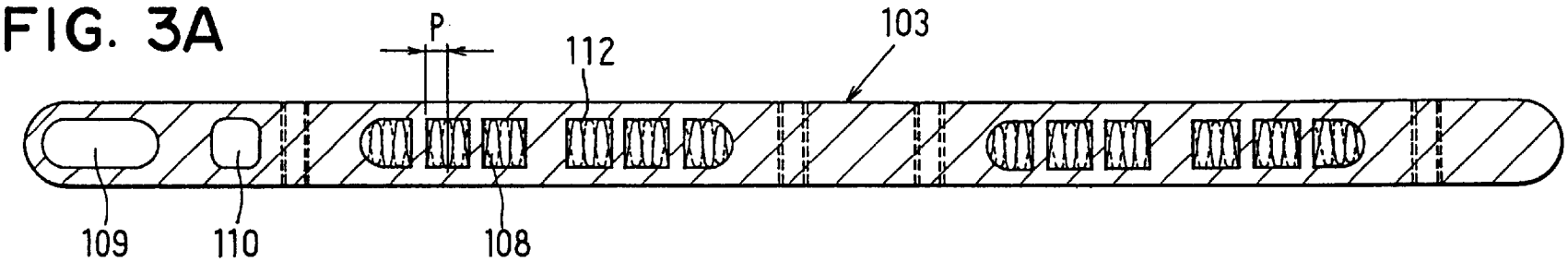
FIG. 3A is a sectional view taken along line 3A—3A in FIG. 1.
Figure 3B:
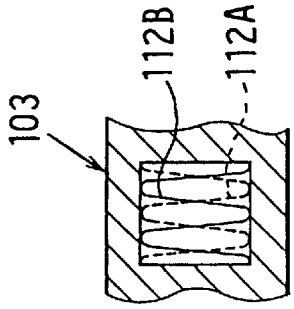
FIG. 3B is an enlarged view of FIG. 3A.

The hollow member 106 is an extrusion molding made of a metallic material having an excellent thermal conductivity such as aluminum and is formed into a thin shape having a smaller thickness than the width, as shown in FIGS. 3A, 3B. Through the hollow member 106, there are vertically extended a plurality of hollow holes for forming the refrigerant chambers 108, the liquid returning passages 109 and the thermal insulation passages 110.

The end cup 107 is made of aluminum, for example, like the hollow member 106 and covers the lower end portion of the hollow member 106.

The refrigerant chambers 108 are partitioned into a plurality of passages to form chambers for boiling a liquid refrigerant reserved therein when they receives the heat of the heating body 102. In these refrigerant chambers 108, as shown in FIG. 3A, there are inserted corrugated fins 112 which are folded in corrugated shapes for the individual passages so as to increase the boiling area in the refrigerant tank 103. These corrugated fins 112 are composed of lower corrugated fins 112A arranged to correspond to the lower of the boiling faces to receive the heating body 102, and upper corrugated fins 112B arranged to correspond to the upper sides of the boiling faces. These lower and upper corrugated fins 112A and 112B are individually held in thermal contact with the boiling faces of the refrigerant chambers 108.

The lower corrugated fins 112A and the upper corrugated fins 112B are individually inserted in the longitudinal direction with a common fin pitch P to partition the individual refrigerant chambers 108 further into a plurality of narrow passage portions. Here, the lower corrugated fins 112A and the upper corrugated fins 112B are so inserted in the refrigerant chambers 108 that their crests and valleys are staggered in their transverse direction (horizontal in FIGS. 3A, 3B), as shown in FIG. 3B. Specifically, the lower corrugated fins 112A and the upper corrugated fins 112B are so inserted into the individual passages that their back-and-forth directions are inverted each other (vertical in FIGS. 3A, 3B).

The liquid returning passages 109 are passages into which the condensed liquid cooled and liquefied by the radiator 104 flows, and are disposed at the most left side of the hollow member 106 in FIG. 1.

The thermal insulation passages 110 are passages for the thermal insulations between the refrigerant chambers 108 and the liquid returning passages 109 and are interposed between the refrigerant chambers 108 and the liquid returning passages 109.

The communication passage 111 is a passage for feeding the refrigerant chambers 108 with the condensed liquid having flown into the liquid returning passages 109, and is formed between the end cup 107 and the lower end face of the hollow member 106 to communicate between the liquid returning passages 109, the refrigerant chambers 108 and the thermal insulation passages 110.

The radiator 104 is the so-called "drawn cup type" heat exchanger composed of a connecting chamber 113, radiating chambers 114 and radiating fins 115 (as referred to FIG. 2).

The connecting chamber 113 provides a connecting portion to the refrigerant tank 103 and is assembled with the upper end portion of the refrigerant tank 103. This connecting chamber 113 is formed by joining two pressed sheets at their outer peripheral edge portions and is opened to have round communication ports 116 at its two longitudinal (horizontal in FIG. 1) end portions. A partition plate 117 is arranged in the connecting chamber 113 to partition this chamber into a first communication chamber (or a space located on the right side of the partition plate 117 in FIG. 1) for communicating with the refrigerant chambers 108 of the refrigerant tank 103, and a second communication chamber (or a space located on the left side of the partition plate 117 in FIG. 1) for communicating between the liquid returning passages 109 and the thermal insulation passages 110 of the refrigerant tank 103. In the connecting chamber 113, there are inserted inner fins 118 made of aluminum, for example, as shown in FIG. 1.

The radiating chambers 114 are formed into flattened hollow chambers by joining two pressed sheets at their outer peripheral edge portions and are opened to form round communication ports 119 at their two longitudinal (horizontal in FIG. 1) end portions. A plurality of the radiating chambers 114 are provided individually on the two sides of the connecting chamber 113, as shown in FIG. 2, and are caused to communicate with each other through their communication ports 116 and 119. Here, the radiating chambers 114 are assembled at such a small inclination with the connecting chamber 113 as to provide a level difference between the communication ports 119 on the two left and right sides, as shown in FIG. 1.

The radiating fins 115 are corrugated by alternately folding a thin metal sheet having an excellent thermal conductivity (or an aluminum sheet, for example) into an undulating shape. These radiating fins 115 are fitted between the connecting chamber 113 and the radiating chambers 114 and between the adjoining radiating chambers 114 and are joined to the surfaces of the connecting chamber 113 and the radiating chambers 114.

Next, operations of this embodiment will be described.

The heat, which is generated by the heating body 102, is transferred to the refrigerant reserved in the refrigerant chambers 108 through the boiling faces of the refrigerant chambers 108, the upper corrugated fins 112A, and the lower corrugated fins 112B so that the refrigerant is boiled. The boiled and vaporized refrigerant rises in the refrigerant chambers 108 and flows from the refrigerant chambers 108 into the first communication chamber of the connecting chamber 113 and further from the first communication chamber into the radiating chambers 114. The vaporized refrigerant having flow into the radiating chambers 114 is cooled while flowing therein by the heat exchange with the external fluid so that it is condensed while releasing its latent heat. The latent heat of the vaporized refrigerant is transmitted from the radiating chambers 114 to the radiating fins 115 until it is released through the radiating fins 115 to the external fluid.

The condensed liquid, which is condensed in the radiating chambers 114 into droplets, flows in the downhill direction (from the right to the left of FIG. 1) in the radiating chambers 114, and then through the second communication chamber of the connecting chamber 113 into the liquid returning passages 109 and the thermal insulation passages 110 of the refrigerant chambers 108 until it is recycled through the communication passage 111 into the refrigerant chambers 108.

(Effects of the First Embodiment)

Figure 4:
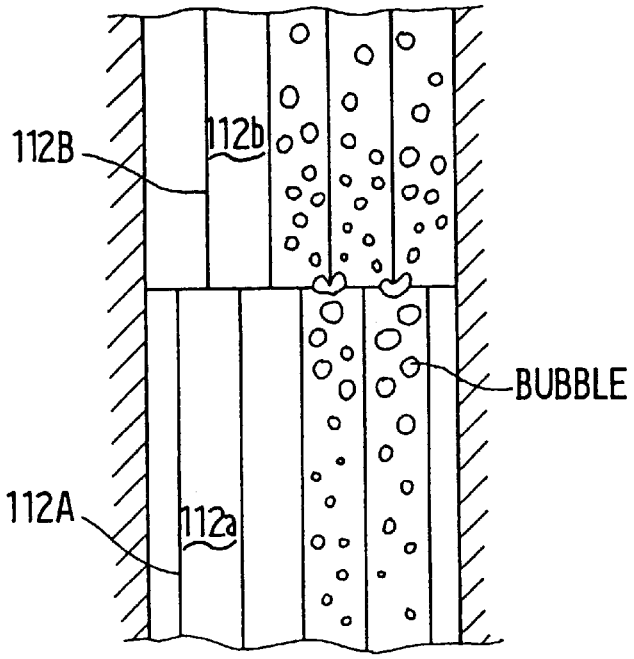
FIG. 4 is a diagram illustrating an effect of disposing corrugated fins.

In this embodiment, as shown in FIG. 4, lower passage portions 112*a*, which are defined by the lower corrugated fins 112A arranged to correspond to the lower sides of the boiling faces, and upper passage portions 112*b*, which are defined by the upper corrugated fins 112B arranged to correspond to the upper sides of the boiling faces, are transversely staggered in communication with each other. Specifically, in FIG. 4, one lower passage portion 112*a* has communication at its upper end with two upper passage portions 112*b*. In this case, bubbles rising in the one lower passage portion 112*a* can advance separately into the two upper passage portions 112*b*.

Figure 5:
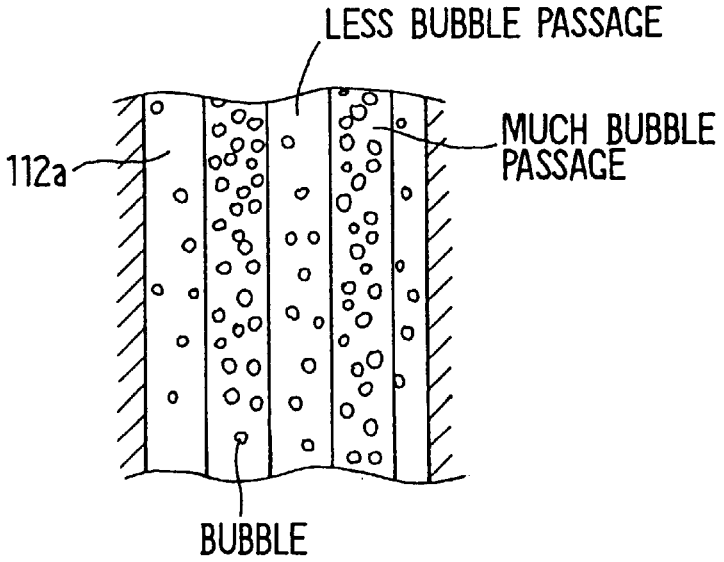
FIG. 5 is a diagram illustrating bubble amounts in passage portions defined by the corrugated fins.

As shown in FIG. 5, therefore, even if some of the lower passage portions 112*a* have much bubbles whereas the others have less, the bubbles rising in the individual lower passage portions 112*a* are individually scattered to advance into the two upper passage portions 112*b* so that their quantity is substantially homogenized in the individual upper passage portions 112*b*. Even if the bubbles rising in the lower passage portions 112*a* join together to grow larger ones, on the other hand, they highly probably impinge, when they advance into the upper passage portions 112*b*, against the lower ends of the upper corrugated fins 112B so that they are divided again into smaller bubbles. As a result, the bubbles rising in the lower passage portions 112*a* can be more homogeneously dispersed to advance into the upper passage portions 112*b*. Thus, the distributions of bubbles in the individual upper passage portions 112*b* can be substantially homogenized to fill the boiling faces more stably with the refrigerant so that the burnout can be made difficult to occur especially over the boiling faces where the number of bubbles increases.

[Second Embodiment]

Figure 6:
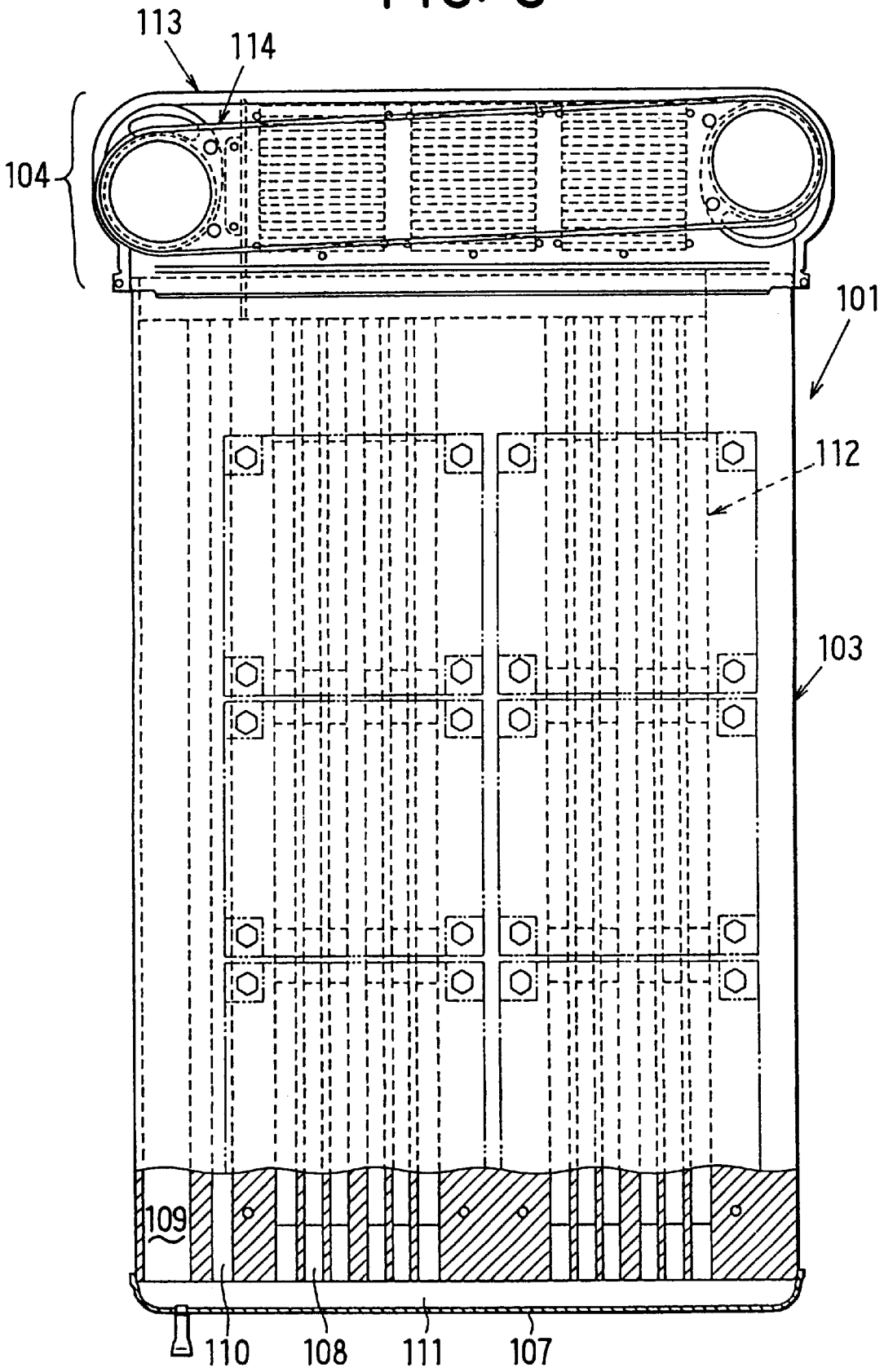
FIG. 6 is a plan view of a cooling apparatus (Second Embodiment)

FIG. 6 is a plan view of a cooling apparatus 101.

Figure 7:
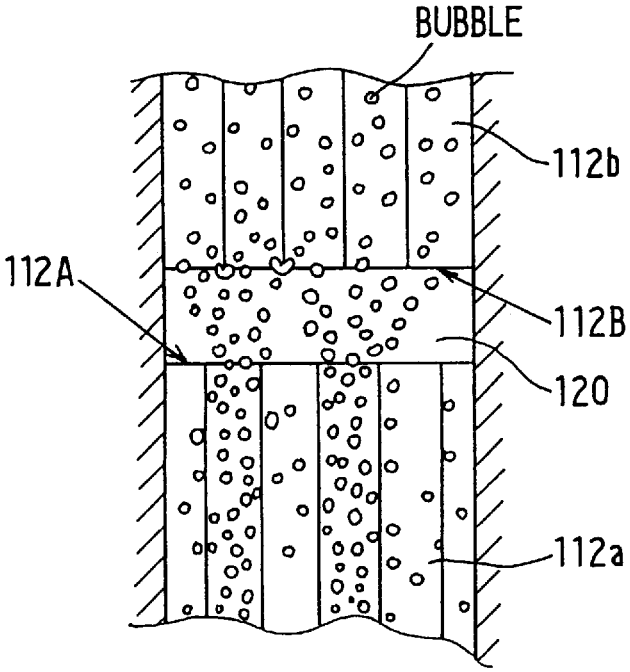
FIG. 7 is a diagram illustrating an effect of disposing corrugated fins.

In this embodiment, the corrugated fins 112 are arranged at individual positions corresponding to the lower, intermediate and upper portions of the boiling faces of the refrigerant tank 103. The individual corrugated fins 112 are given an identical fin pitch and are inserted vertically in the individual passages of the refrigerant chambers 108 as in the first embodiment. On the other hand, the individual corrugated fins 112 are not vertically arranged in contact with each other, but a predetermined space 120 is retained, between the lower corrugated fins 112A arranged in the vertically lower location and the upper corrugated fins 112B arranged in the upper location, as shown in FIG. 7.

Here will be described the relations between the lower corrugated fins 112A arranged on the lower side and the upper corrugated fins 112B arranged on the upper side. In the relation between the corrugated fins 112 arranged at the lowermost location and the condensed refrigerant arranged in the intermediate location, as shown in FIG. 6, the lowermost corrugated fins 112 are the lower corrugated fins 112A arranged on the lower side, and the intermediate corrugated fins 112 are the upper corrugated fins 112B arranged on the upper side. In the relation between the corrugated fins 112 arranged in the intermediate location and the corrugated fins 112 arranged in the uppermost location, however, the corrugated fins 112 arranged in the intermediate location are the lower corrugated fins 112A arranged on the lower side, and the corrugated fins 112 arranged in the uppermost location are the upper corrugated fins 112B arranged on the upper side.

In the construction of this embodiment, the bubbles, which have risen in the lower passage portions 112*a* defined by the lower corrugated fins 112A arranged on the lower side, are horizontally scattered in the spaces 120 which are retained between them and the upper corrugated fins 112B arranged on the upper side. Even if some of the lower passage portions 112*a* have much bubbles whereas the others have less, therefore, the bubbles rising in the individual lower passage portions 112*a* can be scattered to advance into the upper passage portions 112*b* defined by the upper corrugated fins 112B arranged on the upper side, so that their quantity is substantially homogenized in the individual upper passage portions 112*b*.

Even if the bubbles rising in the lower passage portions 112*a* join together to grow larger ones, on the other hand, they highly probably impinge, when they advance into the upper passage portions 112*b*, against the lower ends of the upper corrugated fins 112B arranged on the upper side, so that they are divided again into smaller bubbles. As a result, the bubbles rising in the lower passage portions 112*a* can be more homogeneously dispersed to advance into the upper passage portions 112*b*. Thus, the distributions of bubbles in the individual upper passage portions 112*b* can be substantially homogenized to fill the boiling faces more stably with the refrigerant so that the burnout can be made difficult to occur especially over the boiling faces where the number of bubbles increases.

(Modification of the Second Embodiment)

In this embodiment, the space 120 is formed between the lower corrugated fins 112A arranged on the lower side and the upper corrugated fins 112B arranged on the upper side. However, third corrugated fins may also be additionally arranged in that space 130. Here, these additional corrugated fins 112 are desired to have a larger fin pitch than that of the lower corrugated fins 112A and the upper corrugated fins 112B so that the bubbles having risen in the lower passage portions 112*a* may be dispersed.

In this embodiment, on the other hand, the space 120 is formed between the lower corrugated fins 112A and the upper corrugated fins 112B so that the lower corrugated fins 112A and the upper corrugated fins 112B need not be horizontally staggered. Like the first embodiment, however, the lower and upper corrugated fins 112A and 112B may be inserted into the individual passages with their crests and valleys being horizontally staggered.

[Third Embodiment]

Figure 8:
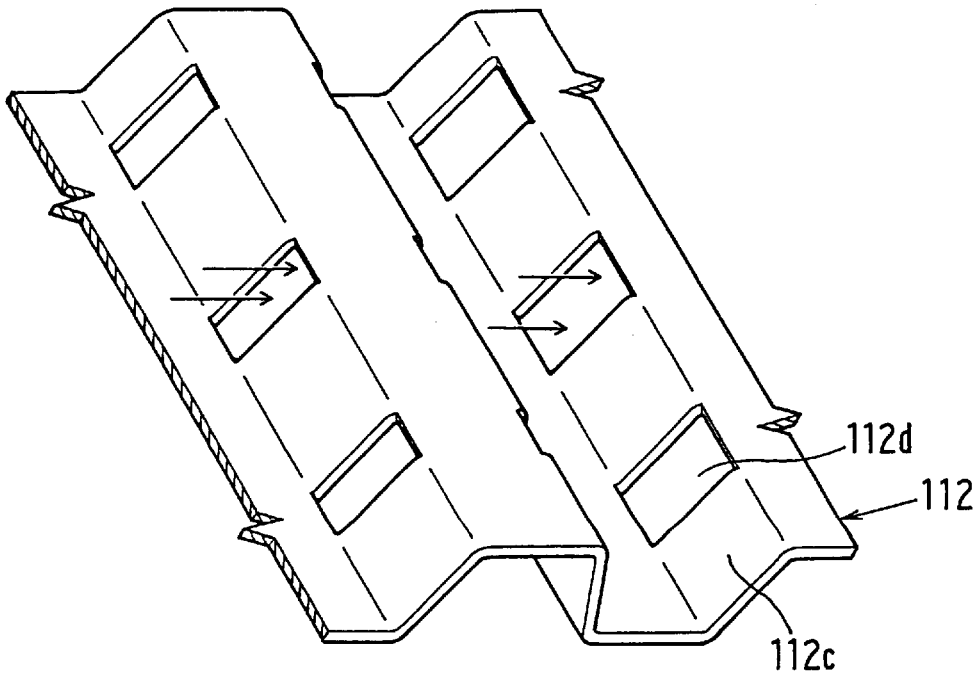
FIG. 8 is a perspective view of the corrugated fins (Third Embodiment).

FIG. 8 is a perspective view of corrugated fins 112.

In this embodiment, openings 112*d* are formed in the side faces 112*c* of the corrugated fins 112 defining the passage portions.

In this case, the passage portions adjoining to each other through the side faces 112*c* of the corrugated fins have communication with each other through the openings 112*d* so that the bubbles rising in one passage portion can advance into other passage portions through the openings 112*d*. As a result, the distributions of bubbles in the individual passage portions can be substantially homogenized to facilitate passage of the bubbles so that the burnout can be made difficult to occur especially over the boiling faces where the number of bubbles increases.

Here, the openings 112*d* may be replaced by (not-shown) louvers which are cut up from the side faces 112*c* of the corrugated fins 112. In this case, too, the passage portions adjoining to each other through the side faces 112*c* of the corrugated fins 112 have communication with the openings which are made by cutting up the louvers. As a result, the bubbles rising in one passage portion can advance into other passage portions through those openings as in the case where the openings 112*d* are opened in the side faces 112*c* of the corrugated fins 112. Furthermore, the corrugated fins 112 have their own surface area unchanged even if the louvers are formed on their side faces 112*c* of the corrugated fins 112 so that the radiating area is not reduced even with the louvers.

[Fourth Embodiment]

Figure 9A:
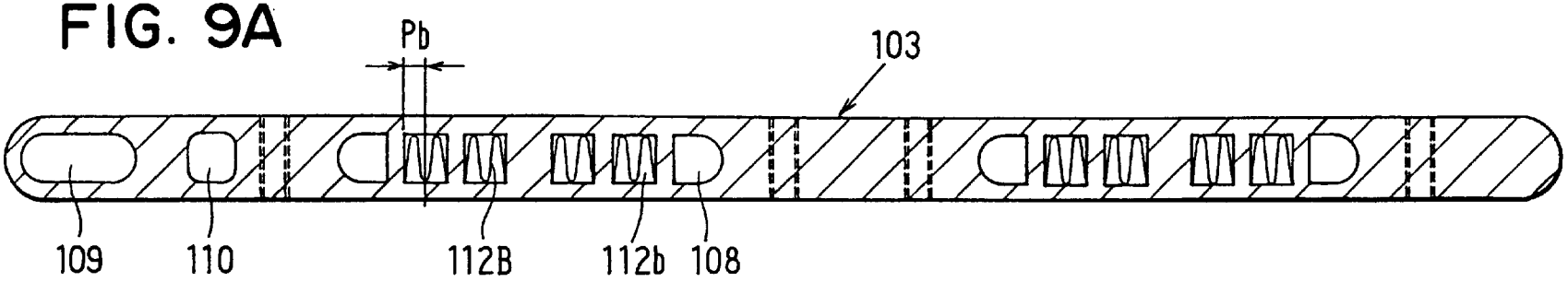
FIG. 9A is a sectional view taken along line 3A—3A of the cooling apparatus in FIG. 1.
Figure 9B:
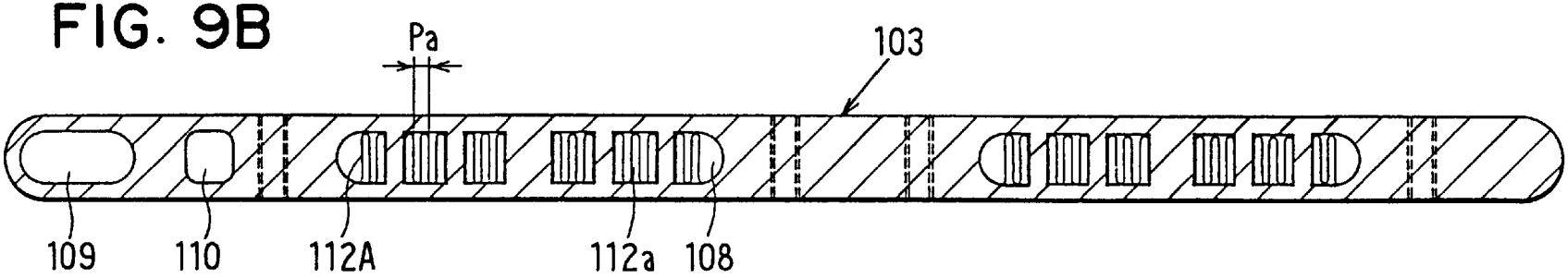
FIG. 9B is a sectional view taken along line 9B—9B of the cooling apparatus in FIG. 1 (Fourth Embodiment)
Figure 10:
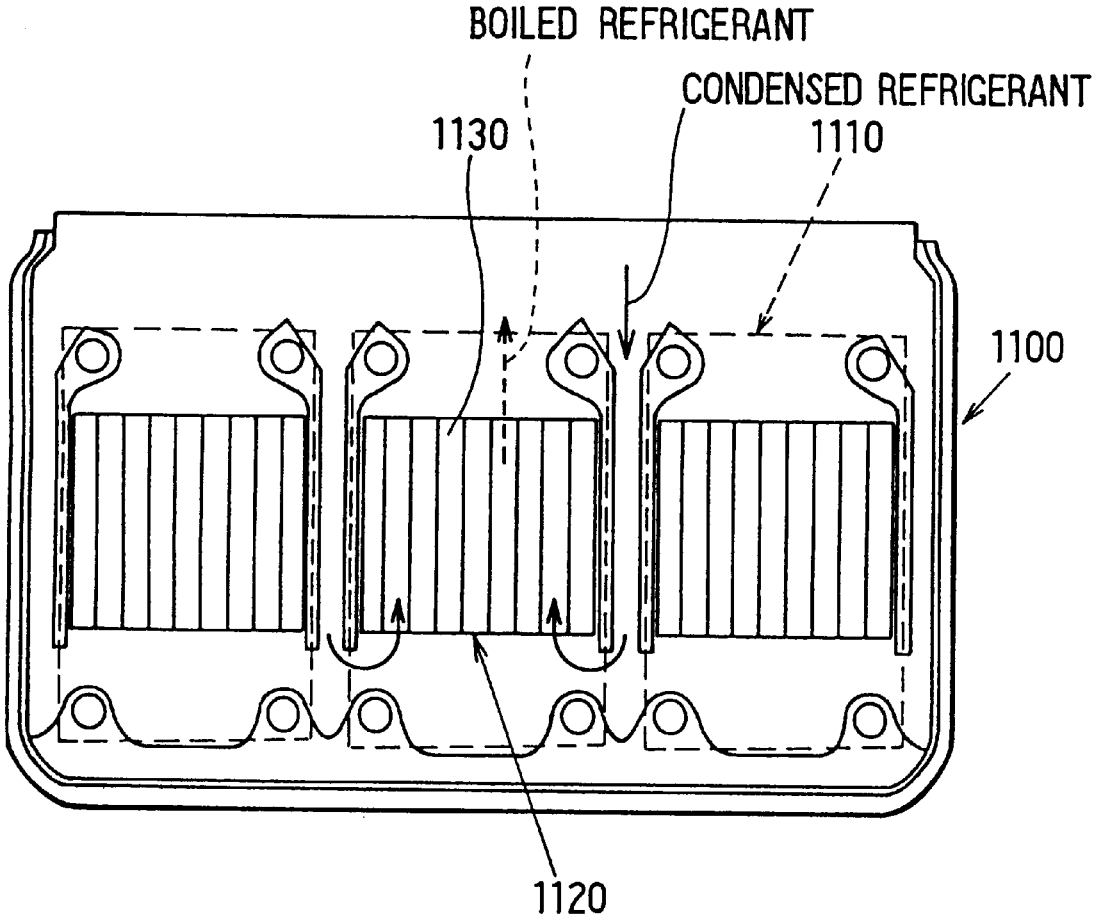
FIG. 10 PRIOR ART
FIG. 10 is a plan view illustrating an inside of a refrigerant tank of a conventional cooling apparatus.

FIGS. 9A, 9B are sectional views of a refrigerant tank 103.

In this embodiment, the upper corrugated fins 112B arranged on the upper side shown in FIG. 9A is given a larger fin pitch Pb than the fin pitch Pa of the lower corrugated fins 112A arranged on the lower side shown in FIG. 9B.

In this case, an average open area of the plurality of upper passage portions 112*b* defined by the upper corrugated fins 112B is larger than that of the plurality of lower passage portions 112*a* defined by the lower corrugated fins 112A. According to this construction, even if the number of bubbles increases the more for the higher portion of the refrigerant chambers 108, the ratio of the number of bubbles to the average open area can be homogenized between the lower passage portions 112*a* and the upper passage portions 112*b*. As a result, these upper passage portions 112*b*, which are defined by the upper corrugated fins 112B, can be filled more stably with the refrigerant so that the occurrence of the burnout in the upper portions of the boiling faces can be suppressed.

[Fifth Embodiment]

Figure 11:
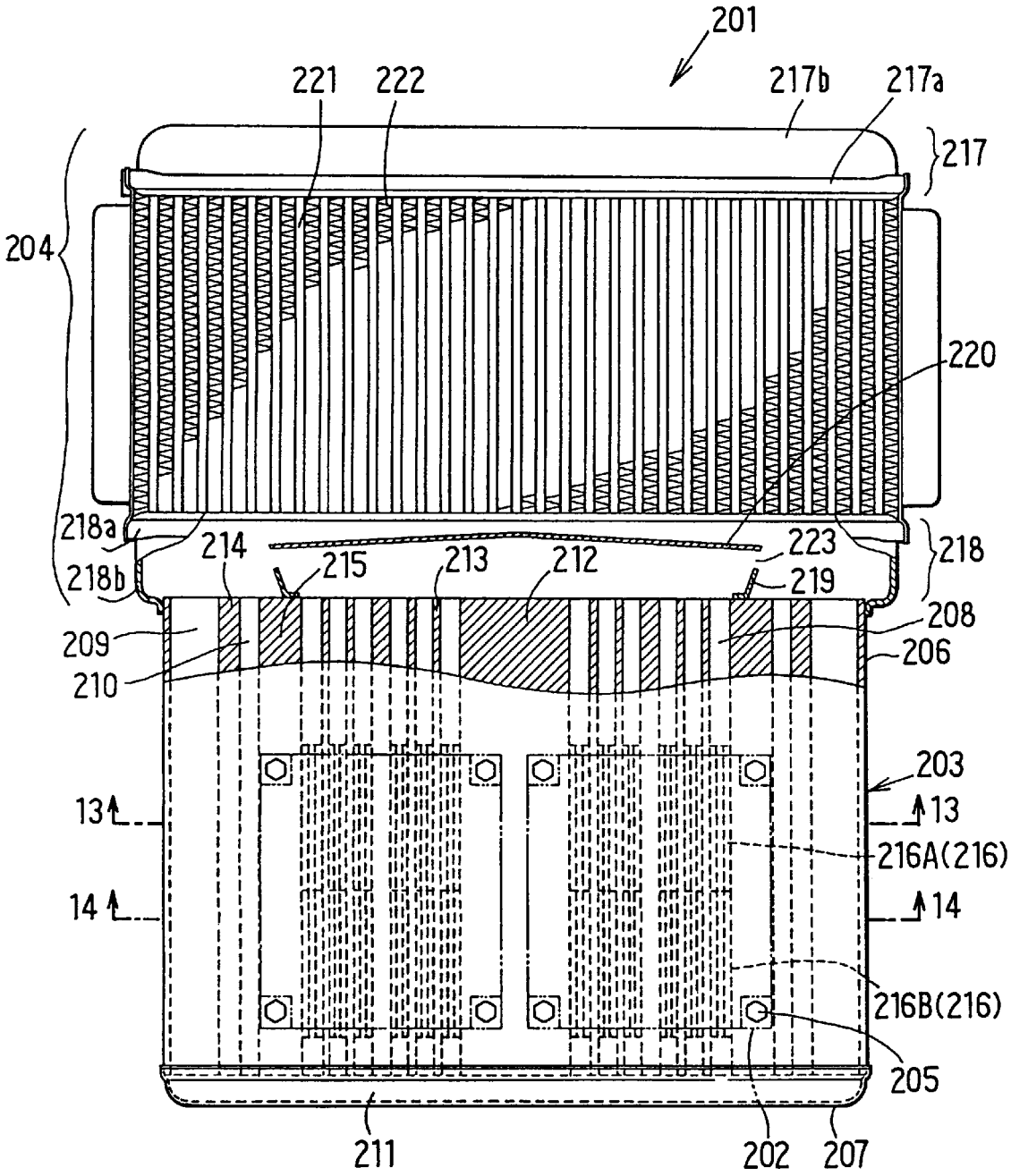
FIG. 11 is a plan view of a cooling apparatus (Fifth Embodiment)

FIG. 11 is a plan view of a cooling apparatus 201.

The cooling apparatus 201 of this embodiment cools a heating body 202 by making use of the boiling and condensing actions of a refrigerant and is provided with a refrigerant tank 203 for reserving the refrigerant therein, and a radiator 204 disposed over the refrigerant tank 203.

Figure 12:
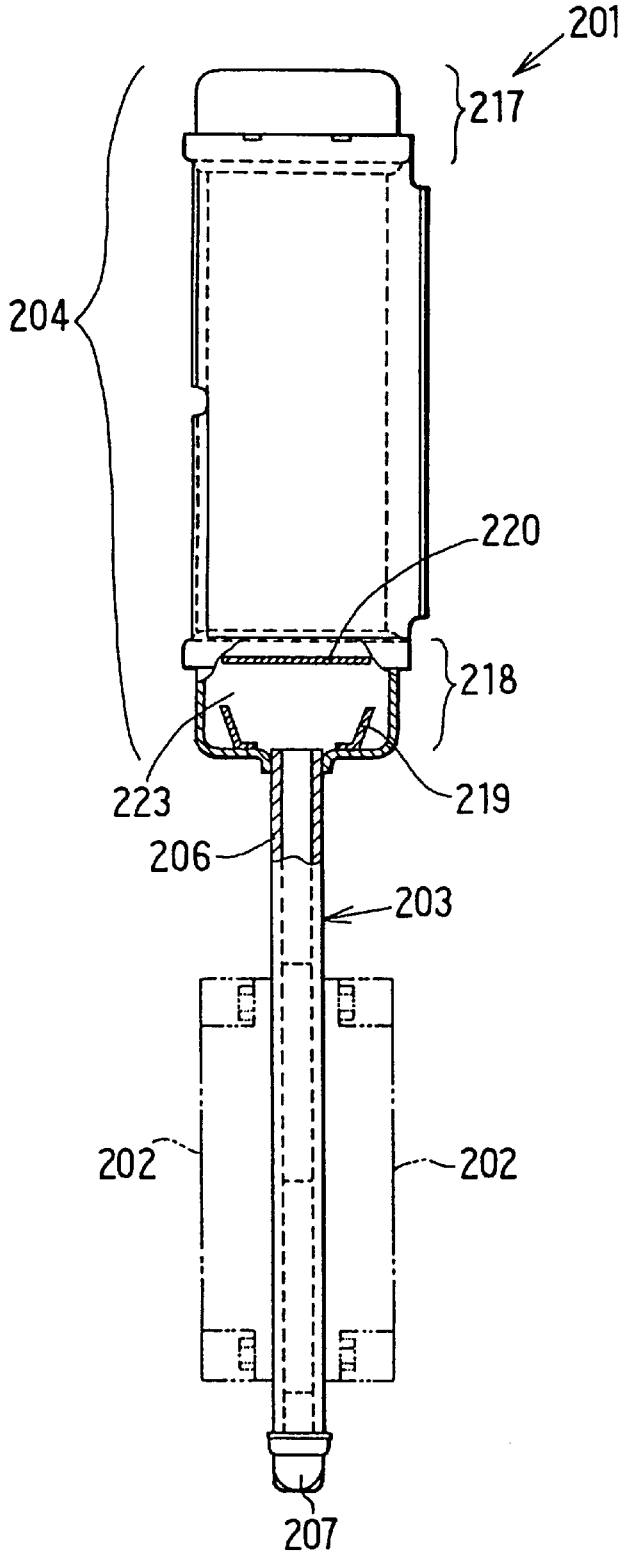
FIG. 12 is a side view of the cooling apparatus.

The heating body 202 is an IGBT module constructing an inverter circuit of an electric vehicle, for example, and is fixed in close contact with the two side surfaces of the refrigerant tank 203 by fastening bolts 205 (as referred to FIG. 12).

The refrigerant tank 203 is includes a hollow member 206 made of a metallic material such as aluminum having an excellent thermal conductivity, and an end tank 207 covering the lower end portion of the hollow member 206, and is provided therein with refrigerant chambers 208, liquid returning passages 209, thermal insulation passages 210 and a circulating passage 211.

The hollow member 206 is formed of an extruding molding, for example, into a thin flattened shape having a smaller thickness (i.e., a transverse size of FIG. 12) than the width (i.e., a transverse size of FIG. 11), and is provided therein with a plurality of passage walls (a first passage wall 212, second passages wall 213, third passage walls 214 and fourth passage walls 215).

Figure 15:
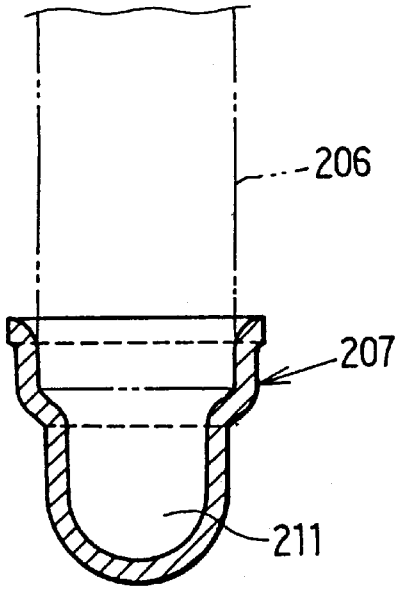
FIG. 15 is a sectional view of an end tank.

The end tank 207 is made of aluminum, for example, like the hollow member 206 and is joined by a soldering method or the like to the lower end portion of the hollow member 206. However, a space 211 is retained between the inner side of the end tank 207 and the lower end face of the hollow member 206, as shown in FIG. 15.

The refrigerant chambers 208 are formed on the two left and right sides of the first passage wall 212 disposed at the central portion of the hollow member 206 and are partitioned therein into a plurality passages by the second passage walls 213. These refrigerant chambers 208 form boiling regions in which the refrigerant reserved therein is boiled by the heat of the heating body 202. Corrugated fins 216 (216A, 216B) are inserted to inside of the refrigerant chamber 208 to enlarge a boiling area of the boiling regions.

Figure 13:
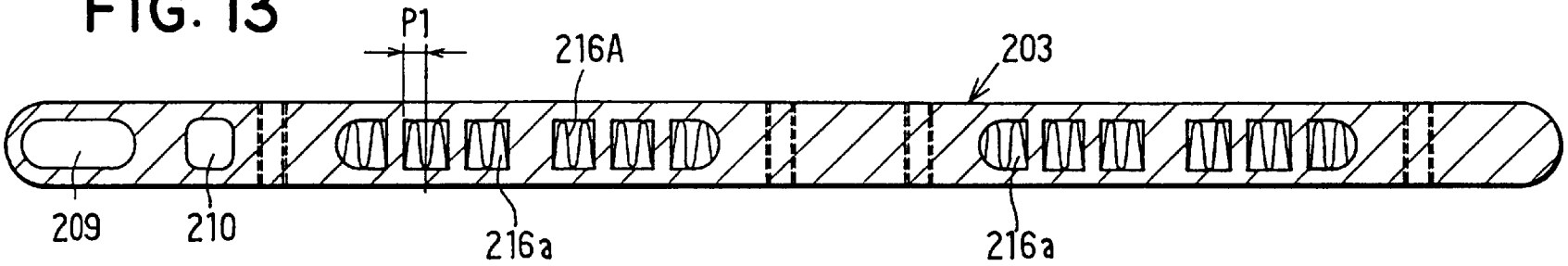
FIG. 13 is a sectional view taken along line 13—13 in FIG. 11.
Figure 14:
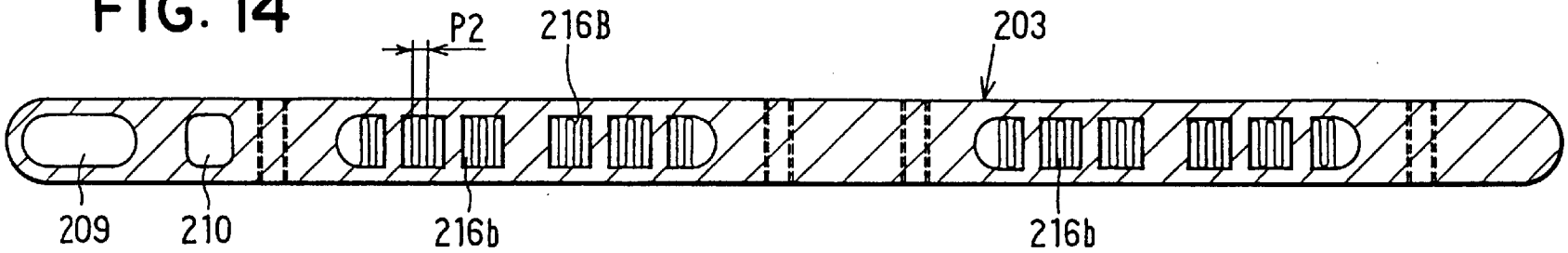
FIG. 14 is a sectional view taken along line 14—14 in FIG. 11.

The corrugated fins 216 include first corrugated fins 216A (as referred to FIG. 13) having a wide pitch P1 and second corrugated fins 216B (as referred to FIG. 14) having a narrow pitch P2. The first corrugated fins 216A are arranged in the upper side of the boiling regions, whereas the second corrugated fins 216B are arranged in the lower side of the boiling regions (as referred to FIG. 11). Here, both of the first corrugated fins 216A and the second corrugated fins 216B are vertically inserted to the refrigerant chamber 208, as shown in FIGS. 13, 14, and divide the refrigerant chamber 208 into a plurality of small passage portions 216*a*, 216*b*, which are vertically extend in the refrigerant chamber 208.

The liquid returning passages 209 are passages into which the condensed liquid condensed in the radiator 204 flows back, and are formed on the two outer sides of the third passage walls 214 disposed on the two left and right sides of the hollow member 206.

The thermal insulation passages 210 are provided for thermal insulation between the refrigerant chambers 208 and the liquid returning passages 209 and are formed between the third passage walls 213 and the fourth passage walls 214.

The circulating passage 211 is a passage for feeding the refrigerant chambers 208 with the condensed liquid having flown into the liquid returning passages 209 and is formed by the inner space (as referred to FIG. 15) of the end tank 207 to provide communication between the liquid returning passages 209, and the refrigerant chambers 208 and the thermal insulation passages 210.

The radiator 204 is composed of a core portion (as will be described in the following), an upper tank 217 and a lower tank 218, and refrigerant flow control plates (composed of a side control plate 219 and an upper control plate 219) is disposed in the lower tank 218.

The core portion is the radiating portion of the invention for condensing and liquefying the vaporized refrigerant, as boiled by the heat of the heating body 202, by the heat exchange with an external fluid (such as air). The core portion is composed of pluralities of radiating tubes 221 vertically juxtaposed and radiating fins 222 interposed between the individual radiating tubes 221. Here, the core portion is cooled by receiving the air flown by a not-shown cooling fan.

The radiating tubes 221 form passages in which the refrigerant flows and are used by cutting flat tubes made of an aluminum, for example, to a predetermined length. Corrugated inner fins 222 may be inserted into the radiating tubes 221.

The upper tank 217 is constructed by combining a shallow dish shaped core plate 217*a* and a deep dish shaped tank plate 217*b*, for example, and is connected to the upper end portions of the individual radiating tubes 221 to provide communication of the individual radiating tubes 221. In the core plate 217*a*, there are formed a number of (not-shown) slots into which the upper end portions of the radiating tubes 221 are inserted.

The lower tank 218 is constructed by combining a shallow dish shaped core plate 218*a* and a deep dish shaped tank plate 218*b*, similarly with the upper tank 217, and is connected to the lower end portions of the individual radiating tubes 221 to provide communication of the individual radiating tubes 221. In the core plate 218*a*, there are formed a number of (not-shown) slots into which the lower end portions of the radiating tubes 221 are inserted. In the tank plate 218*b*, on the other hand, there is formed a (not-shown) slot into which the upper end portion of the refrigerant tank 203 (or the hollow member 206) is inserted.

The refrigerant flow control plates prevent the condensed liquid, as liquefied in the core portion, from flowing directly into the refrigerant chambers 208 thereby to prevent interference in the refrigerant chambers 208 between the vaporized refrigerant and the condensed liquid.

This refrigerant flow control plates are composed of the side control plate 219 and the upper control plate 220, and vapor outlets 223 are opened in the side control plate 219.

The side control plate 219 is disposed at a predetermined level around (on the four sides of) the refrigerant chambers 208 opened into the lower tank 218, and its individual (four) faces are inclined outward, as shown in FIGS. 11 and 12. By disposing the side control plate 218 in the lower tank 218, on the other hand, there is formed an annular condensed liquid passage around the side control plate 219 in the lower tank 218, and the liquid returning passages 209 and the thermal insulation passages 210 are individually opened in the two left and right sides of the condensed liquid passage.

The upper control plate 220 covers all over the refrigerant chambers 208, which are enclosed by the side control plate 219. Here, this upper control plate 220 is the highest in the transverse direction and sloped downhill toward the two left and right sides of the side control plate 219, as shown in FIG. 11.

The vapor outlets 223 are openings for the vaporized refrigerant, as boiled in the refrigerant chambers 208, to flow out, and are individually fully opened to the width in the individual faces of the side control plate 219. However, the vapor outlets 223 are opened (as referred to FIGS. 11 and 12) at such a higher position than the bottom face of the lower tank 218 (upper end face of the refrigerant tank 203) that the condensed liquid flowing in the aforementioned condensed liquid passage may not flow thereinto. On the other hand, the upper ends of the vapor outlets 223 are opened along the upper control plate 219 up to the uppermost end of the side control plate 218.

Next, operations of this embodiment will be described.

The vaporized refrigerant, as boiled in the boiling portions of the refrigerant chambers 208 by the heat of the heating body 202, flows from the refrigerant chambers 208 into the space in the lower tank 218, as enclosed by the refrigerant flow control plates. After this, the vaporized refrigerant flows out from the vapor outlets 223, as opened in the side control plates 219, and further from the lower tank 218 into the individual radiating tubes 221. The vaporized refrigerant flowing in the radiating tubes 221 is cooled by the heat exchange with the external fluid blown to the core portion, so that it is condensed in the radiating tubes 221 to drip into the lower tank 218. At this time, the condensed liquid dripping from the radiating tubes 221 mostly falls on the upper face of the upper control plate 220 and then flows on the slopes of the upper control plate 220 so that it falls to the condensed liquid passage formed around the side control plates 219. A portion of the remaining condensed liquid drips directly into the liquid returning passages 209 or the thermal insulation passages 210 whereas the remainder flows into the condensed liquid passage. The condensed liquid, as reserved in the condensed liquid passage, flows into the liquid returning passages 209 and the thermal insulation passages 210 and is further recycled via the circulating passage 211 to the refrigerant chambers 208.

(Effects of the Fifth Embodiment)

In the cooling apparatus 201 of this embodiment, the corrugated fins 216 are inserted into the refrigerant chambers 208 to enlarge the boiling area so that the radiation performance can be improved.

Of the corrugated fins 216, on the other hand, the first corrugated fins 216A having a larger pitch are arranged on the upper side of the boiling portions whereas the second corrugated fins 216B having a smaller pitch are arranged on the lower side of the boiling portions. Even if the vapor becomes the more for the upper portion of the boiling portions, therefore, it does not reside in the upper portion of the boiling portions but can smoothly pass through the passage-shaped portions 216*a* which are defined by the first corrugated fins 216A. As a result, it is possible to make the burnout reluctant to occur in the upper portion of the boiling portions.

Here, the first corrugated fins 216A and the second corrugated fins 216B may be made of separate members or can be made of a single member (or single part).

On the other hand, the openings may be formed in the fin side faces of the individual corrugated fins 216A and 216B. In this case, the vaporized refrigerant, as generated in the boiling portions, not only rises in the passage-shaped portions 216*a* and 216*b* which are formed by the individual corrugated fins 216A and 216B, but also can flow through the openings formed in the fin side faces into another adjoining passage-shaped portions. As a result, even if the quantities of vapor are different between the individual passage-shaped portions, the vapor can be homogeneously diffused all over the boiling portions to provide a merit that the radiation performance can be better improved.

[Sixth Embodiment]

Figure 16:
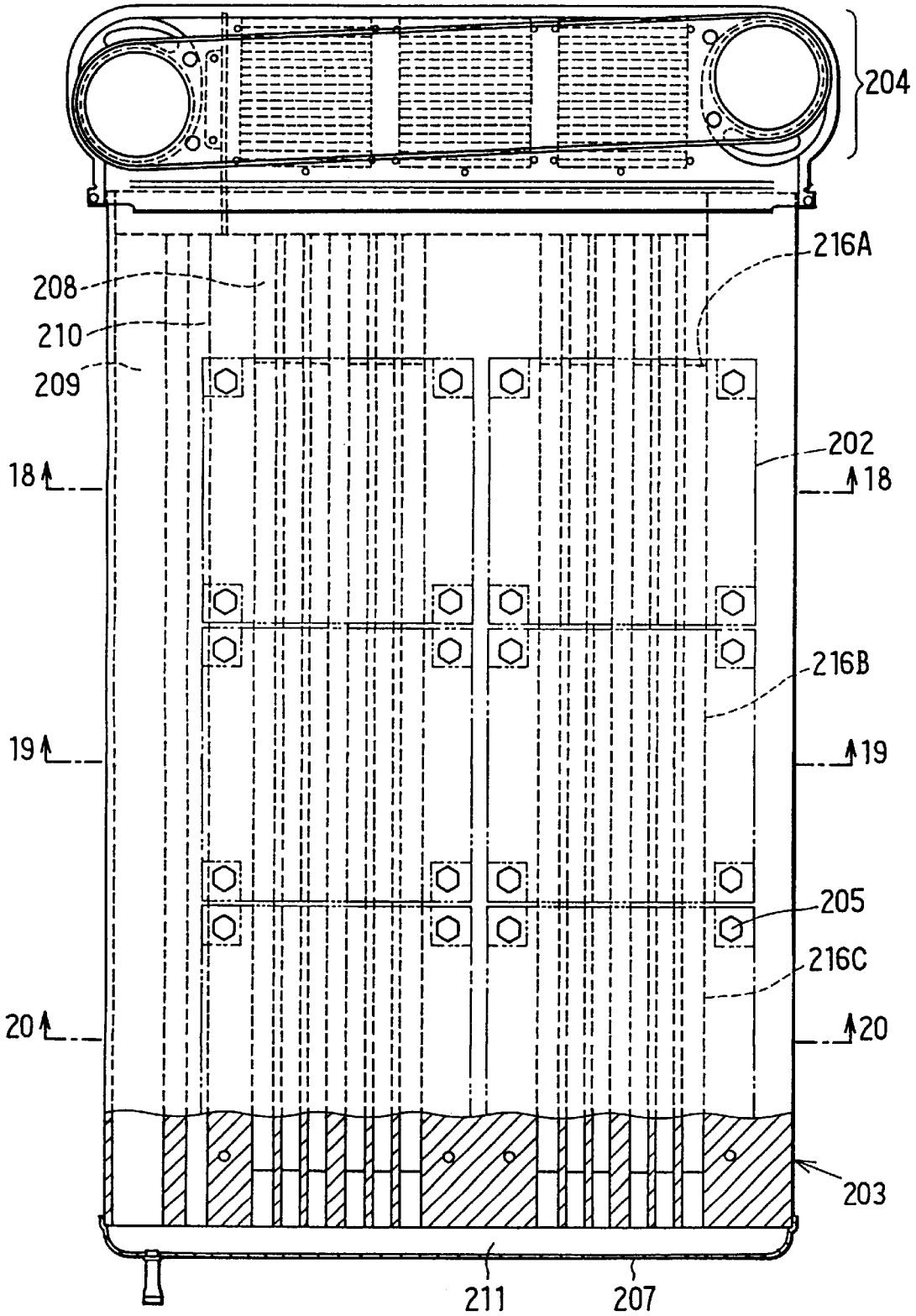
FIG. 16 is a plan view of a cooling apparatus (Sixth Embodiment)
Figure 17:
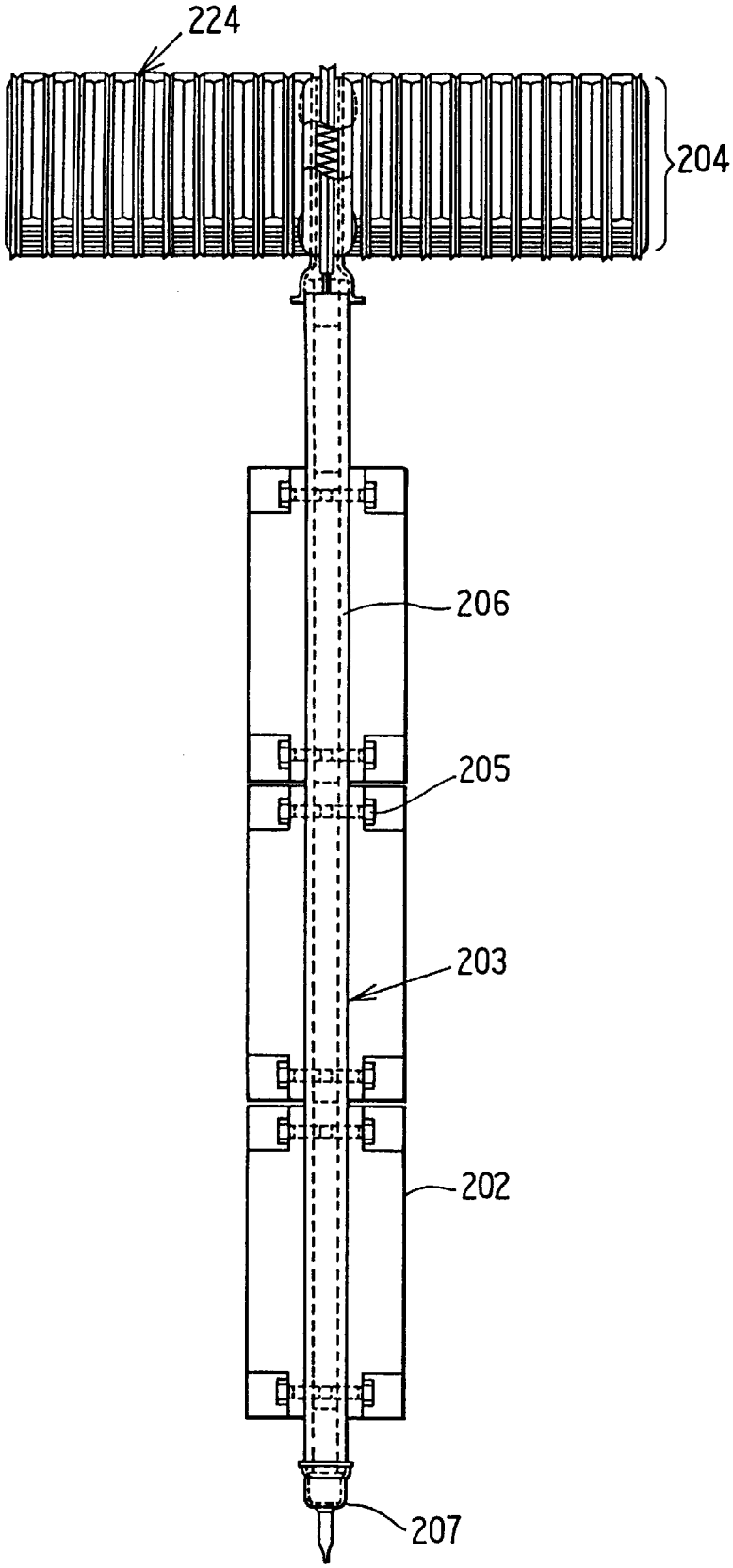
FIG. 17 is a side view of the cooling apparatus.

FIG. 16 is a plan view of a cooling apparatus 201, and FIG. 17 is a side view of the cooling apparatus 201.

In the cooling apparatus 201 of this embodiment, the refrigerant tank 203 is so vertically elongated that a plurality of heating bodies 202 can be vertically attached to the refrigerant tank 203. In this case, the corrugated fins 216 having different pitches are arranged in every boiling portion corresponding to the mounting faces of the individual heating bodies 202.

These corrugated fins 216 are composed of: the first corrugated fins 216A arranged in the boiling portions at the upper stage; the second corrugated fins 216B arranged in the boiling portions at the intermediate stage; and a third corrugated fins 216C arranged in the boiling portions at the lower stage. The second corrugated fins 216B have a pitch P2 smaller than the pitch P1 of the first corrugated fins 216A and larger than the pitch P3 of the third corrugated fins 216C (P1>P2>P3).

Figure 18:
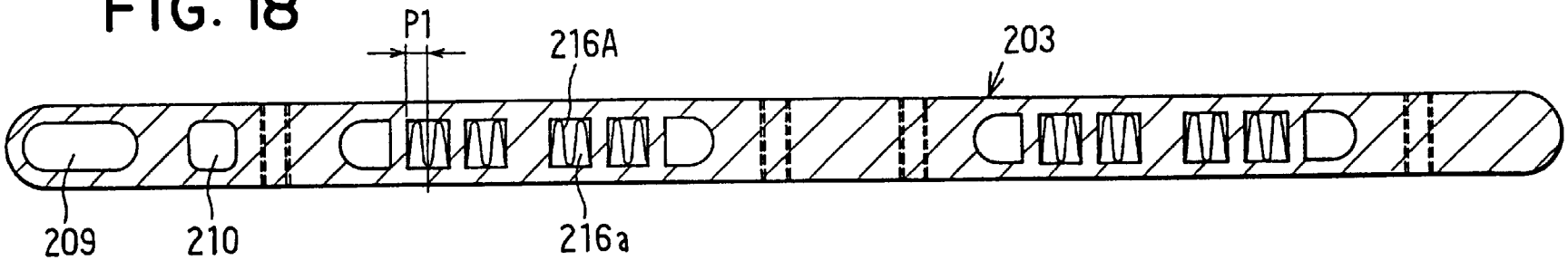
FIG. 18 is a sectional view taken along line 18—18 in FIG. 16.
Figure 19:
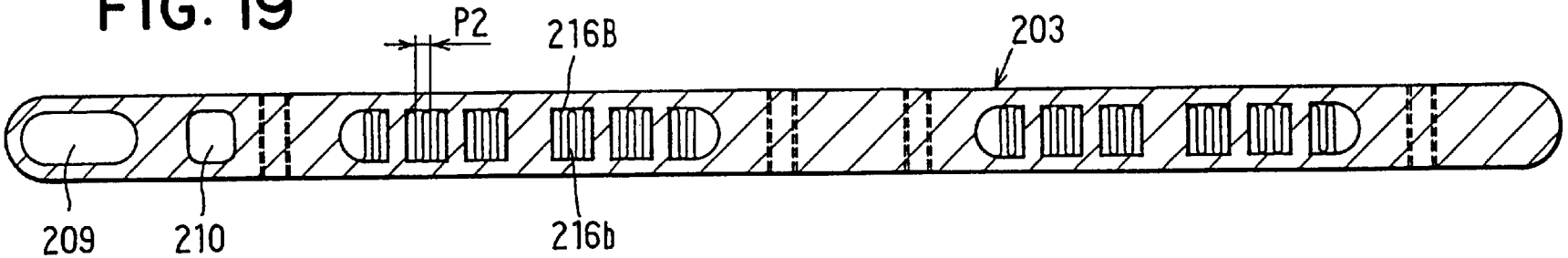
FIG. 19 is a sectional view taken along line 19—19 in FIG. 16.
Figure 20:
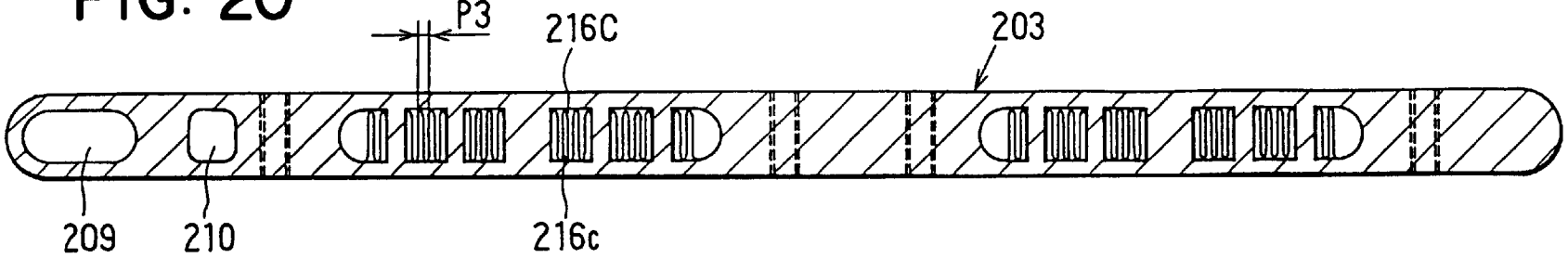
FIG. 20 is a sectional view taken along line 20—20 in FIG. 16.

Here, the individual corrugated fins 216A, 216B and 216C are individually vertically inserted into the refrigerant chambers 208 as in the Fifth Fmbodiment to define a plurality of small passage portions 216*a,* 216*b* and 216*c* extending vertically in the refrigerant chambers 208, as shown in FIGS. 18 to 20.

In this embodiment, the vaporized refrigerant, as generated in the boiling portions at the lower stage, rises in the refrigerant chambers 208 to join the vaporized refrigerant, as generated in the boiling portions at the intermediate stage, further rises in the refrigerant chambers 208 to join the vaporized refrigerant, as generated in the boiling portions at the upper so that its quantity becomes the more as it rise to the upper portion of the refrigerant chambers 208.

On the contrary, the second corrugated fins 216B, as arranged in the boiling portions at the intermediate stage, has a larger pitch than that of the third corrugated fins 216C arranged in the boiling portions at the lower stage, and the first corrugated fins 216A, as arranged in the boiling portions at the upper stage, has a larger pitch than that of the second corrugated fins 216B. Thus, the vapor can smoothly pass through the passage portions 216*b,* as defined by the second corrugated fins 216B, even if its quantity increases in the boiling portions at the intermediate stage, and the steam can smoothly pass through the passage portions 216*a,* as defined by the first corrugated fins 216A, even if its quantity increases in the boiling portions at the upper stage. As a result, it is possible to make the burnout reluctant to occur in the boiling portions at the intermediate and upper stages.

The radiator 204, as shown in this embodiment, is a drawn cup type heater exchanger which is constructed by overlapping a plurality of radiating tubes 224 horizontally to match a vertical flow, as shown in FIG. 17, but may be constructed to match a horizontal flow as in the fifth embodiment.

The individual corrugated fins 216A, 216B and 216C may be made of separate members or can be made of a single member (or single part).

As in the Fifth Embodiment, on the other hand, the openings may be formed in the fin side faces of the individual corrugated fins 216A, 216B and 216C.

Figure 21:
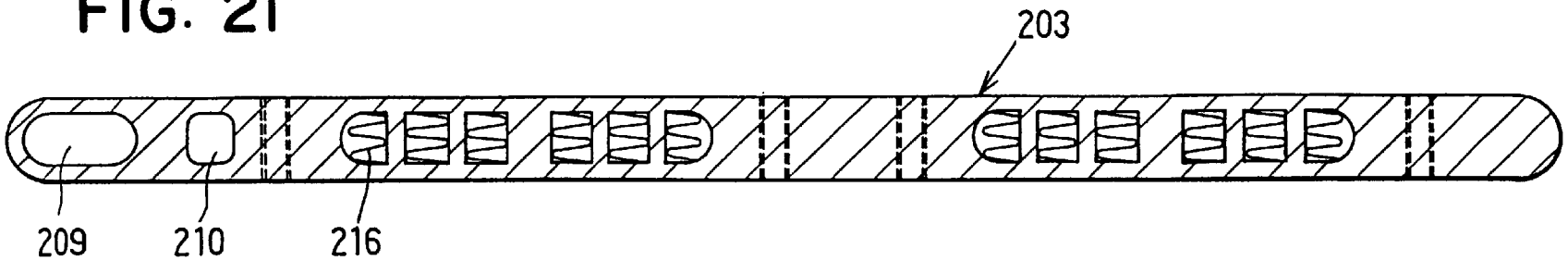
FIG. 21 is a sectional view of a cooling apparatus (Modification of Fifth and Sixth Embodiment)

In the Fifth Embodiment and the Sixth Embodiment, the corrugated fins 216 to be inserted into the refrigerant chambers 208 may be arranged in a direction, as shown in FIG. 21.

[Seventh Embodiment]

Figure 22:
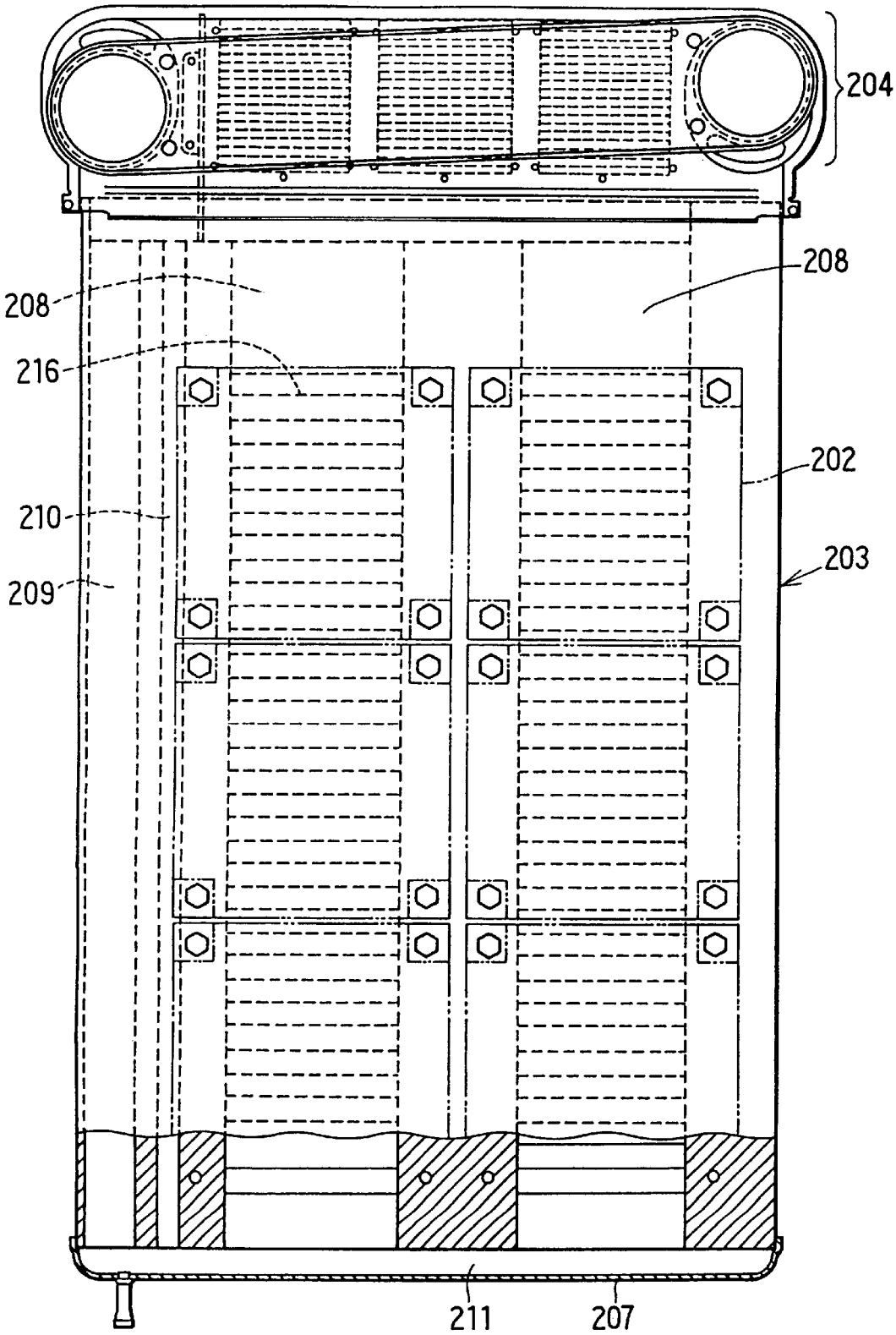
FIG. 22 is a plan view of a cooling apparatus (Seventh Embodiment)

FIG. 22 is a plan view of a cooling apparatus.

In this embodiment, the corrugated fins 216 are horizontally inserted into the refrigerant chambers 208.

Figure 23:
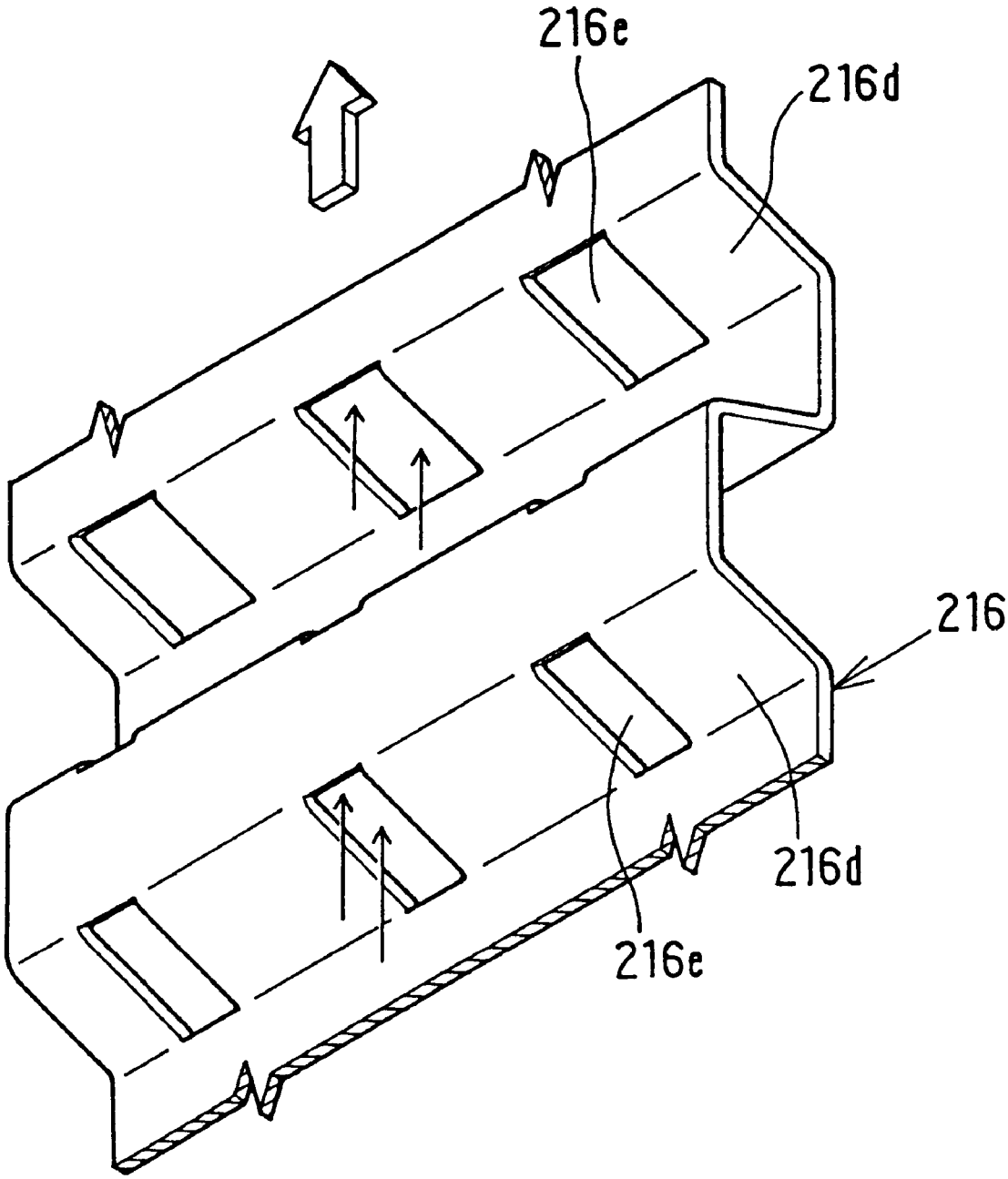
FIG. 23 is a perspective view of a corrugated fin.

The corrugated fins 216 are horizontally (in the position, as shown in FIG. 23) inserted into the refrigerant chambers 208 so that the corrugations to be formed by alternate folds may be vertically arranged.

In the corrugated fins 216, on the other hand, a plurality of openings 216*e* are formed in fin side faces 216*d,* as shown in FIG. 23. These openings 216*e* are so formed that the openings 216*e* formed in the upper fin side faces 216*d* may have a larger average effective area than that of the openings 216*e* formed in the lower fin side faces 216*d.* In other words, the average effective areas of the openings 216*e,* as formed in the individual side faces 216*d,* become gradually larger from the lowermost fin side faces 216*d* to the uppermost fin side faces 216*d.* However, all the individual openings 216*d,* as formed in one fin side face 216*d,* need not have an equal size (although they may naturally be equal).

In this embodiment, the vaporized refrigerant, as generated in the boiling portions, rises in the refrigerant chambers 208, while passing through the openings 216*e* opened in the individual side faces 216*d* of the corrugated fins 216, until it flows into the radiator 204. In this case, the openings 216*e,* as opened in the upper fin side faces 216*d,* have a larger average effective area than that of the lower fin side faces 216*d,* so that the vaporized refrigerant can smoothly pass through the openings 216*e* opened in the individual fin side faces 216*d* even if the quantity of vapor becomes the more for the upper portion of the refrigerant chambers 208. As a result, it is possible to make the burnout reluctant to occur in the upper boiling portions.

Here in the above description, in one corrugated fin 216, the openings 216*e,* as formed in the upper fin side face 216*d,* is made to have a larger average effective area than that of the openings 216*e* of the lower fin side faces 216*d.* However, the openings 216*e* may have an equal size among the corrugated fins 216 which are arranged in the boiling portions at the individual (lower, intermediate and upper) stages. In this case, the individual openings 216*e* of the corrugated fins 216, as arranged in the boiling portions at the intermediate stage, may have a larger average effective area than that of the individual openings 216*e* of the corrugated fins 216 arranged in the boiling portions at the lower stage, and the individual openings 216*e* of the corrugated fins 216, as arranged in the boiling portions at the upper stage, may have a larger average effective area than that of the individual openings 216*e* of the corrugated fins 216 arranged in the boiling portions at the intermediate stage.

[Eighth Embodiment]

Figure 24:
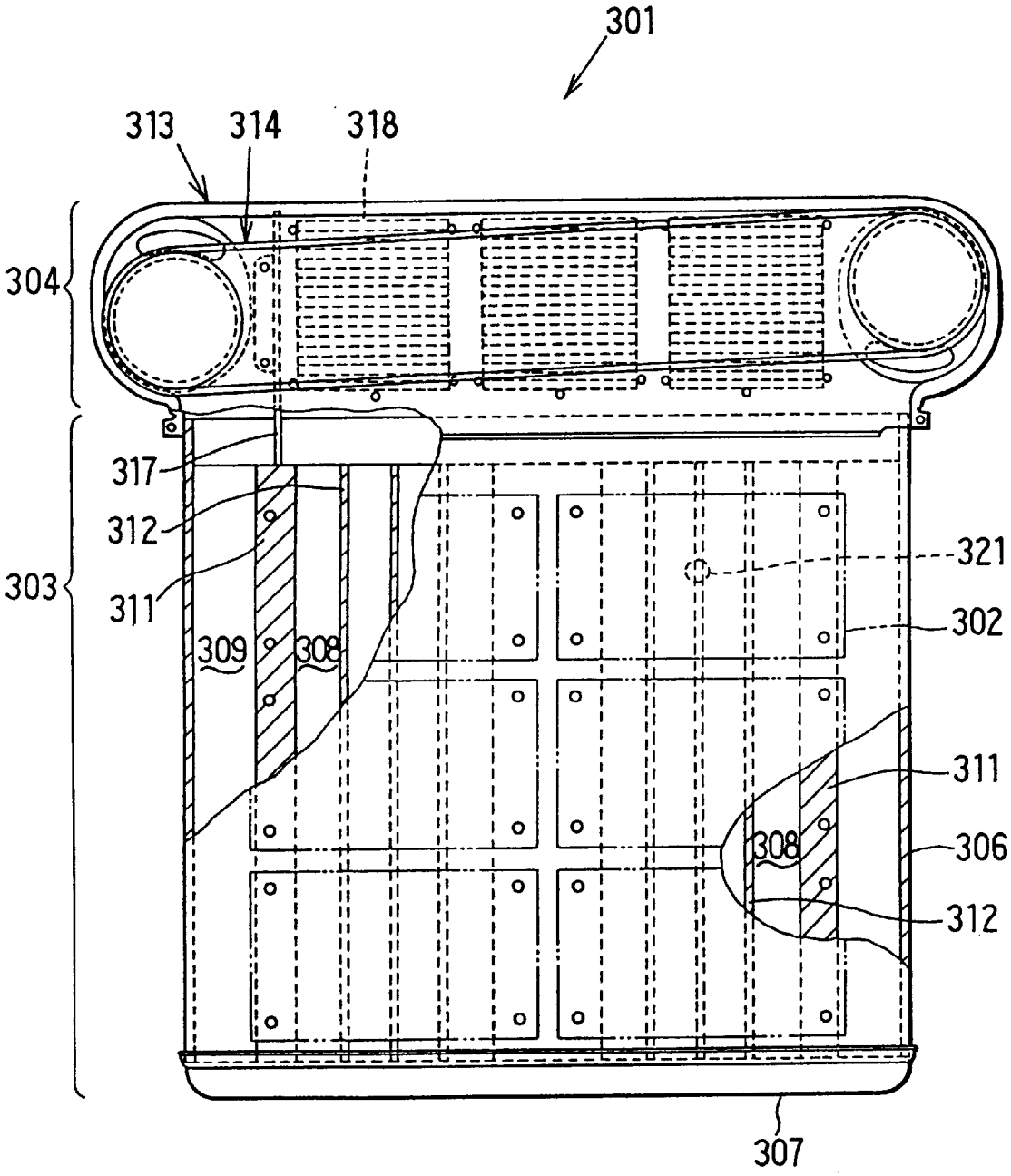
FIG. 24 is a plan view of a cooling apparatus (Eighth Embodiment)

FIG. 24 is a plan view of a cooling apparatus 301.

The cooling apparatus 301 of this embodiment cools a heating body 302 by boiling and condensing a refrigerant repeatedly and includes a refrigerant tank 303 for reserving a liquid refrigerant therein, a radiator 304 for releasing heat of a vaporized refrigerant boiled in the refrigerant tank 303 by receiving heat of the heating body, and a cooling fan 305 (as referred to FIG. 25) for sending air to the radiator 304.

Figure 25:
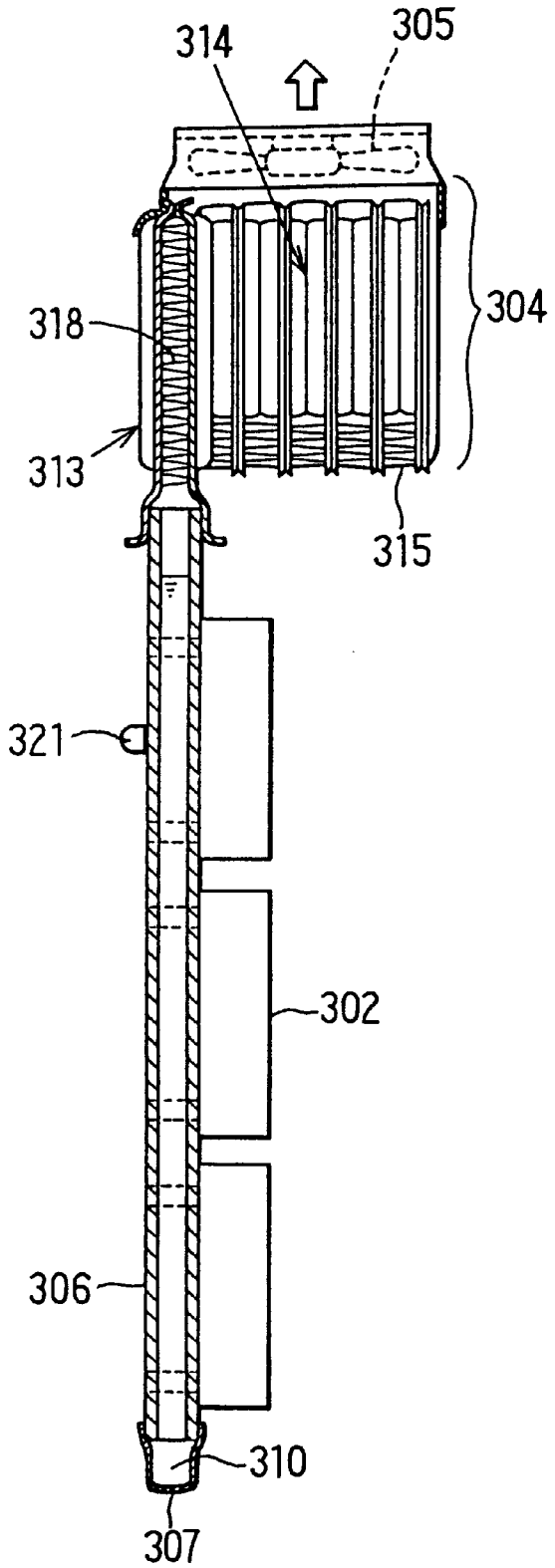
FIG. 25 is a side view of the cooling apparatus.

The heating body 302 is exemplified by an IGBT module constructing the inverter circuit of an electric vehicle and includes (not shown) computer chips therein as the heating portion. The heating body 302 is fixed in close contact on one surface of the refrigerant tank 303 by such as (not shown) bolts, as shown in FIG. 25.

The refrigerant tank 303 is composed of a hollow member 306 and an end cup 307.

The hollow member 306 is an extrusion molding made of a metallic material having an excellent thermal conductivity such as aluminum and is formed into a thin shape having a smaller thickness than the width. Through hollow member 306, there are vertically extended a plurality of hollow holes for forming the refrigerant chambers 308 and the liquid returning passages 309.

The end cup 307 is made of aluminum, for example, like the hollow member 306 and covers the lower end portion of the hollow member 306, and forms a communication passage 310 (as referred to FIG. 25) between a lower end face of the hollow member 306.

The refrigerant chambers 308 are boiling chambers for boiling a liquid refrigerant reserved therein when they receives the heat of the heating body 302, and are provided between two ribs 311 arranged both sides of the hollow member 306, and are partitioned into a plurality of passages by a plurality of ribs 312.

The liquid returning passages 309 are passages into which the condensed liquid cooled and liquefied by the radiator 304 flows, and are disposed at the most left side of the hollow member 306 in FIG. 24.

The communication passage 310 is a passage for feeding the refrigerant chambers 308 with the condensed liquid having flown into the liquid returning passages 309, and communicates between the liquid returning passages 309 and the refrigerant chambers 308.

Figure 26:
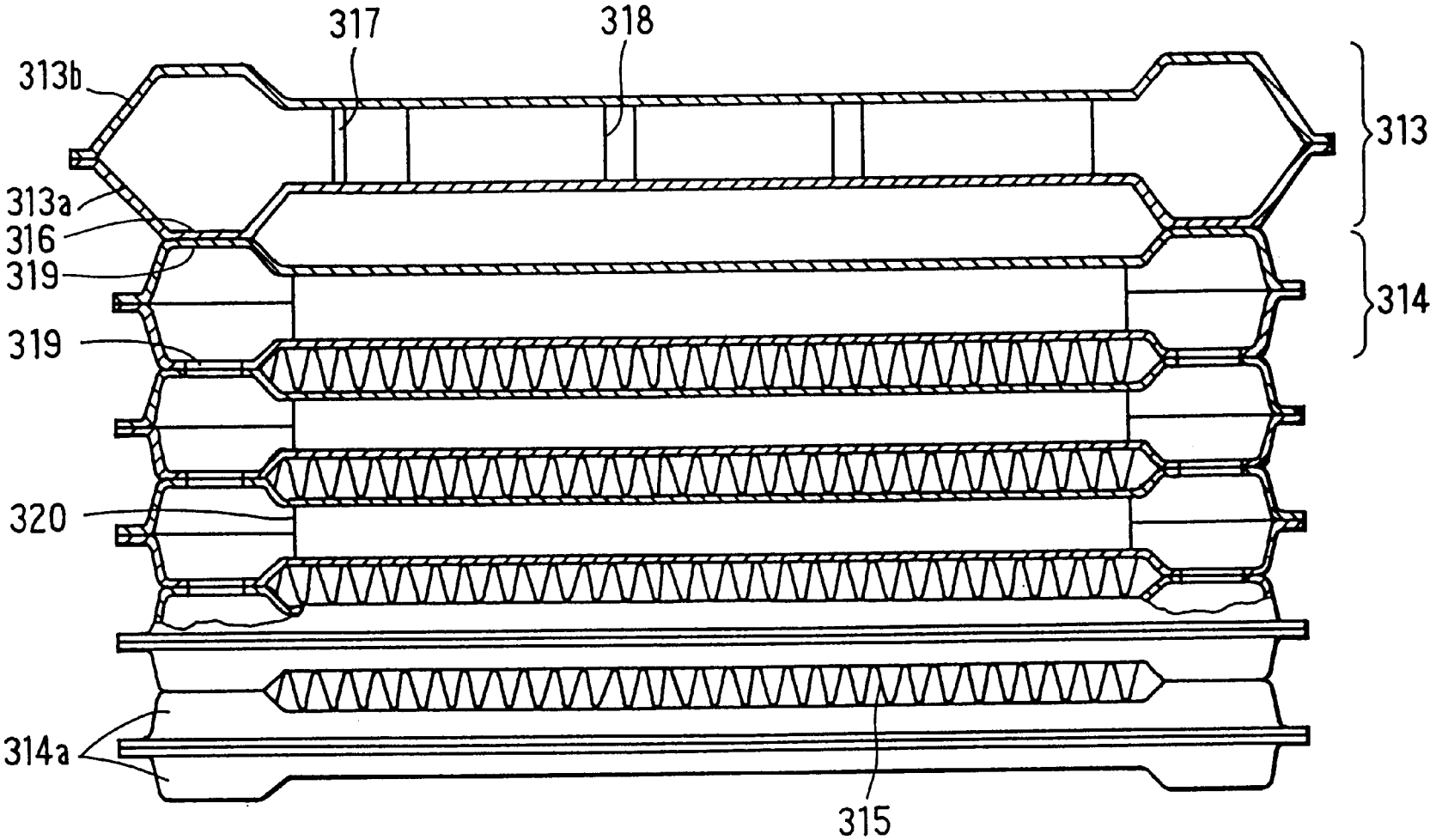
FIG. 26 is a sectional view of a radiator.

The radiator 304 is the so-called "drawn cup type" heat exchanger composed of a connecting chamber 313, radiating chambers 314 and radiating fins 315 (as referred to FIG. 26).

The connecting chamber 313 provides a connecting portion to the refrigerant tank 303 and is assembled with the upper end portion of the refrigerant tank 303. This connecting chamber 313 is formed by joining two pressed sheets 313*a,* 313*b* at their outer peripheral edge portions and is opened to have round communication ports 16 at two end portions in one pressed sheet longitudinal direction (horizontal in FIG. 26). A partition plate 317 is arranged in the connecting chamber 313 to partition this chamber into a first communication chamber (or a space located on the right side of the partition plate 317 in FIG. 24) for communicating with the refrigerant chambers 308 of the refrigerant tank 303, and a second communication chamber (or a space located on the left side of the partition plate 317 in FIG. 24) for communicating between the liquid returning passages 309 of the refrigerant tank 303. In the connecting chamber 313, there are inserted inner fins 318 made of, for example, aluminum (as referred to FIG. 24).

The radiating chambers 314 are formed into flattened hollow chambers by joining two pressed sheets 314*a* at their outer peripheral edge portions and are opened to form round communication ports 319 at their two longitudinal (horizontal in FIG. 26) end portions. Here, the pressed sheet 314*a* arranged at the outermost side (lowermost side in FIG. 26) has no communication ports 319. Further, inner fins 320 are arranged in the radiating chambers 314, as shown in FIG. 26.

As shown FIGS. 25 and 26, a plurality of the radiating chambers 314 are individually provided on the one side of the connecting chamber 313, and are caused to communicate with each other through their communication ports 316 of the communication chamber 313 and communication ports 319 of the radiating chambers 314. Here, the radiating chambers 314 are assembled at such a small inclination with the connecting chamber 313 as to provide a level difference between the communication ports 319 on the two left and right sides, as shown in FIG. 24.

The radiating fins 315 are corrugated by alternately folding a thin metal sheet having an excellent thermal conductivity (or an aluminum sheet, for example) into an undulating shape. As shown in FIG. 26, these radiating fins 315 are fitted between the adjoining radiating chambers 314 and are joined to the surfaces of the radiating chambers 314.

As shown in FIG. 25, the cooling fan 305 is arranged above the radiator 304, and vertically sends air from lower to upper against a core portion (a radiation portion made up of the radiating chambers 314 and the radiating fins 315) of the radiator 304 by being applied a power thereto via a not-shown control devices.

Figure 27:
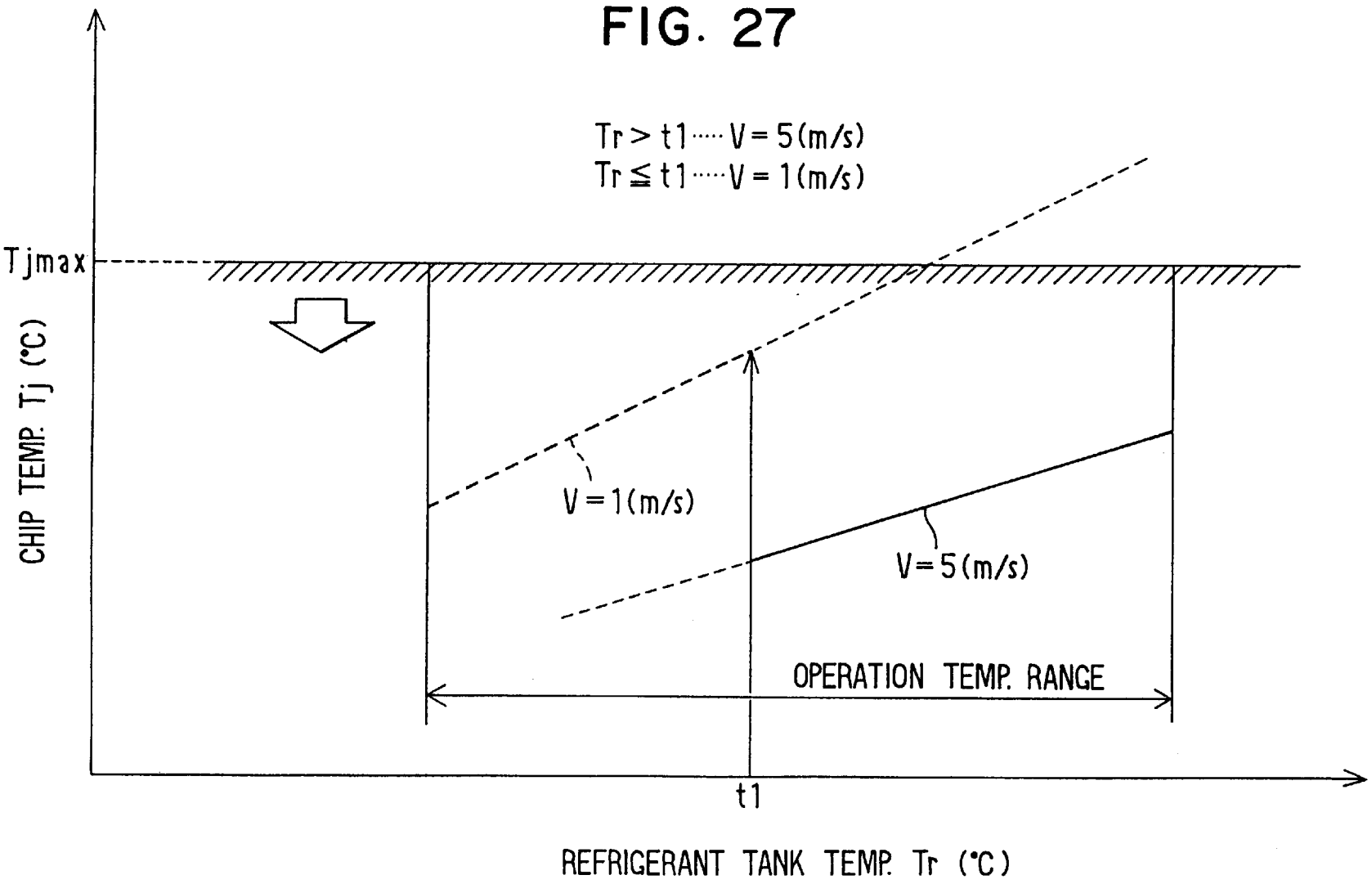
FIG. 27 is a diagram illustrating a control procedure.

The control devices control an amount of blowing air (motor rotation speed) of the cooling fan 305 in, for example, two steps (Hi and Lo) based on a detected value of the temperature sensor 321 (as referred to FIGS. 24, 25) that detects a surface temperature of the refrigerant tank 303. In detail, as shown in FIG. 27, when the detected value of the temperature sensor is larger than a predetermined value t1, the amount of the blown air is set to Hi level (e.g., a motor rotation speed that can output an air velocity v=5 m/s). Whereas, when the detected value of the temperature sensor is equal to or smaller than the predetermined value t1, the amount of the blown air is set to Lo level (e.g., a motor rotation speed that can output an air velocity v=1 m/s). Here, the t1 is such a temperature that is slightly high than a temperature that the boiling faces of the refrigerant chamber 308 causes the burnout as a result of its abruptly temperature rising, when a radiation amount of the cooling apparatus 301: Q=2 kw; and the amount of blowing air is set Hi level.

The temperature sensor 321 is desired to be provided at the portion where the surface temperature of the refrigerant tank 303 is the highest (the portion around where the chip is mounted, in the case of the IGBT) to accurately decide a threshold value (the predetermined value t1) that the air amount of the cooling fan 305 is changed. Here, in this embodiment, since the heating body is mounted on one surface of the refrigerant tank 303, the temperature sensor 321 is preferably mounted on another surface of the refrigerant tank 303. Therefore, the temperature sensor 321 is preferably mounted at adjacent portion of the ribs 311 or the ribs 312, because temperature is highest at this adjacent portion at which the heat of the chip is transmitted on the another surface of the refrigerant tank 303 (as referred to FIG. 24).

Here, when heating bodies 303 are fixed to both surfaces of the refrigerant tank 303, temperature sensors 321 are desired to be provided on the surface of the refrigerant at adjacent portion of the heating body 302 (adjacent portion of the chip).

Next, the operations of this embodiment will be described hereinafter.

The heat generated by the heating body 302 is transferred to the refrigerant reserved in the refrigerant chambers 308 through the boiling faces of the refrigerant chambers 308. The boiled and vaporized refrigerant rises in the refrigerant chambers 308 and flows from the refrigerant chambers 308 into the first communication chamber of the connecting chamber 313 and further from the first communication chamber into the radiating chambers 314. The vaporized refrigerant having flow into the radiating chambers 314 is cooled while flowing therein by the cooling air so that it is condensed while releasing its latent heat. The latent heat of the vaporized refrigerant is transmitted from the radiating chambers 314 to the radiating fins 315 until it is released through the radiating fins 315 to the external fluid.

The condensed liquid, which is condensed in the radiating chambers 314 into droplets, flows in the downhill direction (from the right to the left of FIG. 24) in the radiating chambers 314, and then flows into the second communication chamber of the connecting chamber 313. Then, the condensed liquid flows into the liquid returning passages 309 of the refrigerant chambers 308 until it is recycled to the refrigerant chambers 308 through the communication passage 310.

Here, when the refrigerant tank temperature Tr measured by the temperature sensor 321 is higher than the predetermined value t1, the air amount level of the cooling fan 305 is set to Hi level by the control device so that the chip temperature Tj of the heating body 302 is suppressed to or under a tolerance upper limit temperature Tjmax of the chip.

Furthermore, the refrigerant tank temperature Tr relates to the heating amount of the heating body 302 and air temperature, and decreases as the heating amount of the heating body 302 or the air temperature is lower. Therefore, when the air mount level of the cooling fan 305 is set constant to Hi, the refrigerant tank temperature Tr decreases to or under the predetermined value t1 if the air temperature is low or the like, and then the boiling faces may cause burnout. Hence, when the refrigerant tank temperature Tr measured by the temperature sensor 321 is under the predetermined value t1, the air amount level of the cooling fan 305 is changed to Lo by the control device. Consequently, even when the air amount level of the cooling fan 305 is changed from Hi to Lo, the chip temperature Tj of the heating body 302 can be suppressed under the tolerance upper limit temperature Tjmax.

(Effects of the Eighth Embodiment)

Figure 29:
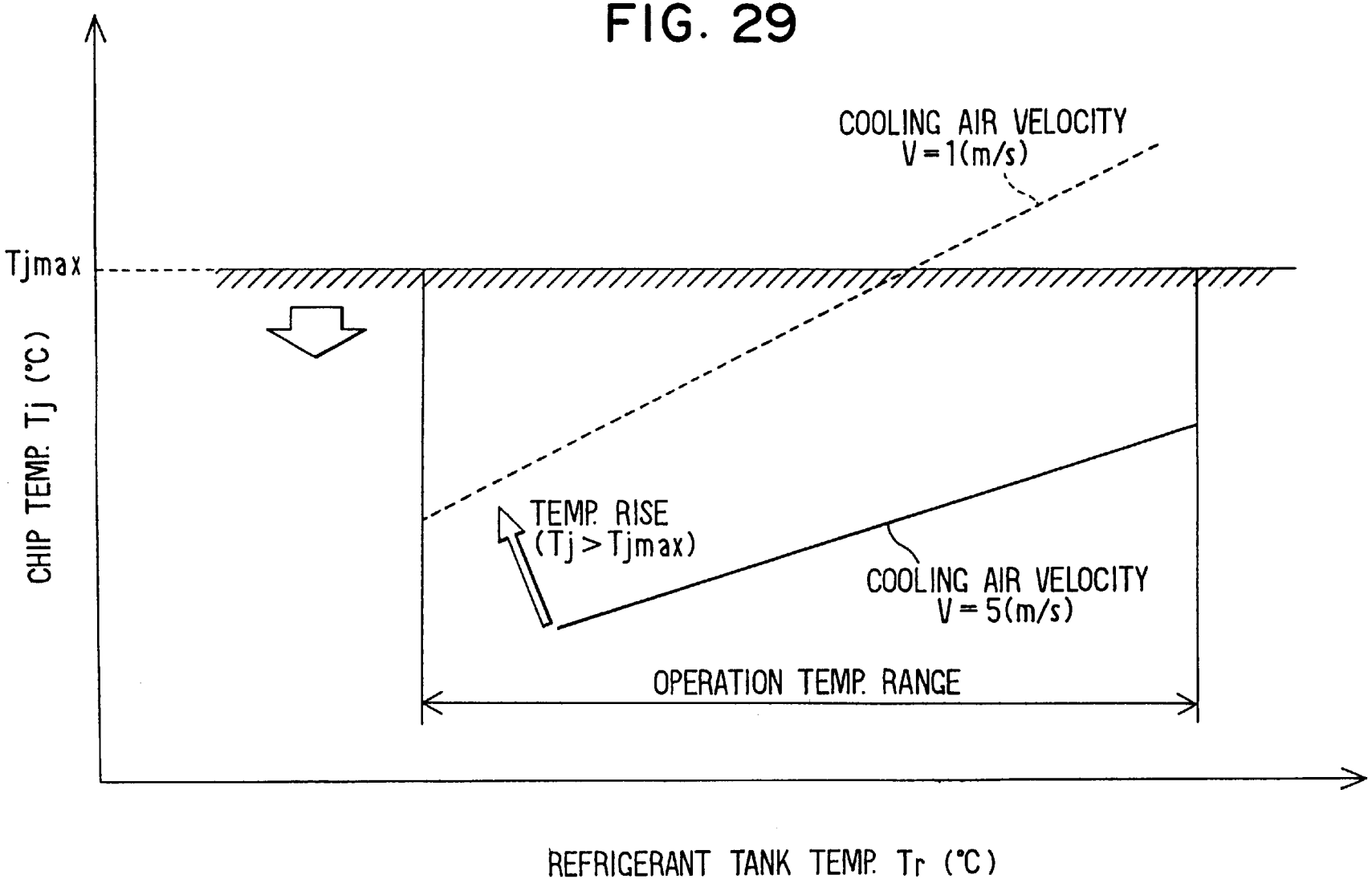
FIG. 29 is a graph illustrating a relation between a refrigerant tank temperature and a chip temperature.

When the larger the cooling air velocity is and the lower the refrigerant tank temperature is, the more an internal pressure decreases so that a volume rate of bubbles in the refrigerant tank becomes large (Boyle-Charles' law). Hence, especially in a thin type cooling apparatus in which refrigerant to be contained is reduced, as shown in FIG. 29, the more the refrigerant temperature falls when the cooling air velocity is large, boiling faces in the refrigerant tank are covered the more bubbles (refrigerant vapor). Hence, since a boiling heat transfer rate decrease, the temperature of the boiling faces may abruptly rise. Even if the refrigerant is not the thin type, when the internal pressure decrease, cavity ($\mu$ order) may decrease so that the boiling heat transfer rate may decrease.

When the cooling air velocity is small, the radiation performance decreases. Therefore, when the refrigerant tank temperature rises, it cannot suppress the heating body temperature (chip temperature) below a tolerance upper limit. As a result, it occurs a problem that when the cooling air velocity is constant, it cannot be adopted to a wider operation temperature range.

However, in this embodiment, the air amount level of the cooling fan 305 is switched in two steps based on the refrigerant tank temperature Tr. That is, when the refrigerant tank temperature Tr is higher than the predetermined value t1, the air amount level of the cooling fan 305 is set to Hi to maintain the high radiation performance.

Furthermore, when the refrigerant tank temperature Tr is equal to or lower than the predetermined value t1, the air amount level of the cooling fan 305 is set to Lo to enlarge the internal pressure. Hence, even if the refrigerant tank temperature Tr is equal to or lower than the predetermined value t1, it can stably boils the refrigerant to prevent the burnout at the boiling faces from causing.

As a result, the chip temperature can be suppressed to or under the tolerance upper limit temperature within a required operation temperature range.

Furthermore, the life time of the motor of the cooling fan 305 can be improved by setting the air amount level of the cooling fan 305 to Lo.

Here, in this embodiment, the air amount level of the cooling fan 305 is changed based on the refrigerant tank temperature Tr measured by the temperature sensor 321, however, the air amount level of the cooling fan 305 may be changed based on a physical quantity relative to the refrigerant tank temperature Tr, which is at least one of the air temperature, the heating amount of the heating body 302, and the amount of the cooling air (when a moving air is guided thereto) be provided to the radiator 304, other than the refrigerant tank temperature Tr.

However the air amount level of the cooling fan 305 is switched in two steps of Hi and Lo, it may be switched in three or more steps.

The cooling apparatus 301 of this embodiment corresponds to a structure that flows the air vertically, however, it may correspond to a structure that flows the air horizontally.

Furthermore, the control device, the temperature sensor 321 and cooling fan 305 of this embodiment and the following Ninth Embodiment can be adapted to each of cooling apparatus in the First to the Seventh Embodiments, and the following Ninth to Twenty-ninth Embodiments.

[Ninth Embodiment]

Figure 28:
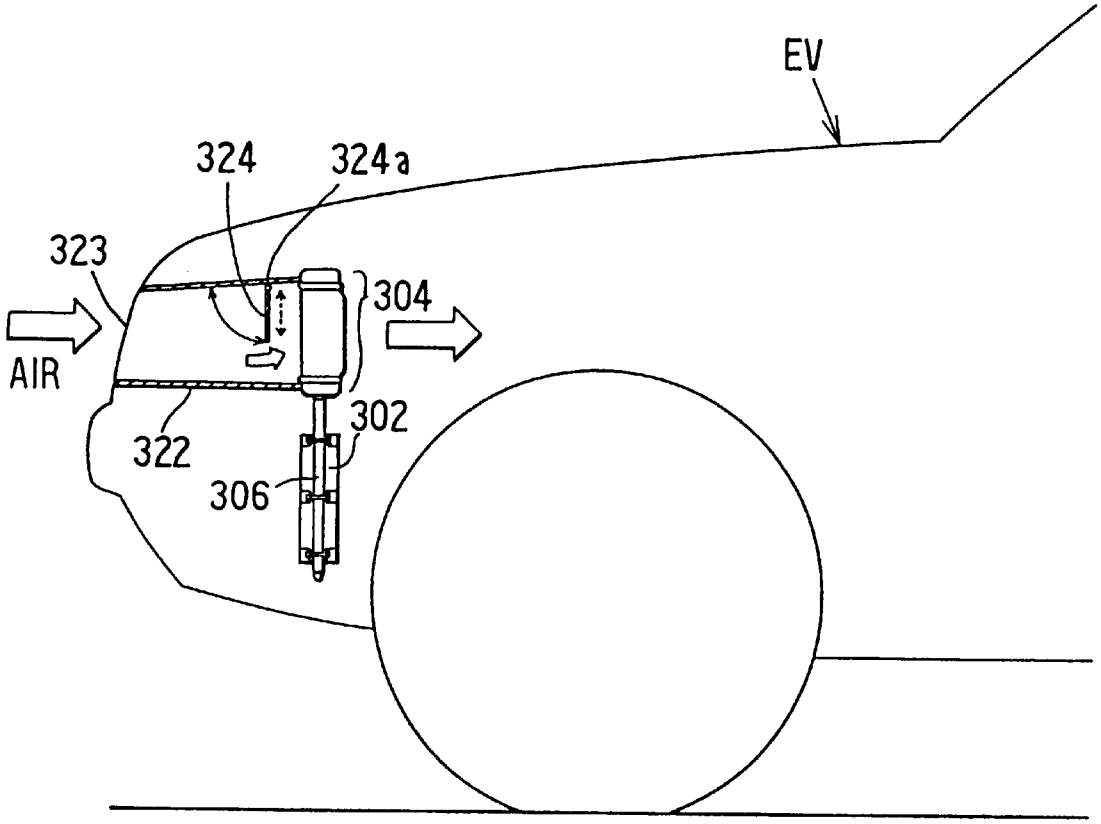
FIG. 28 is a diagram illustrating a situation in which a cooling apparatus is mounted on a vehicle (Ninth Embodiment)

FIG. 28 shows a graph illustrating a situation in which the cooling apparatus is mounted on the vehicle.

As shown FIG. 28, the cooling apparatus 301 according to this embodiment is mounted in the front of the vehicle EV. A moving air caused as a result of moving of the vehicle EV is provided to the radiator 304 through a cooling air guiding passage 322. Here, the cooling apparatus 301 is arranged so that core surfaces of the radiator 304 are directed to a back-and-forth direction of the vehicle to facilitate a receiving the moving air.

The cooling air guiding passage 322 is formed like a duct to extend, for example, from a opening 323 opened at a front grille of the vehicle EV to the radiator 304, and guides a introduced moving air from the opening 323 to the radiator 304. The cooling air guiding passage 322 is provided with a cover plate 324 in front of the radiator 304 to decrease a passage opening area of the cooling air guiding passage.

The cover plate 324 is provided so that it is movable vertically or horizontally against the cooling air guiding passage 322, or rotatable centered on a support point 324*a*, and driven by not-shown actuators.

The actuator is driven by the control device based on the temperature sensor 321 described in the Eighth Embodiment. In detail, when the detected value of the temperature sensor is larger than the predetermined value t1, the cover plate 324 is driven to a position in which the cooling air guiding passage 322 opens fully, when the detected value of the temperature sensor is equal to or smaller than the predetermined value t1, the cover plate 324 is driven to a position (a position shown in FIG. 28) in which the passage opening area of the cooling air guiding passage 322 decreases.

According to the above structure, since the cover plate 324 fully opens the cooling air guiding passage 322 when the detected value of the temperature sensor is larger than the predetermined value t1, the moving air is provided to the radiator 304 through the cooling air guiding passage 322. Furthermore, since the passage opening area of the cooling air guiding passage 322 decreases when the detected value of the temperature sensor is equal to or smaller than the predetermined value t1, a passage resistance of the cooling air guiding passage 322 increases. As a result, the amount of cooling air provided to the radiator 304 decreases compared to the situation in which the cooling air guiding passage 322 is fully opened. In this way, even when the refrigerant tank temperature Tr is equal to or smaller than t1, it can prevent the internal pressure from decreasing, and then it can maintain a stable boiling.

Here, in this embodiment, the cooling air to the radiator is supplied by the moving air, however, the cooling fan shown in Eighth Embodiment may use to generate the cooling fan in addition to the moving air.

[Tenth Embodiment]

Figure 30:
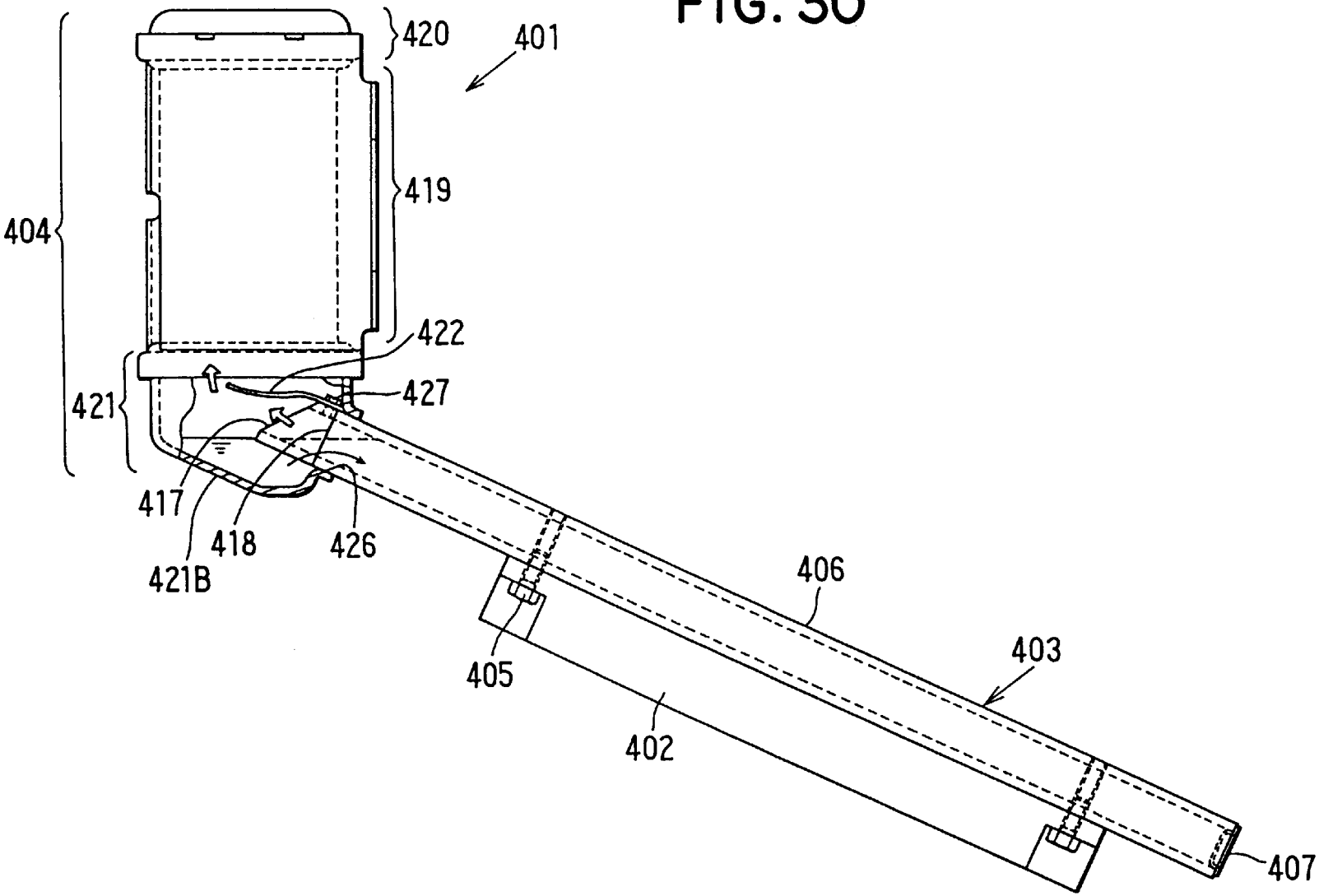
FIG. 30 is a side view of a cooling apparatus (Tenth Embodiment)

FIG. 30 is a side plan view of a cooling apparatus 401.

The cooling apparatus 401 of this embodiment cools a heating body 402 by boiling and condensing a refrigerant repeatedly and is manufactured, by an integral soldering, of a refrigerant tank 403 for reserving a liquid refrigerant therein and a radiator 404 assembled over the refrigerant tank 403.

The heating body 402 is exemplified by an IGBT module constructing the inverter circuit of an electric vehicle and is fixed in close contact on the surface of the refrigerant tank 403 by such as bolts 405, as shown in FIG. 30.

Figure 31:
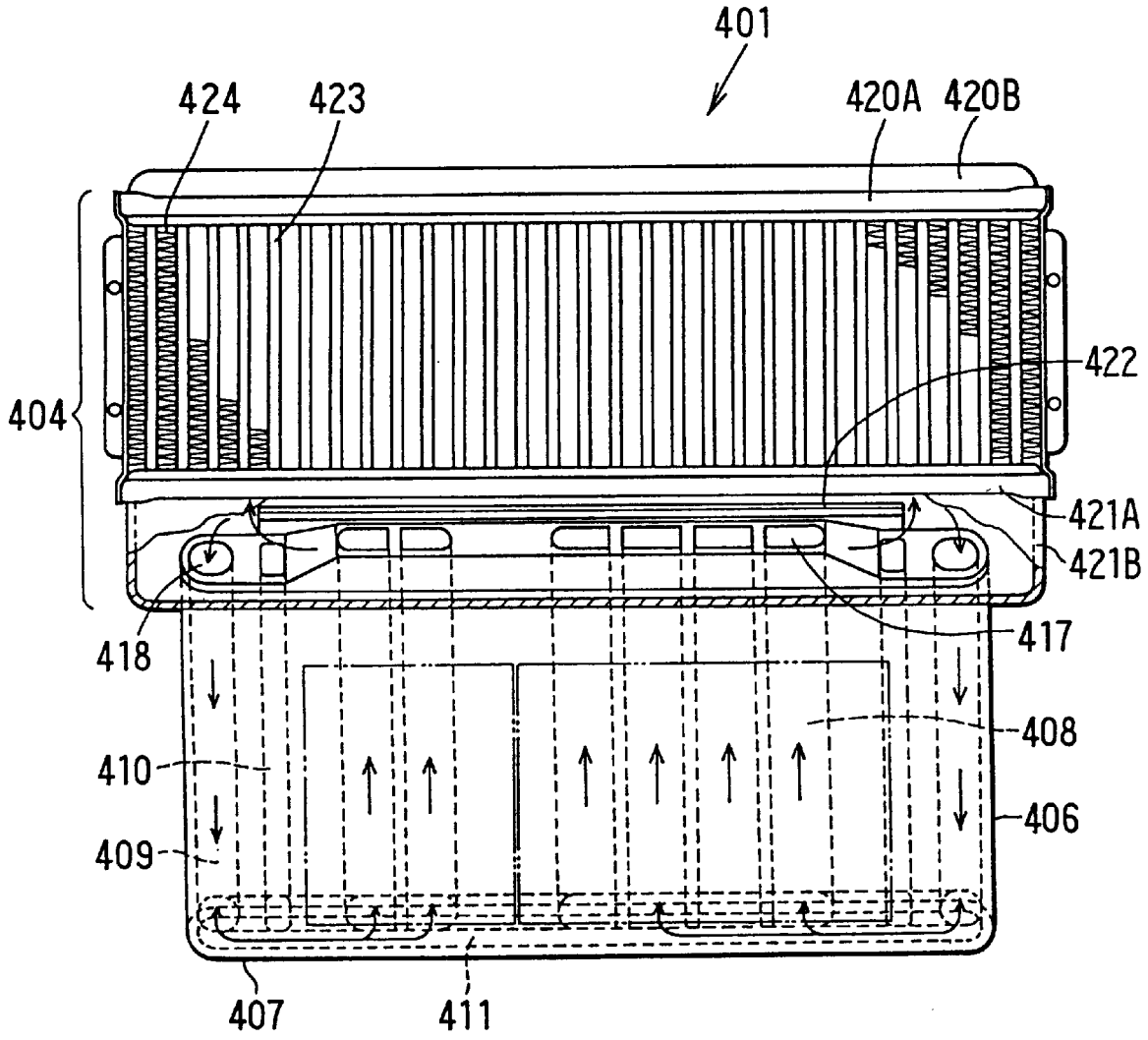
FIG. 31 is a plan view of the cooling apparatus.

The refrigerant tank 403 is composed of a hollow member 406 and an end plate 407 and is provided therein with refrigerant chambers 408, liquid returning passages 409, thermal insulation passages 410 and a communication passage 411 (as referred to FIG. 31).

Figure 32A:
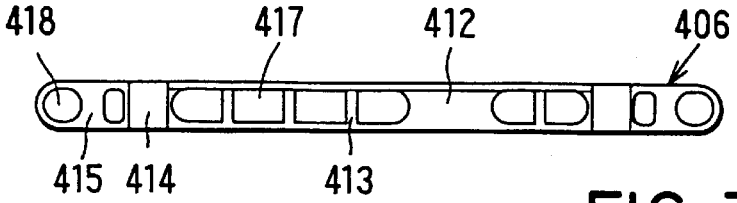
FIG. 32A is a top view of a hollow member.

The hollow member 406 is an extrusion molding made of a metallic material having an excellent thermal conductivity such as aluminum and is formed into a thin shape having a smaller thickness than the width, as shown in FIG. 32A. The hollow member 406 is provided therein with a plurality of partition walls of different thicknesses (i.e., a first partition wall 412, second partition walls 413, third partition walls 414 and fourth partition walls 415). However, the individual partition walls 412 to 415 are cut at their lower end portions by a predetermined length, as shown in FIG. 32B, such that their lower end faces are positioned over the lower face of the hollow member 406. On the other hand, the first partition wall 412 and the third partition walls 414 are provided with a plurality of threaded holes 416 for screwing the bolts 405.

Figure 32C:
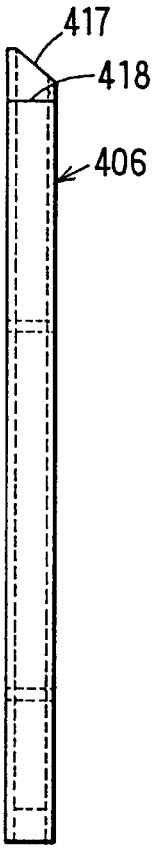
FIG. 32C is a side view of the hollow member.
Figure 32B:
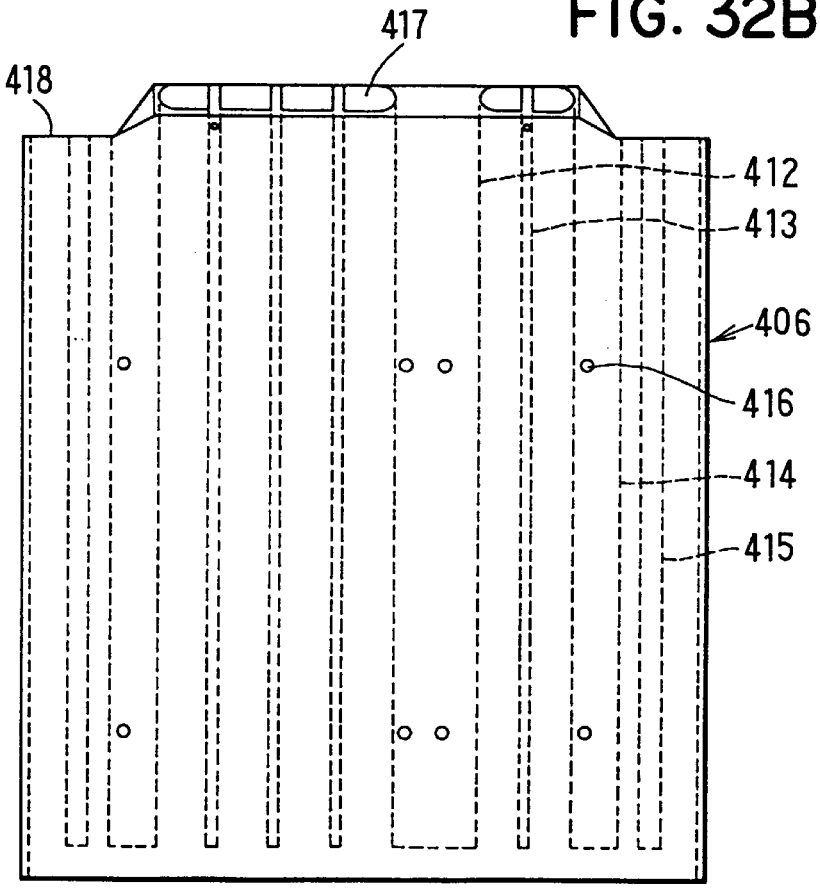
FIG. 32B is a plan view of the hollow member.

The upper end portion of the hollow member 406 has such a level difference between the outer side portions and the inner side portion of the left and right third partition walls 414 that the inner side portion protrudes upward relative to the outer side portions and that the inner side portion is sloped at its upper end face, as shown in FIG. 32C.

Figure 33A:
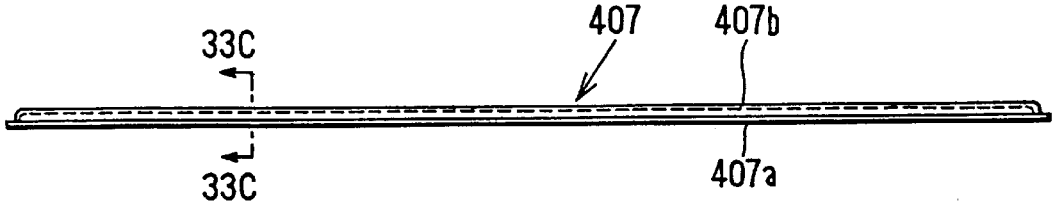
FIG. 33A is a side view of an end plate.
Figure 33B:
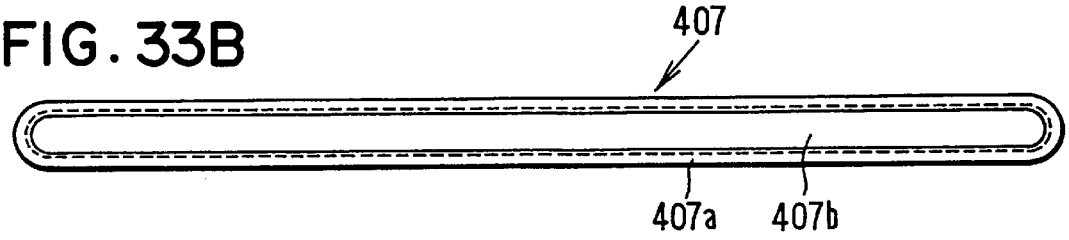
FIG. 33B is a plan view of the end plate.
Figure 33C:
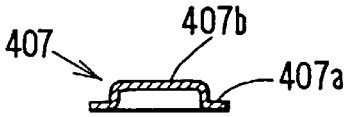
FIG. 33C is a sectional view of the end plate.
Figure 34:
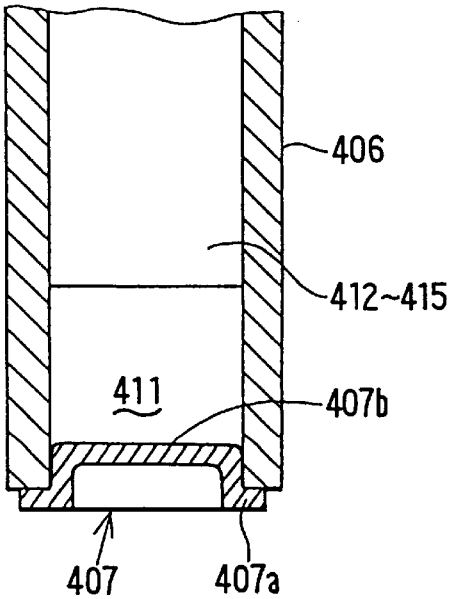
FIG. 34 is a sectional view illustrating a mounted situation of the end plate.

The end plate 407 is made of aluminum, for example, like the hollow member 406 and is formed thin in the transverse direction, as shown in FIGS. 33A–33C, such that an inner side portion 407*b* is slightly raised relative to an outer peripheral edge portion 407*a*. This end plate 407 is caused to plug the lower end opening of the hollow member 406, as shown in FIG. 34, by fitting the raised inner side portion 407*b* in the lower end opening of the hollow member 406 so that the outer peripheral edge portion 407*a* contacts with the outer peripheral lower end face of the hollow member 406. However, a predetermined spacing is retained between the surface of the inner side portion 407*b* of the end plate 407 fitted in the lower end opening of the hollow member 406 and the lower end faces of the individual partition walls 412 to 415 of the hollow member 406.

The refrigerant chambers 408 are formed between the first partition wall 412 located on the right side of the central portion of the hollow member 406, and the left and right third partition walls 414, as shown in FIG. 32B, and are partitioned into a plurality of passages by the individual second partition walls 413. This refrigerant chambers 408 form chambers for boiling a liquid refrigerant reserved therein when they receives the heat of the heating body 402. Here, in the following description, the upper openings of the refrigerant chambers 408, as opened in the upper end face of the hollow member 406, will be called vapor outlets 417. These vapor outlets 417 are protruded upward relative to the upper end open faces of the liquid returning passages 409, and their open faces are sloped.

The liquid returning passages 409 are passages into which the condensed liquid cooled and liquefied by the radiator 404 flows, and are disposed at the two most left and right sides of the hollow member 406. Here, in the following description, the upper openings of the liquid returning passages 409, as opened in the upper end face of the hollow member 406, will be called liquid inlets 418.

The thermal insulation passages 410 are passages for the thermal insulation between the refrigerant chambers 408 and the liquid returning passages 409 and are partitioned from the refrigerant chambers 408 by the third partition walls 414 and from the liquid returning passages 409 by the fourth partition walls 415.

The communication passage 411 is a passage for feeding the refrigerant chambers 408 with the condensed liquid having flown into the liquid returning passages 409, and is formed in the lower end portion of the hollow member 406, as plugged with the end plate 407 (as referred to FIG. 34), to provide communication between the liquid returning passages 409, the refrigerant chambers 408 and the thermal insulation passages 410.

The radiator 404 is constructed of a core portion 419, an upper tank 420 and a lower tank 421 (or a connecting tank of the invention), and a refrigerant control plate 422 is disposed in the lower tank 421.

The core portion 419 is a radiating portion of the invention for cooling the vaporized refrigerant, as boiled by the heat of the heating body 402, by the heat exchange with an external fluid (e.g., air), and is composed of a plurality of radiating tubes 423 and radiating fins 424 interposed between the individual radiating tubes 423.

The radiating tubes 423 form refrigerant passages for the refrigerant to flow therethrough and are made up with plurality of flat tubes made up such as an aluminum and being cut to a predetermined length, and disposed between the lower tank 421 and the upper tank 420 to provide the communication between the lower tank 421 and the upper tank 420. Here, corrugated inner fins 425 may be inserted into the radiating tubes 423 (as referred to FIG. 35). In this case, however, the inner fins 425 are desirably arranged with their crests and valleys extending in the passage direction (up-and-down direction of FIG. 35) of the radiating tubes 423 and arranged to form gaps for refrigerant passages 423*a* on the two sides of the inner fins 425.

The radiating fins 424 are formed into the corrugated shape by alternately folding a thin metal sheet (e.g., an aluminum sheet) having an excellent thermal conductivity and are joined to the surfaces of the radiating tubes 423.

The upper tank 420 is constructed by combining a shallow dish shaped core plate 420A and a deep dish shaped tank plate 420B, and the upper end portions of the radiating tubes 423 are individually inserted into a plurality of (not-shown) slots formed in the core plate 420A.

Figure 36A:
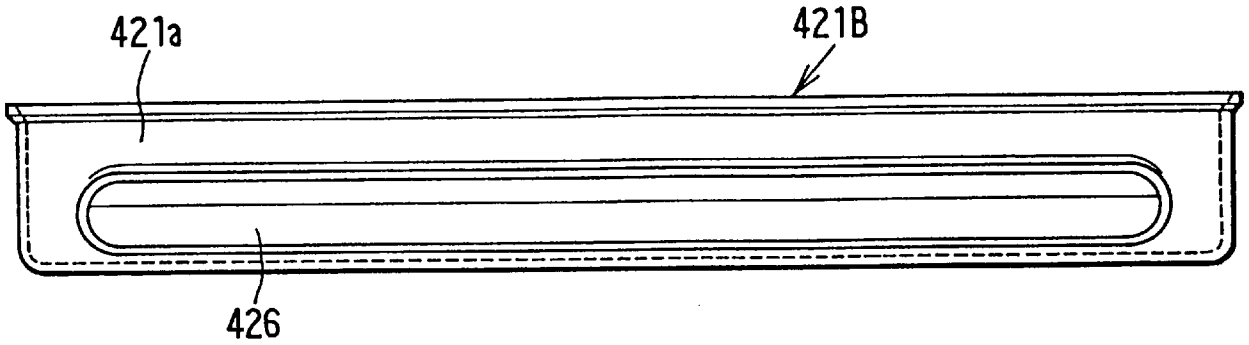
FIG. 36A is a plan view of a lower tank.
Figure 36B:
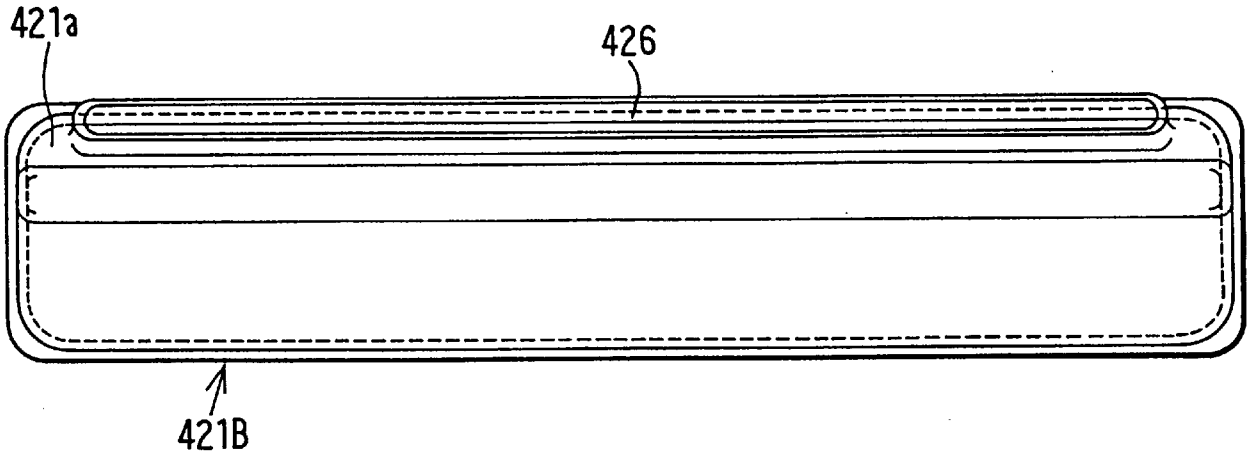
FIG. 36B is a side view of the lower tank.
Figure 36C:
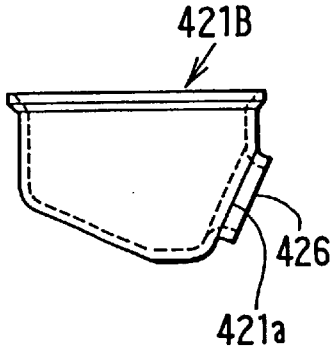
FIG. 36C is a bottom view of the lower tank.

The lower tank 421 is constructed like the upper tank 420 by combining a shallow dish shaped core plate 421A and a deep dish shaped tank plate 421B (as referred to FIGS. 36A–36C). The lower end portions of the radiating tubes 423 are individually inserted into a plurality of (not-shown) slots formed in the core plate 421A, and the upper end portion of the hollow member 406 is inserted (as referred to FIG. 30) into an opening 426 formed in the tank plate 421B. Here, the tank plate 421B is provided with a slope 421*a* having the largest angle of inclination with respect to the lowermost bottom face (i.e., the face opposed to the upper opening to be covered with the core plate 421A) in the shape viewed in its longitudinal direction, as shown in FIG. 36C, and the opening 426 is opened in that slope 421a (as referred to FIGS. 36A–36C).

As a result, the refrigerant tank 403 is assembled in a large inclination with respect to the lower tank 421, as shown in FIG. 30. This inclination is effective when the upward mounting space is limited, because the total height of the apparatus is large when the refrigerant tank 403 is assembled in an upright position with the lower tank 421.

Here, the refrigerant tank 403 is inserted into the opening 426 with its face for mounting the heating body 402 being directed downward so that the vapor outlets 417 are directed obliquely upward in the lower tank 421 (That is, the heating body 402 is mounted on the lower surface of the refrigerant tank 403). As a result, in the lower tank 421, as shown in FIG. 31, the lowermost portions of the vapor outlets 417 are positioned over those of the liquid inlets 418, and the vapor outlets 417 are opened as a whole over the liquid inlets 418.

Figure 37A:
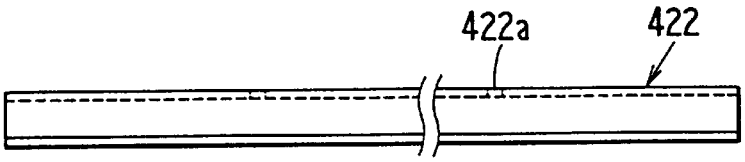
FIG. 37A is a plan view of a refrigerant control plate.
Figure 37B:
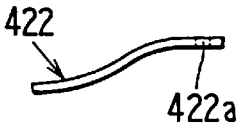
FIG. 37B is a side view of the refrigerant control plate.

The refrigerant control plate 422 prevents the condensed liquid, as liquefied by the core portion 419, from dropping directly into the vapor outlets 417. As shown in FIG. 31, the refrigerant control plate 422 extends its two ends over the thermal insulation passages 410 in the transverse direction in the lower tank 421, and covers the vapor outlets 417 and the thermal insulation passages 410 in the back-and-forth direction (as referred to FIG. 30). This refrigerant control plate 422 is long in the transverse direction, as shown in FIGS. 37A–37B, and is provided at one back-and-forth end portion with a round hole 422*a* for inserting a screw 427 or the like so that it can be mounted by means of the screw 427 or the like on the surface of the upper end portion of the hollow member 406 to be inserted into the lower tank 421 (as referred to FIG. 30). At this time, the refrigerant control plate 422 is desirably mounted in a gently inclined state such that the leading end side is slightly higher than the mounted portion side in the back-and-forth direction of FIG. 30.

Here, operations of this embodiment will be described.

The vaporized refrigerant, as boiled in the refrigerant chambers 408 by the heat of the heating body 402, flows from the vapor outlets 417 into the lower tank 421 and further from the lower tank 421 into the individual radiating tubes 423. The vaporized refrigerant flowing through the radiating tubes 423 are cooled by the heat exchange with the external fluid passing through the core portion 419 so that it releases the latent heat and condenses in the radiating tubes 423. The latent heat thus released is transferred from the wall faces of the radiating tubes 423 to the radiating fins 424 and is released through the radiating fins 424 to the external fluid.

Figure 35:
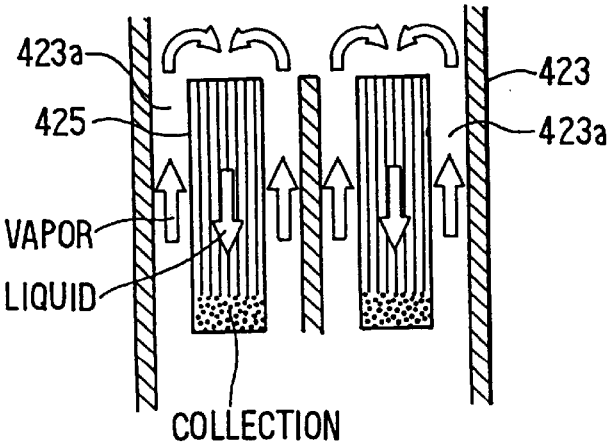
FIG. 35 is a sectional view of a radiating tube in which inner fins are arranged therein.

The refrigerant, as condensed in the radiating tubes 423, is partially held in the lower portions of the inner fins 425 by the surface tension to form liquid trapping portions, as shown in FIG. 35. These liquid trapping portions are also formed in a situation that the vaporized refrigerant rising from the lower side wets the surfaces of the lower portions of the inner fins 425 so that the bubble films are trapped on the lower portions of the inner fins 425 by the surface tension.

The condensed liquid, as trapped in the liquid trapping portions of the inner fins 425, is forced to drop from the liquid trapping portions into the lower tank 421 by the pressure of the vaporized refrigerant which has risen in the gaps (or the refrigerant passages 423*a*) formed on the two sides of the inner fins 425. On the other hand, the condensed liquid, as condensed into droplets on the inner surfaces of the radiating tubes 423, falls on the inner faces of the radiating tubes 423 by its own weight so that it drips from the radiating tubes 423 into the lower tank 421.

The condensed liquid having dropped from the radiating tubes 423 onto the upper face of the refrigerant control plate 422 flows along the slope of the refrigerant control plate 422 and further to the left and right in the passage, as formed between the side faces of the lower tank 421 and the refrigerant control plate 422, into the liquid inlets 418.

On the other hand, the condensed liquid, as reserved in the bottom portion of the lower tank 421, flows into the liquid inlets 418, when its level exceeds the height of the lowermost portions of the liquid inlets 418 so that it can be recycled from the liquid returning passages 409 via the communication passage 411 into the refrigerant chambers 408.

(Effects of the Tenth Embodiment)

In this embodiment, in the lower tank 421, the liquid inlets 418 are opened at lower positions than the vapor outlets 417 so that the condensed liquid, having dripped from the radiating tubes 423 into the lower tank 421, can flow preferentially into the liquid inlets 418. In the lower tank 421, on the other hand, the vapor outlets 417 are covered thereover with the refrigerant control plate 422 so that the condensed liquid having dropped from the radiating tubes 423 can be prevented from flowing directly into the vapor outlets 417. As a result, the condensed liquid is not blown up in the lower tank 421 by the vaporized refrigerant flowing out from the vapor outlets 417, but can be efficiently recycled into the refrigerant chambers 408 so that the circulating efficiency of the refrigerant can be improved to suppress the burnout of the boiling faces.

Especially when the condensed liquid becomes the more reluctant to return to the refrigerant chambers 408 as the refrigerant tank 403 is thinned the more, the radiation performance is likely to decrease due to the burnout of the boiling faces. Hence, in the thinned refrigerant tank 403, the level difference between the vapor outlets 417 and the liquid inlets 418 is highly effective for easy return of the condensed liquid to the refrigerant chambers 408.

[Eleventh Embodiment]

Figure 38:
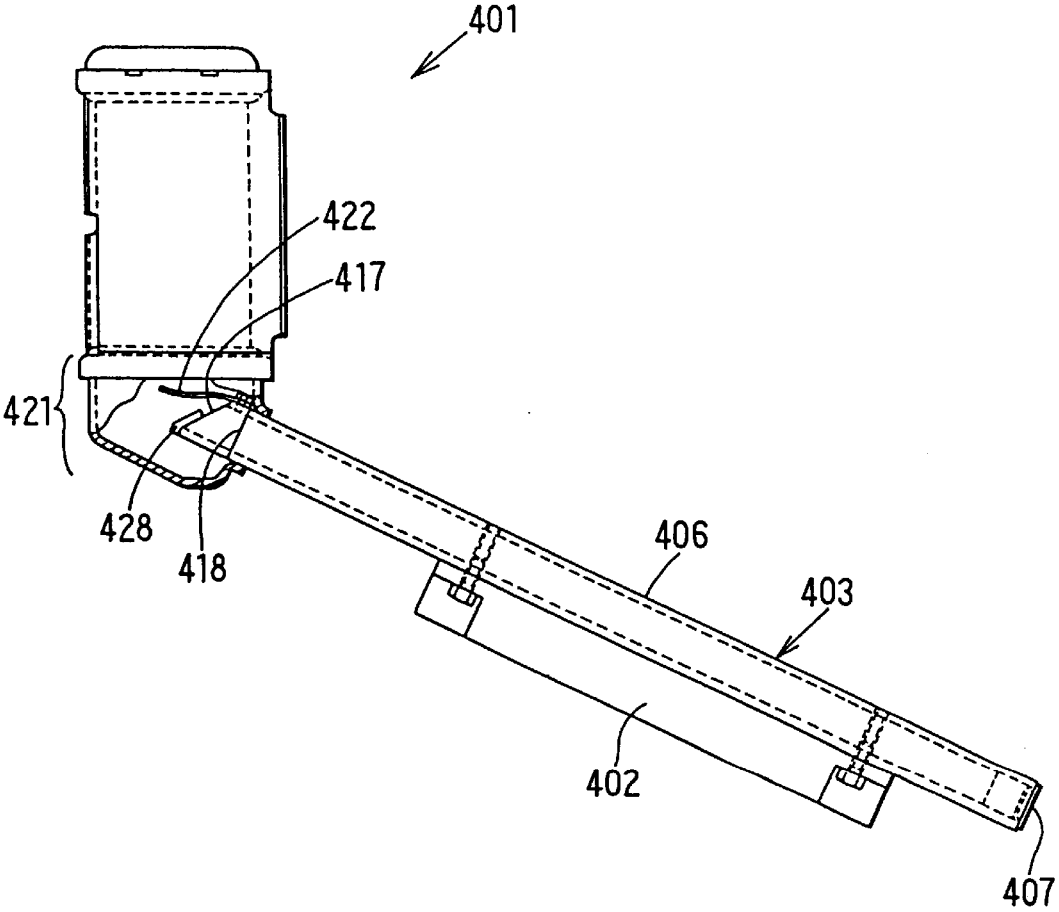
FIG. 38 is a side view of a cooling apparatus (Eleventh Embodiment)

FIG. 38 is a side view of a cooling apparatus 401.

Figure 39:
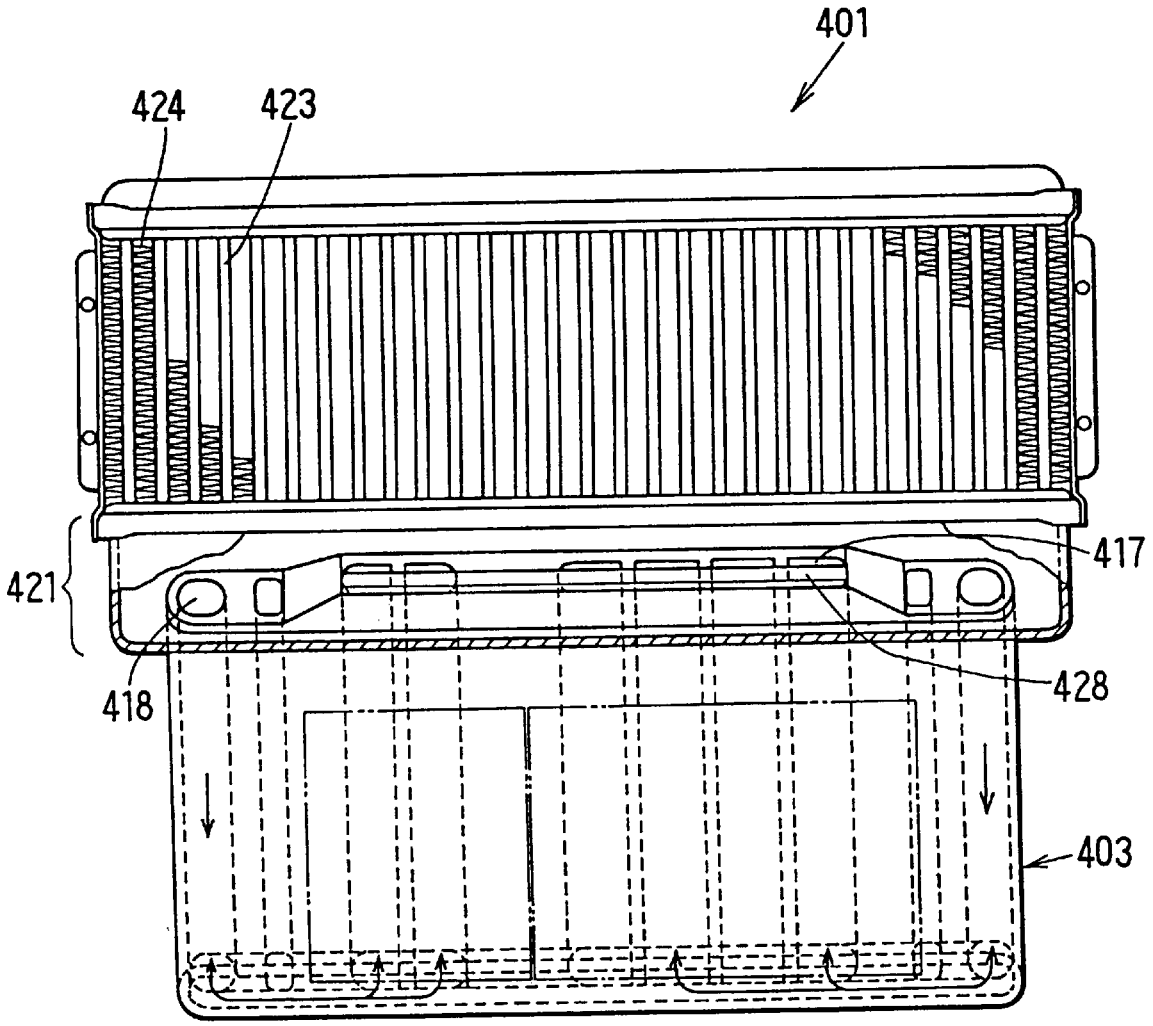
FIG. 39 is a plan view of the cooling apparatus.

This embodiment is applied to the cooling apparatus 401, as described in connection with the Tenth Embodiment. As shown in FIG. 38, the lower sides of the vapor outlets 417, as opened in the lower tank 421, are plugged with a plate 428. This plate 428 is arranged to extend over the whole area of the vapor outlets 417 in the longitudinal direction, as shown in FIG. 39.

In this case, the level difference between the openings of the vapor outlets 417 uncovered with the plate 428 and the liquid inlets 418 can be enlarged so that the condensed liquid reserved in the lower tank 421 can flow more stably into the liquid inlets 418 to further reduce the condensed liquid flowing from the vapor outlets 417 into the refrigerant chambers 408.

[Twelfth Embodiment]

Figure 40:
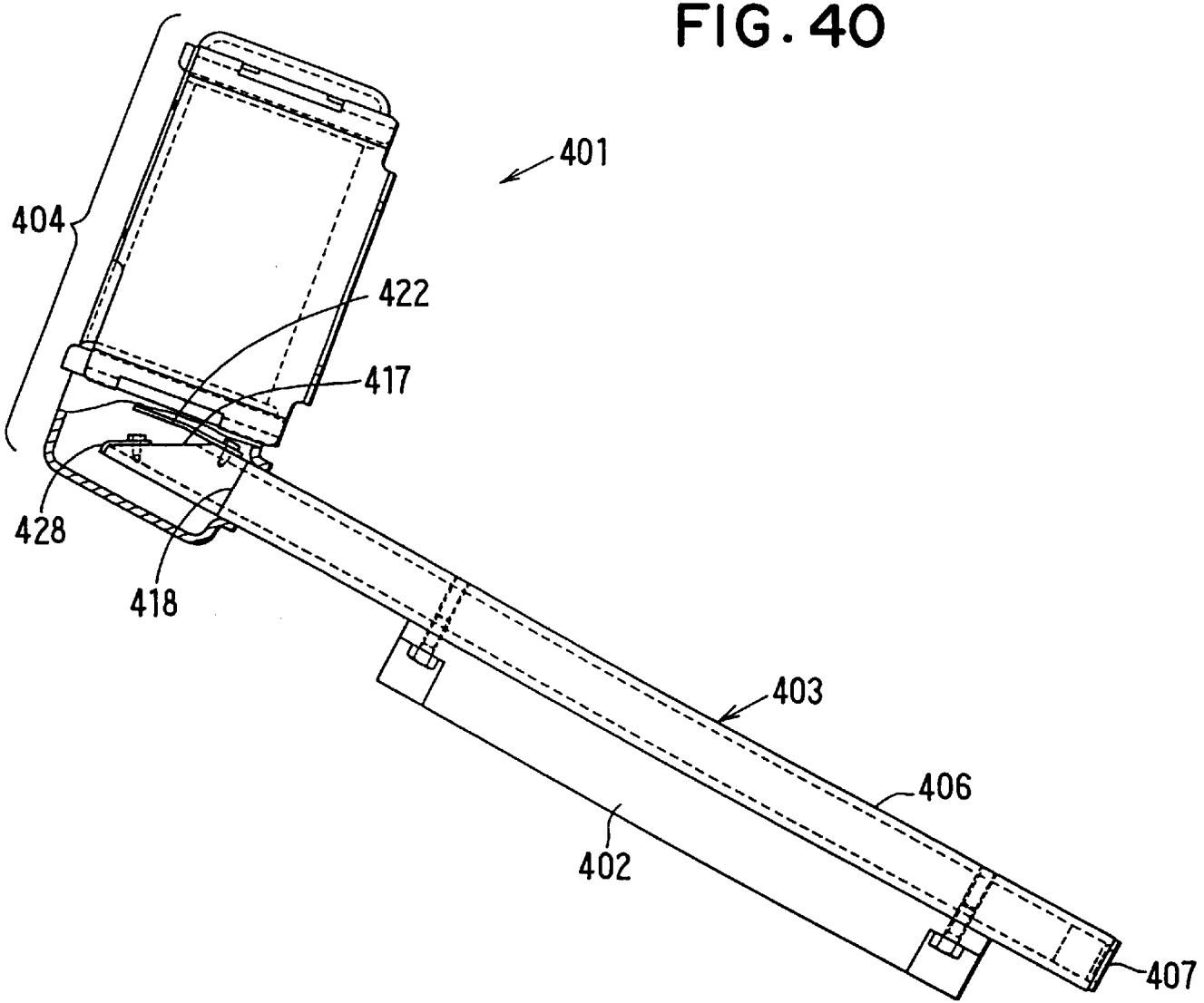
FIG. 40 is a side view of a cooling apparatus (Twelfth Embodiment)

FIG. 40 is a side plan view of the cooling apparatus 401.

This embodiment is applied to the cooling apparatus 401, as have been described in connection with the first or second embodiments. The radiator 404 is disposed at an inclination.

This cooling apparatus 401 is suitable for the case in which the refrigerant tank 403 is mounted toward the front of the vehicle (or to the right of FIG. 40), for example. In this case, the cooling apparatus 401 can be kept in a position to exhibit the highest performance, even if the radiator 404 is raised to a generally upright position when the vehicle runs uphill.

[Thirteenth Embodiment]

Figure 41:
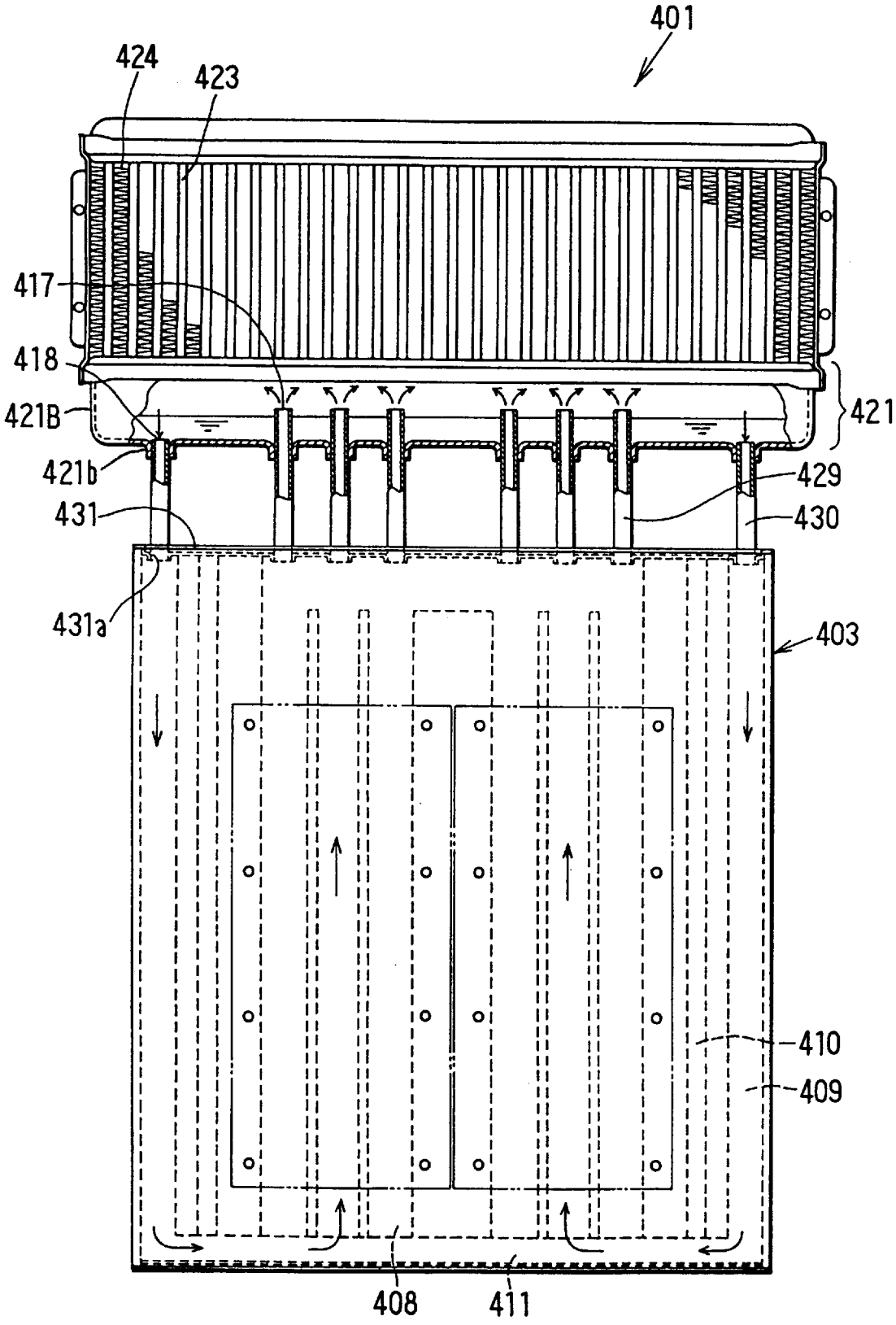
FIG. 41 is a plan view of a cooling apparatus (Thirteenth Embodiment)

FIG. 41 is a front plan view of the cooling apparatus 401.

In this embodiment, the refrigerant tank 403 and the lower tank 421 are separated from each other and are connected by vapor tubes 429 and liquid returning tubes 430.

Figure 42:
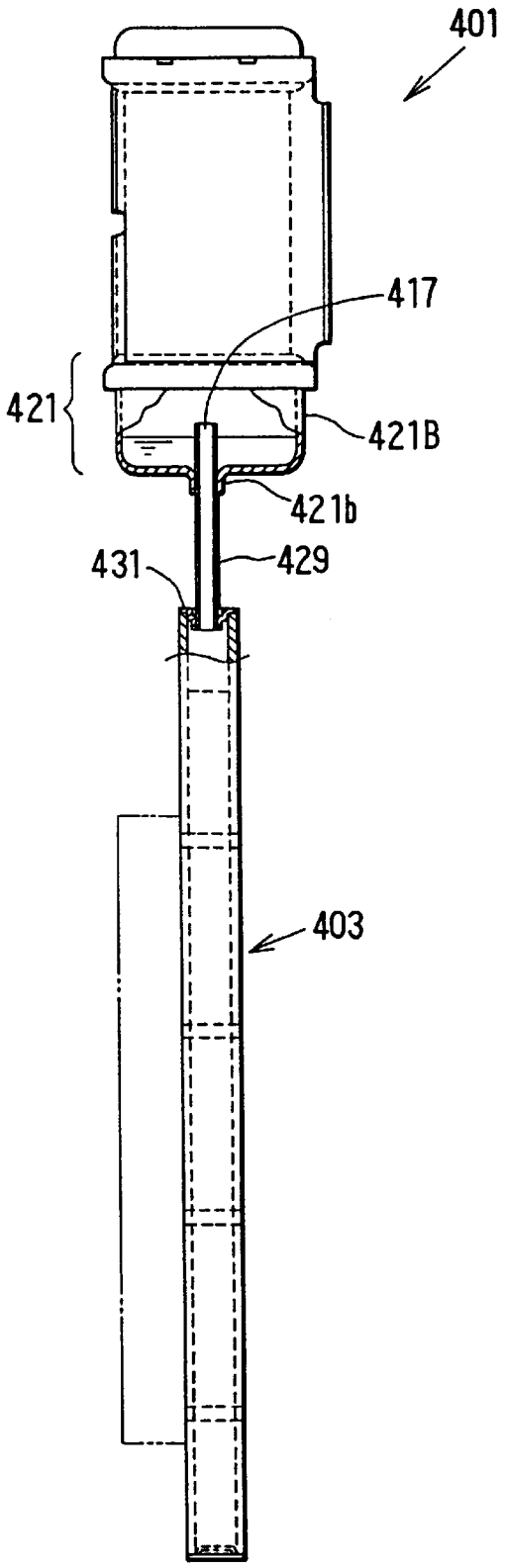
FIG. 42 is a side view of the cooling apparatus.
Figure 43:
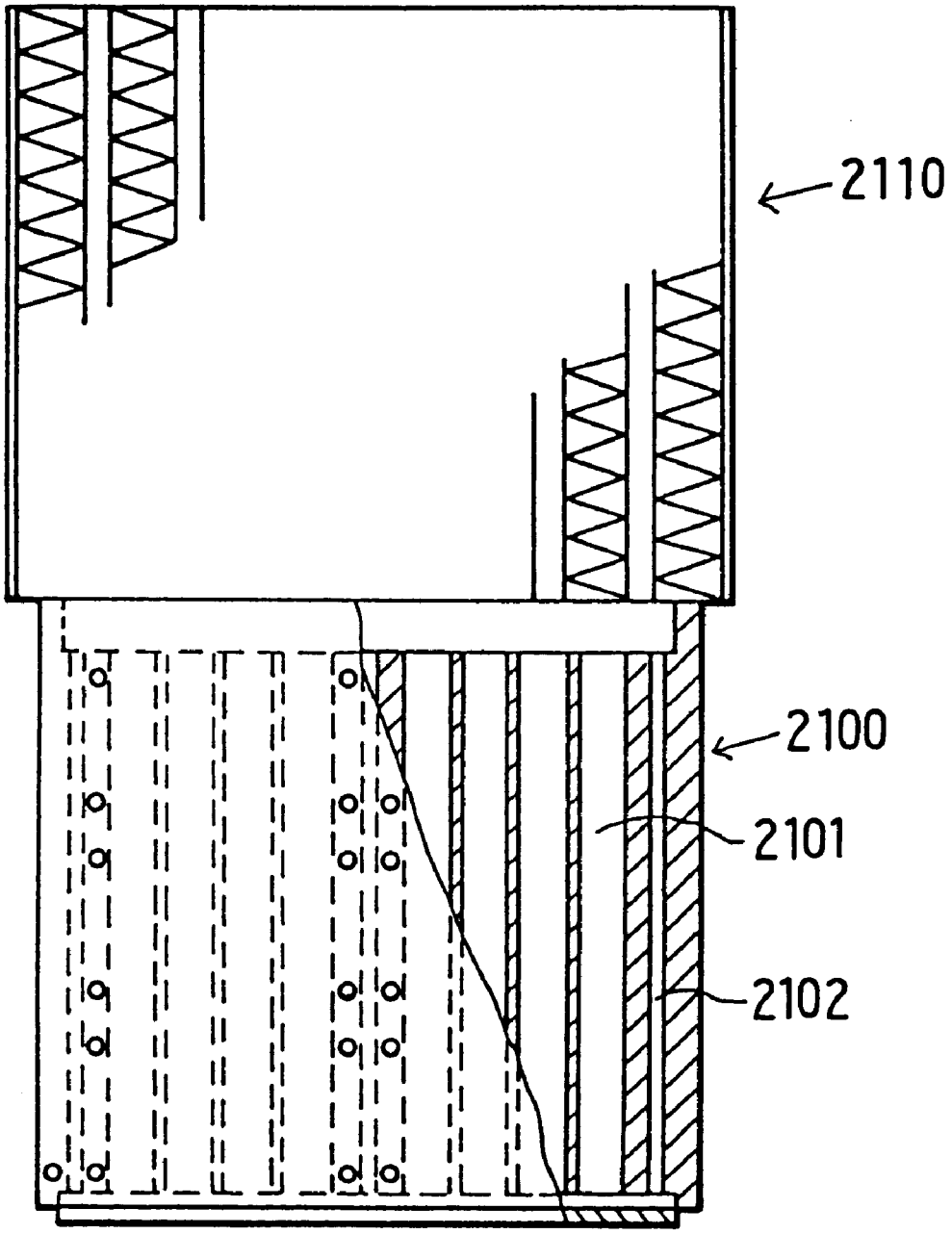
FIG. 43 PRIOR ART
FIG. 43 is a plan view of a conventional cooling apparatus.

The refrigerant tank 403 is provided therein with the refrigerant chambers 408, the liquid returning passages 409, the thermal insulation passages 410 and the communication passage 411. On the upper opening of the hollow member 406, there is mounted an end plate 431, in which there are opened round holes 431*a* for inserting the vapor tubes 429 and the liquid returning tubes 430 thereinto. The round holes 431*a* are opened in the upper portions of the refrigerant chambers 408 and in the upper portions of the liquid returning passages 409. On the other hand, this refrigerant tank 403 is arranged generally upright below the lower tank 421, as shown in FIG. 42.

In this lower tank 421, connecting ports 421*b* are opened in the bottom face of the tank plate 421B for inserting the vapor tubes 429 and the liquid returning tubes 430 thereinto.

The vapor tubes 429 provides communication between the refrigerant chambers 408 and the lower tank 421 by being inserted at their lower end portions into the round holes 431*a* opened in the end plate 431 and at their upper end portions up to the middle (over the bottom face of the lower tank 421) of the inside of the lower tank 421 from the connecting ports 421*b* opened in the tank plate 421B.

The liquid returning tubes 430 provides communication between the liquid returning passages 409 and the lower tank 421 by being inserted at their lower end portions into the round holes 431*a* opened in the end plate 431 and at their upper end portions into the lower tank 421 from the connecting ports 421*b* opened in the tank plate 421B. Here, the upper end openings, i.e., the liquid inlets 418 of the liquid return tubes 430 are opened at substantially the same level as the bottom face of the lower tank 421.

According to the construction of this embodiment, the condensed liquid, as reserved in the lower tank 421, flows preferentially into the liquid inlets 418, as opened at positions lower than those of the vapor outlets 417, and further via the liquid returning tubes 430 into the liquid returning passages 409 of the refrigerant tank 403 and is fed via the communication passage 411 into the refrigerant chambers 408. As a result, the condensed liquid to flow from the vapor outlets 417 into the refrigerant chambers 408 can be reduced to reduce the interference in the refrigerant chambers 408 between the condensed liquid and the vaporized refrigerant thereby to improve the radiation performance.

On the other hand, the numbers of vapor tubes 429 and the liquid returning tubes 430 can be reduced according to the rate of radiation of the heating body 402 attached to the refrigerant tank 403 so that even the heating body 402 having a different radiation rate can be efficiently coped with. In other words, a stable radiation performance can be retained independently of the radiation rate.

Here in this cooling apparatus 401, too, the refrigerant control plate may be arranged in the lower tank 421 over the vapor outlets 417 as in the first embodiment.

[Fourteenth Embodiment]

Figure 44:
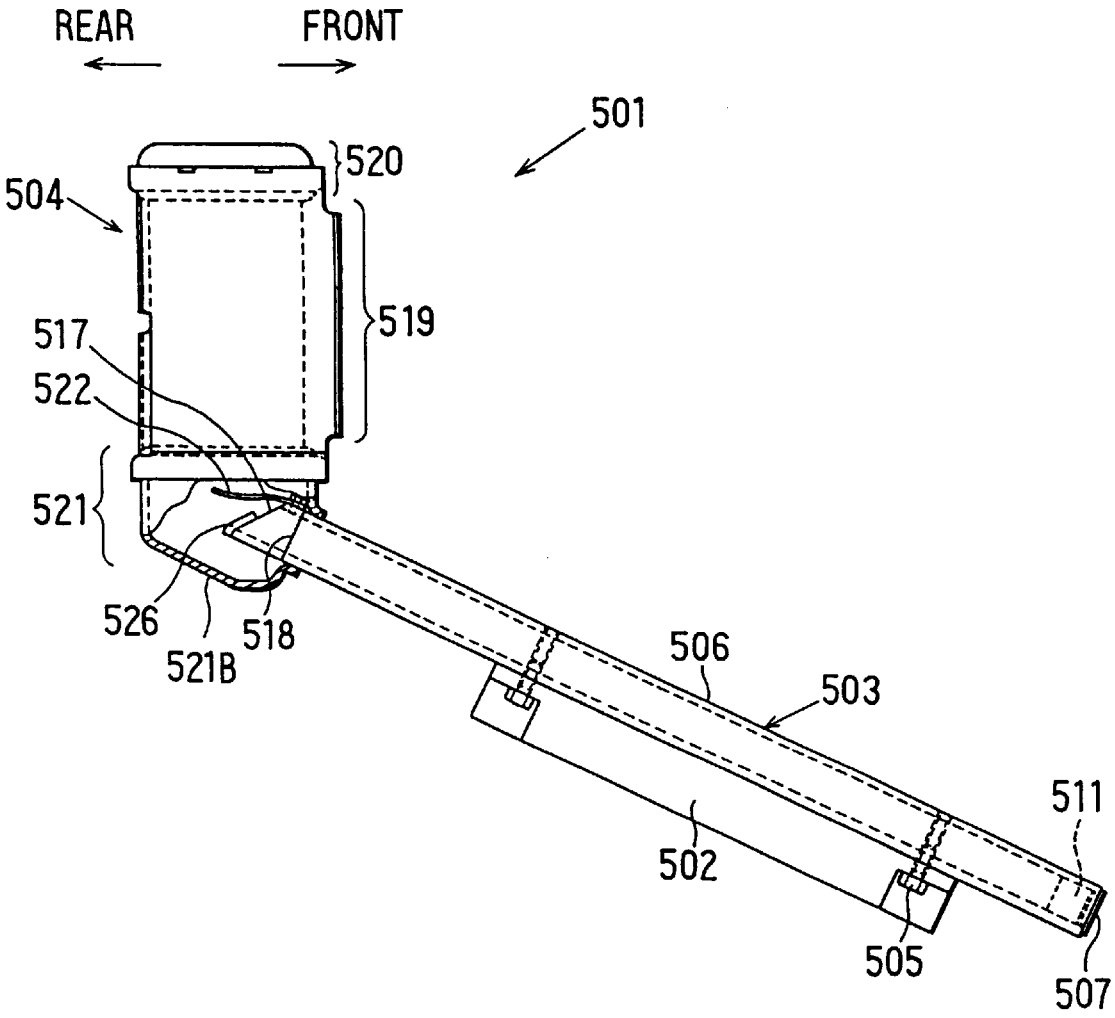
FIG. 44 is a side view of a cooling apparatus (Fourteenth Embodiment)

FIG. 44 is a side view of a cooling apparatus 501.

The cooling apparatus 501 of this embodiment cools a heating body 502 by boiling and condensing a refrigerant repeatedly and is manufactured, by an integral soldering, of a refrigerant tank 503 for reserving a liquid refrigerant therein and a radiator 504 assembled over the refrigerant tank 503.

The heating body 502 is exemplified by an IGBT module constructing the inverter circuit of an electric vehicle and is fixed in close contact on the surface of the refrigerant tank 503 by such as bolts 505, as shown in FIG. 44.

Figure 45:
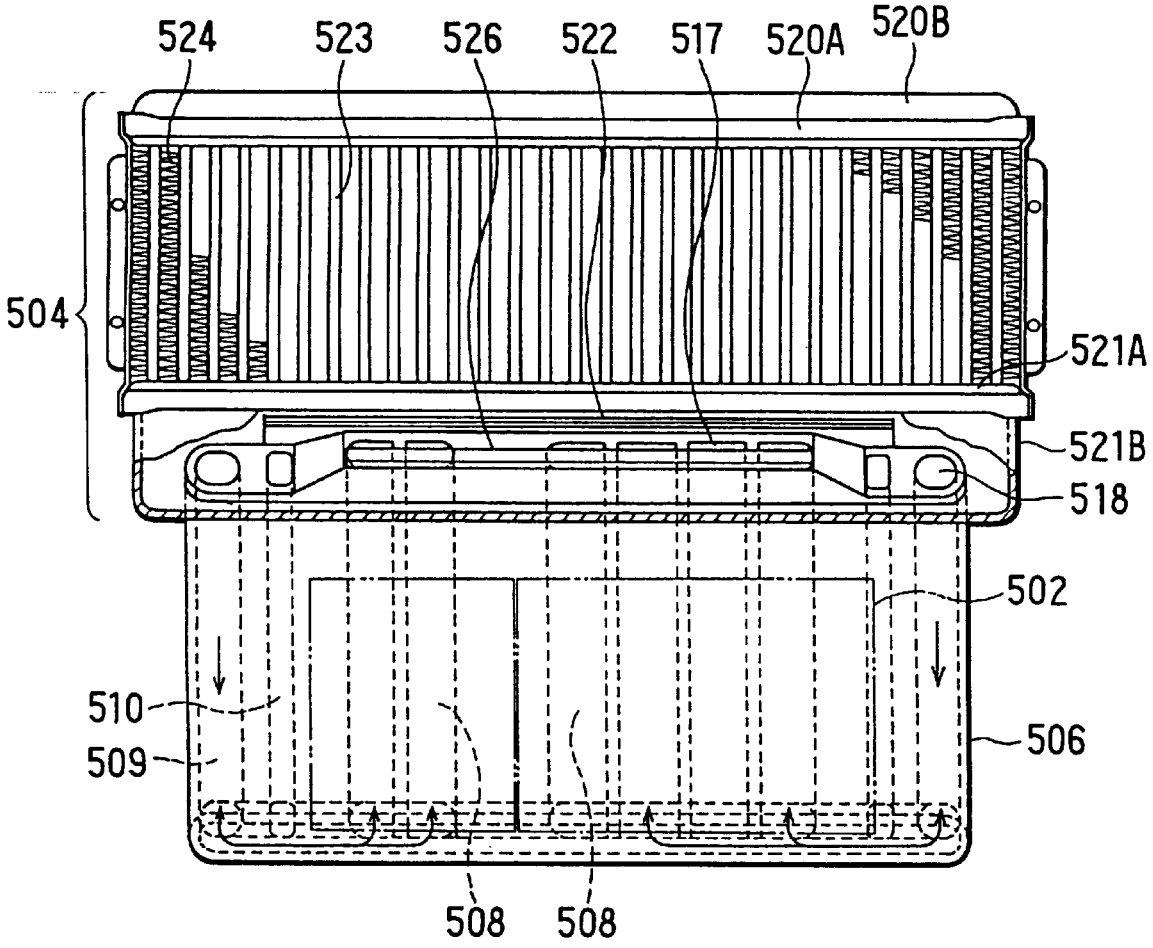
FIG. 45 is a plan view of the cooling apparatus.

The refrigerant tank 503 is composed of a hollow member 506 and an end plate 507 and, as shown in FIG. 45, is provided therein with refrigerant chambers 508, liquid returning passages 509, thermal insulation passages 510 and a communication passage 511 (as referred to FIG. 44).

Figure 46A:
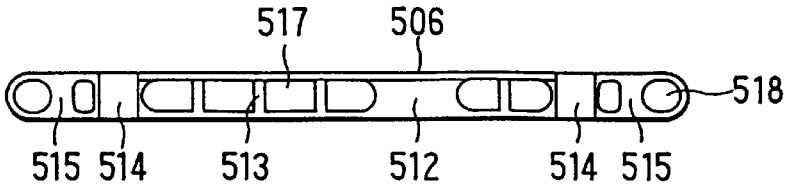
FIG. 46A is a top view of a hollow member.

The hollow member 506 is an extrusion molding made of a metallic material having an excellent thermal conductivity such as aluminum and is formed into a thin shape having a smaller thickness than the width, as shown in FIG. 46A. The hollow member 506 is provided therein with a plurality of ribs of different thicknesses (i.e., a first rib 512, second ribs 513, third ribs 514 and fourth ribs 515). However, the individual ribs 512 to 515 are cut at their lower end portions by a predetermined length, as shown in FIG. 46B, such that their lower end faces are positioned over the lower face of the hollow member 506. On the other hand, the first rib 512 and the third ribs 514 are provided with a plurality of threaded holes 516 for screwing the bolts 505.

Figure 46C:
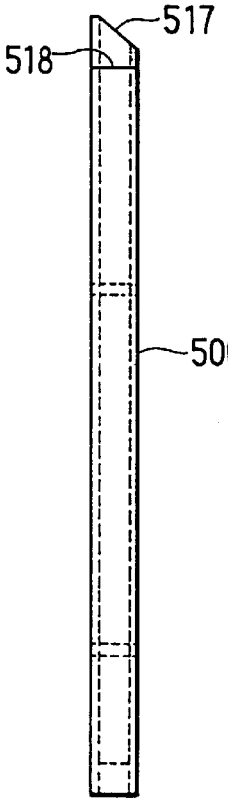
FIG. 46C is a side view of the hollow member.
Figure 46B:
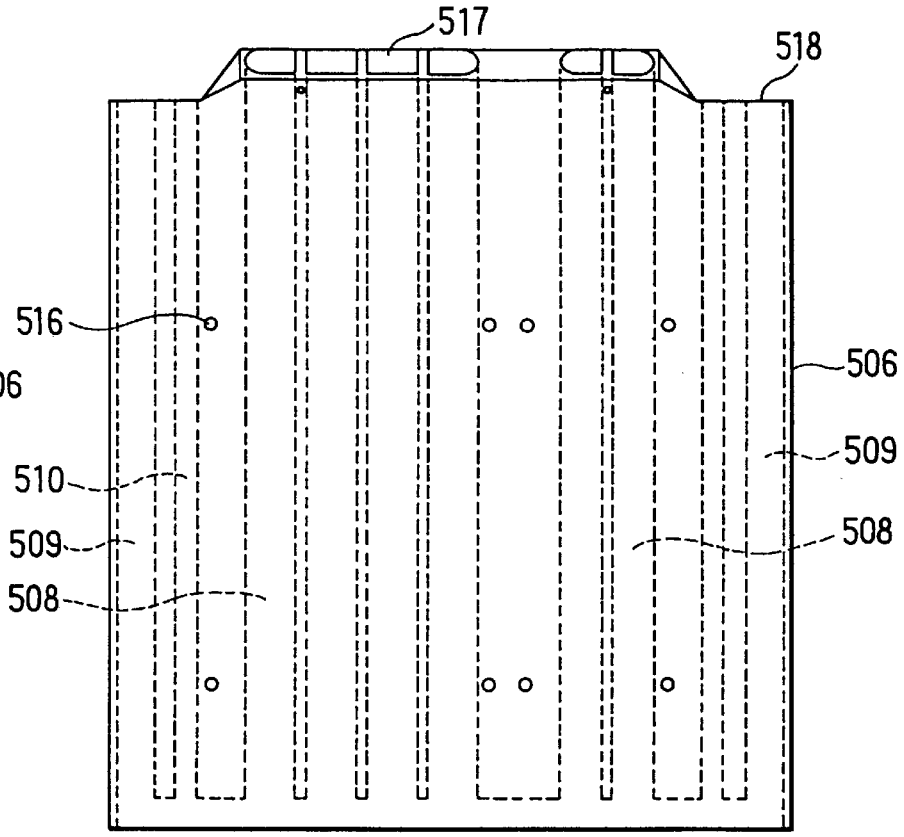
FIG. 46B is a plan view of the hollow member.

The upper end portion of the hollow member 506 has such a level difference between the outer side portions and the inner side portion of the left and right third ribs 514 that the inner side portion protrudes upward relative to the outer side portions and that the inner side portion is sloped at its upper end face, as shown in FIG. 46C.

Figure 47A:
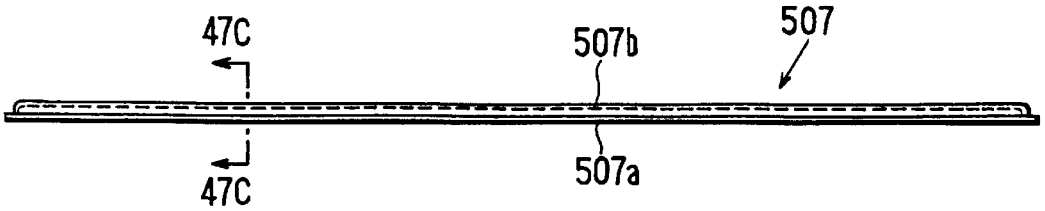
FIG. 47A is a side view of an end plate.
Figure 47B:
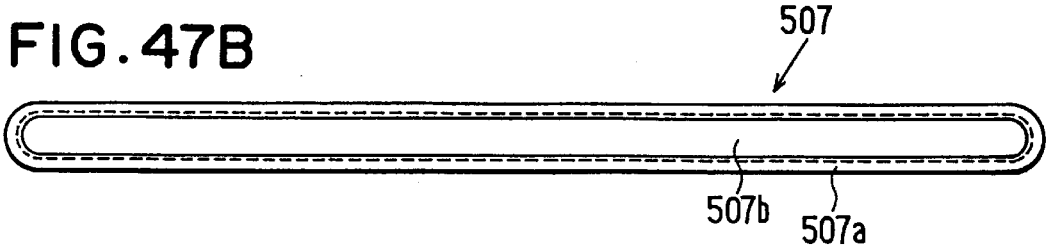
FIG. 47B is a plan view of the end plate.
Figure 47C:
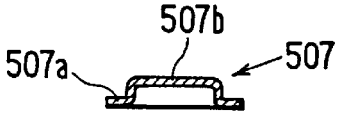
FIG. 47C is a sectional view of the end plate.
Figure 48:
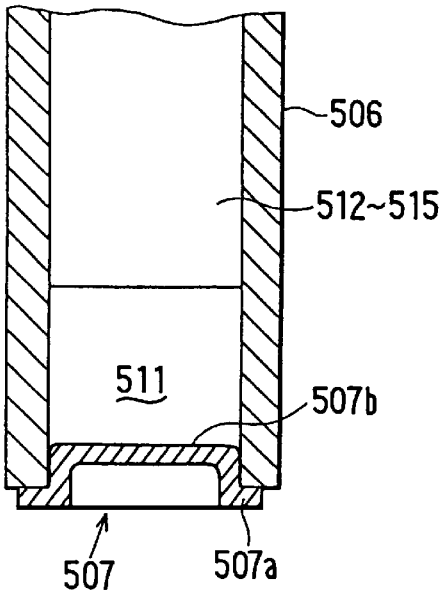
FIG. 48 is a sectional view illustrating a mounted situation of the end plate.

The end plate 507 is made of aluminum, for example, like the hollow member 506 and is formed thin in the transverse direction, as shown in FIGS. 47A–47C, such that an inner side portion 507*b* is slightly raised relative to an outer peripheral edge portion 507*a*. This end plate 507 is caused to plug the lower end opening of the hollow member 506, as shown in FIG. 48, by fitting the raised inner side portion 507*b* in the lower end opening of the hollow member 506 so that the outer peripheral edge portion 507*a* contacts with the outer peripheral lower end face of the hollow member 506. However, a predetermined spacing is retained between the surface of the inner side portion 507*b* of the end plate 507 fitted in the lower end opening of the hollow member 506 and the lower end faces of the individual ribs 512 to 515 of the hollow member 506.

The refrigerant chambers 508 are formed between the first rib 512 located on the right side of the central portion of the hollow member 506, and the left and right third ribs 514, as shown in FIG. 46B, and are partitioned into a plurality of passages by the individual second ribs 513. This refrigerant chambers 508 form chambers for boiling a liquid refrigerant reserved therein when they receives the heat of the heating body 502. Here, in the following description, the upper openings of the refrigerant chambers 508, as opened in the upper end face of the hollow member 506, will be called vapor outlets 517. These vapor outlets 517 are protruded upward relative to the upper end open faces of the liquid returning passages 509, and their open faces are sloped.

The liquid returning passages 509 are passages into which the condensed liquid cooled and liquefied by the radiator 504 flows, and are disposed at the two most left and right sides of the hollow member 506. Here, in the following description, the upper openings of the liquid returning passages 509, as opened in the upper end face of the hollow member 506, will be called liquid inlets 518.

The thermal insulation passages 510 are passages for the thermal insulation between the refrigerant chambers 508 and the liquid returning passages 509 and are partitioned from the refrigerant chambers 508 by the third ribs 514 and from the liquid returning passages 509 by the fourth ribs 515.

The communication passage 511 is a passage for feeding the refrigerant chambers 508 with the condensed liquid having flown into the liquid returning passages 509, and is formed in the lower end portion of the hollow member 506, as plugged with the end plate 507 (as referred to FIG. 48), to provide communication between the liquid returning passages 509, the refrigerant chambers 508 and the thermal insulation passages 510.

As shown in FIG. 44, the radiator 504 is constructed of a core portion 519, an upper tank 520 and a lower tank 521 (or a connecting tank of the invention), and a refrigerant control plate 522 is disposed in the lower tank 521.

The core portion 519 is a radiating portion of the invention for cooling the vaporized refrigerant, as boiled by the heat of the heating body 502, by the heat exchange with an external fluid (e.g., air), and is composed of a plurality of radiating tubes 523 and radiating fins 524 interposed between the individual radiating tubes 523, as shown in FIG. 45.

The radiating tubes 523 form refrigerant passages for the refrigerant to flow therethrough and are made up with plurality of flat tubes made up such as an aluminum and being cut to a predetermined length, and disposed between the lower tank 521 and the upper tank 520 to provide the communication between the lower tank 521 and the upper tank 520.

The radiating fins 524 are formed into the corrugated shape by alternately folding a thin metal sheet (e.g., an aluminum sheet) having an excellent thermal conductivity and are joined to the surfaces of the radiating tubes 523.

The upper tank 520 is constructed by combining a shallow dish shaped core plate 520A and a deep dish shaped tank plate 520B, and the upper end portions of the radiating tubes 523 are individually inserted into a plurality of (not-shown) slots formed in the core plate 520A.

Figure 49A:
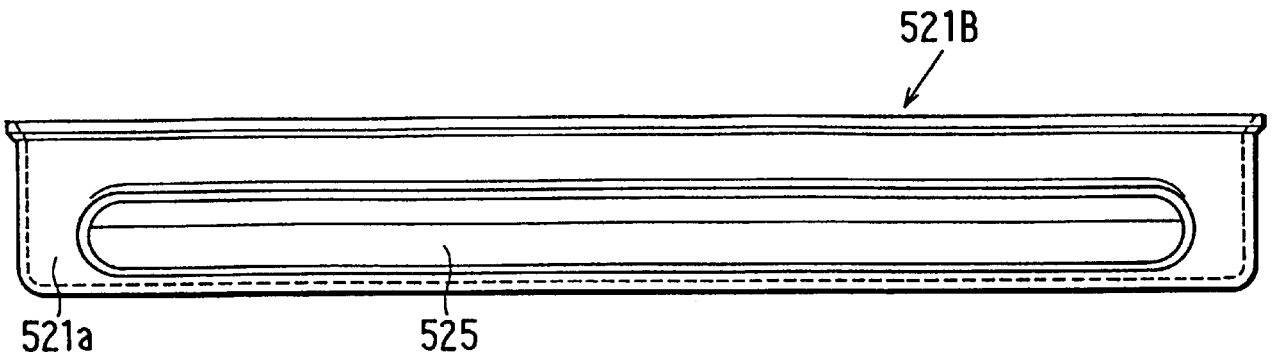
FIG. 49A is a plan view of a lower tank.
Figure 49B:
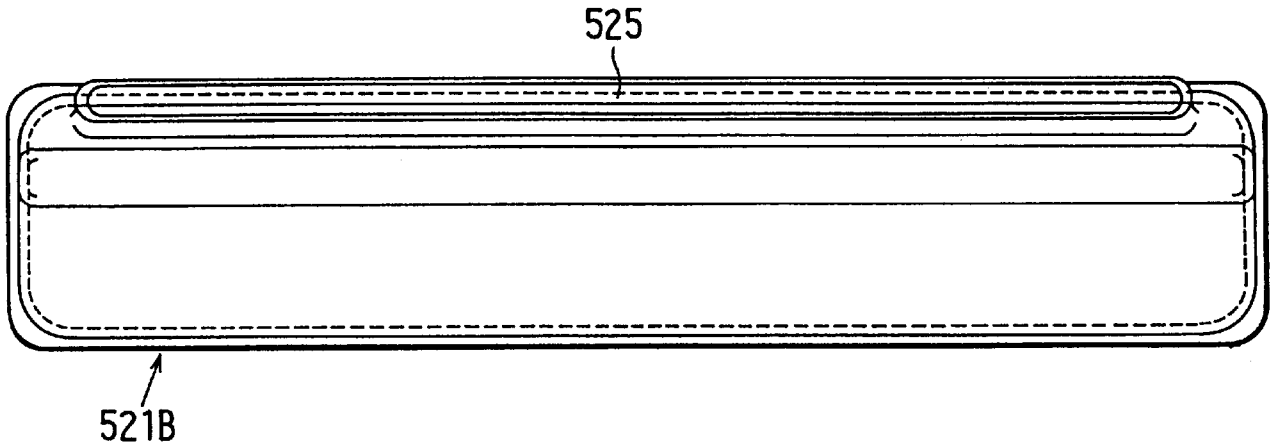
FIG. 49B is a side view of the lower tank.
Figure 49C:
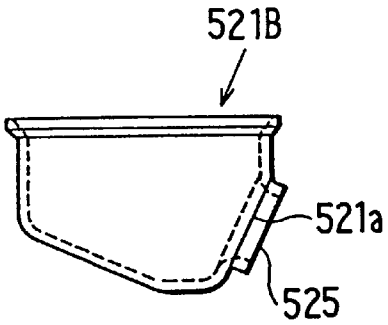
FIG. 49C is a bottom view of the lower tank.

The lower tank 521 is constructed like the upper tank 520 by combining a shallow dish shaped core plate 521A and a deep dish shaped tank plate 521B (as referred to FIGS. 49A–49C). The lower end portions of the radiating tubes 523 are individually inserted into a plurality of (not-shown) slots formed in the core plate 521A, and the upper end portion of the hollow member 506 is inserted (as referred to FIG. 44) into an opening 526 formed in the tank plate 521B. Here, the tank plate 521B is provided with a slope 521*a* having the largest angle of inclination with respect to the lowermost bottom face (i.e., the face opposed to the upper opening to be covered with the core plate 521A) in the shape viewed in its longitudinal direction, as shown in FIG. 49C, and the opening 526 is opened in that slope 521*a* (as referred to FIGS. 49A–49C).

As a result, the refrigerant tank 503 is assembled in a large inclination with respect to the lower tank 521, as shown in FIG. 44. In a vehicle-mounted situation, the refrigerant tank 503 is arranged at more front side of the vehicle than the radiator. That is, the refrigerant tank 503 is connected to the lower tank 503 so that the upper end portion is inclined to rear side in the vehicle. In this figure, the refrigerant tank 503 is arranged so that the right side in the figure is the front side of the vehicle, whereas the left side is the rear side in the vehicle.

Here, the refrigerant tank 503 is inserted into the lower tank 521 through an opening 525 with its face for mounting the heating body 502 being directed downward so that the vapor outlets 517 are directed obliquely upward in the lower tank 521 (therefore, the heating body 502 is mounted on the lower surface of the refrigerant tank 503). Furthermore, as shown in FIG. 45, a back flow prevention plate 526, which covers the whole region of lower side of the vapor outlet 517 in the transverse direction, is fixed to the upper end surface of the hollow member 506 by such as screws.

The refrigerant control plate 522 prevents the condensed liquid, as liquefied by the core portion 519, from dropping directly into the vapor outlets 517. As shown in FIG. 45, the refrigerant control plate 522 extends its two ends over the thermal insulation passages 510 in the transverse direction in the lower tank 521, and covers the vapor outlets 517 and the thermal insulation passages 510 in the back-and-forth direction (as referred to FIG. 44). This refrigerant control plate 522 can be mounted on the surface of the upper end portion of the hollow member 506 to be inserted into the lower tank 521 by means of the screw or the like (as referred to FIG. 44). Here, the refrigerant control plate 522 is desirably mounted in a gently inclined state such that the leading end side is slightly higher than the mounted portion side in the back-and-forth direction of FIG. 44.

Here, operations of this embodiment will be described.

The vaporized refrigerant, as boiled in the refrigerant chambers 508 by the heat of the heating body 502, flows from the vapor outlets 517 into the lower tank 521 and further from the lower tank 521 into the each radiating tubes 523. The vaporized refrigerant flowing through the radiating tubes 523 are cooled by the heat exchange with the external fluid passing through the core portion 519 so that it releases the latent heat and condenses in the radiating tubes 523. The latent heat thus released is transferred from the wall faces of the radiating tubes 523 to the radiating fins 524 and is released through the radiating fins 524 to the external fluid.

On the other hand, the condensed liquid, as condensed into droplets on the inner surfaces of the radiating tubes 523, falls on the inner faces of the radiating tubes 523 by its own weight so that it drips from the radiating tubes 523 into the lower tank 521.

In the lower tank 521, the vapor outlets 517 and the thermal insulation passage 510 are covered thereover with the refrigerant control plate 522 so that the condensed liquid having dropped from the radiating tubes 523 can be prevented from flowing directly into the vapor outlets 517.

The condensed liquid having dropped from the radiating tubes 523 onto the upper face of the refrigerant control plate 522 flows along the slope of the refrigerant control plate 522 and further to the left and right in the passage, as formed between the side faces of the lower tank 521 and the refrigerant control plate 522, into the liquid inlets 518.

On the other hand, the condensed liquid, as reserved in the bottom portion of the lower tank 521, flows into the liquid inlets 518, when its level exceeds the height of the lowermost portions of the liquid inlets 518 so that it can be recycled from the liquid returning passages 509 via the communication passage 511 into the refrigerant chambers 508.

Figure 50A:
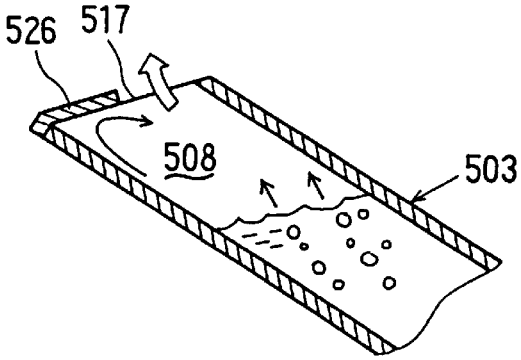
FIG. 50A is a diagram for explaining a suddenly stop.

Next, operations when the vehicle stops suddenly and when the vehicle ascends an uphill road will be explained.

a) Since the cooling apparatus 501 of this embodiment is assembled so that the refrigerant tank 503 is largely inclined to the rear side in the vehicle in the back-and-forth direction with respect to the radiator 504, when the vehicle stops suddenly, the liquid refrigerant in the refrigerant chamber 508 is likely to spill from the vapor outlet 517. However, since the back flow prevention plate 526 covers the lower side of the vapor outlet 517, the liquid refrigerant flowing back to the vapor outlet 517 in the refrigerant chamber 508 as a result of suddenly stop is repelled by the back flow prevention plate 526 so as to prevent the flowing back liquid refrigerant from spilling from the vapor outlet 517, as fererred by arrow in FIG. 50A.

b) When the vehicle ascends an uphill road, since the inclination of the refrigerant tank 503 becomes large (an attitude of the refrigerant is almost horizontal situation), liquid level of the refrigerant in the refrigerant chamber 508 rises with respect to the vapor outlet 517 so as to approach the vapor outlet 517.

Figure 50B:
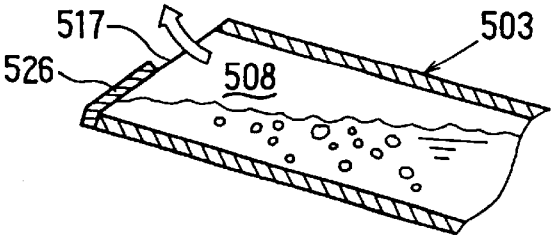
FIG. 50B is a diagram explaining an ascending an uphill road.

Therefore, the liquid refrigerant in the refrigerant chamber 508 might easily spill from the vapor outlet 517 during ascending the uphill road. In this case, since the back flow prevention plate 526 covers the lower side of the vapor outlet 517, the back flow prevention plate 526 prevent the liquid refrigerant from spilling from the vapor outlet 517 even when the liquid level of the refrigerant in the refrigerant chamber 508 rises over the lowermost portion of the vapor outlet 517, as shown in FIG. 50B.

(Effects of the Fourteenth Embodiment)

In this embodiment, since the lower side of the vapor outlet 517 is covered by the back flow prevention plate 526, it can prevent the liquid refrigerant in the refrigerant chamber 508 from spilling from the vapor outlet 517 when the vehicle stops suddenly or ascends the uphill road. Hence, the boiling face (mounting face for the heating body) can be stably filled with the liquid refrigerant. As a result, it can prevent radiation efficiency from decreasing due to the burnout (abrupt temperature rising) of the boiling faces.

Especially when the condensed liquid amount becomes the less as the refrigerant tank 503 is thinned the more, the burnout of the boiling faces are likely occur because the liquid refrigerant in the refrigerant chamber spills from the vapor outlet 517 as a result of the suddenly stopping or the ascending the uphill road. Therefore, in the thinned refrigerant tank 503, the back flow prevention plate 526 is highly effective for suppression of spilling of liquid refrigerant.

Here, since the covering the lower side of the vapor outlet by the back flow prevention plate 526 enable to enlarge the level difference between the openings of the vapor outlets 517 uncovered with the back flow prevention plate 526 and the liquid inlets 518, the condensed liquid reserved in the lower tank 521 can flow more stably into the liquid inlets 518 to further reduce the condensed liquid flowing from the vapor outlets 517 into the refrigerant chambers 508. Furthermore, it can reduce the interference in the refrigerant chambers 508 between the rising vaporized refrigerant and the falling condensed liquid.

[Fifteenth Embodiment]

Figure 51:
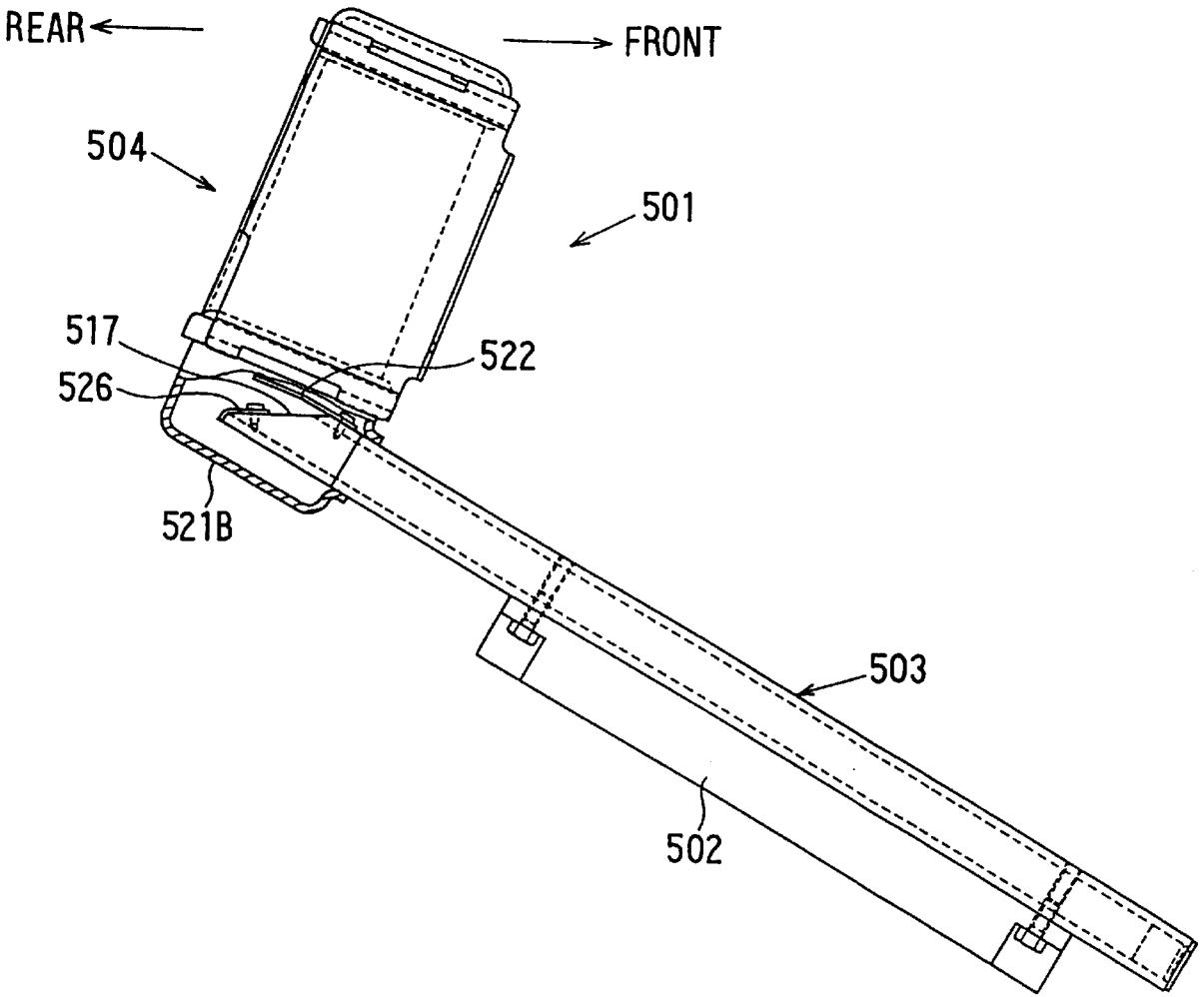
FIG. 51 is a side view of a cooling apparatus (Fifteenth Embodiment)

FIG. 51 is a side view of a cooling apparatus 501.

In this embodiment, the radiator 504 of the cooling apparatus 501 explained in the first embodiment is assembled in inclination to the front side of the vehicle.

In this cooling apparatus 501, since the attitude of the radiator 504 approaches vertically when the vehicle ascends a hill (uphill) road where the vehicle needs more power, it can prevent a part of the radiator 504 from soaking in the liquid refrigerant so that the radiator 504 can secure a required radiation performance.

This embodiment can also obtain the same effects as that of first embodiment because the lower side of the vapor outlet 517 is covered by the back flow prevention plate 526.

[Sixteenth Embodiment]

Figure 52:
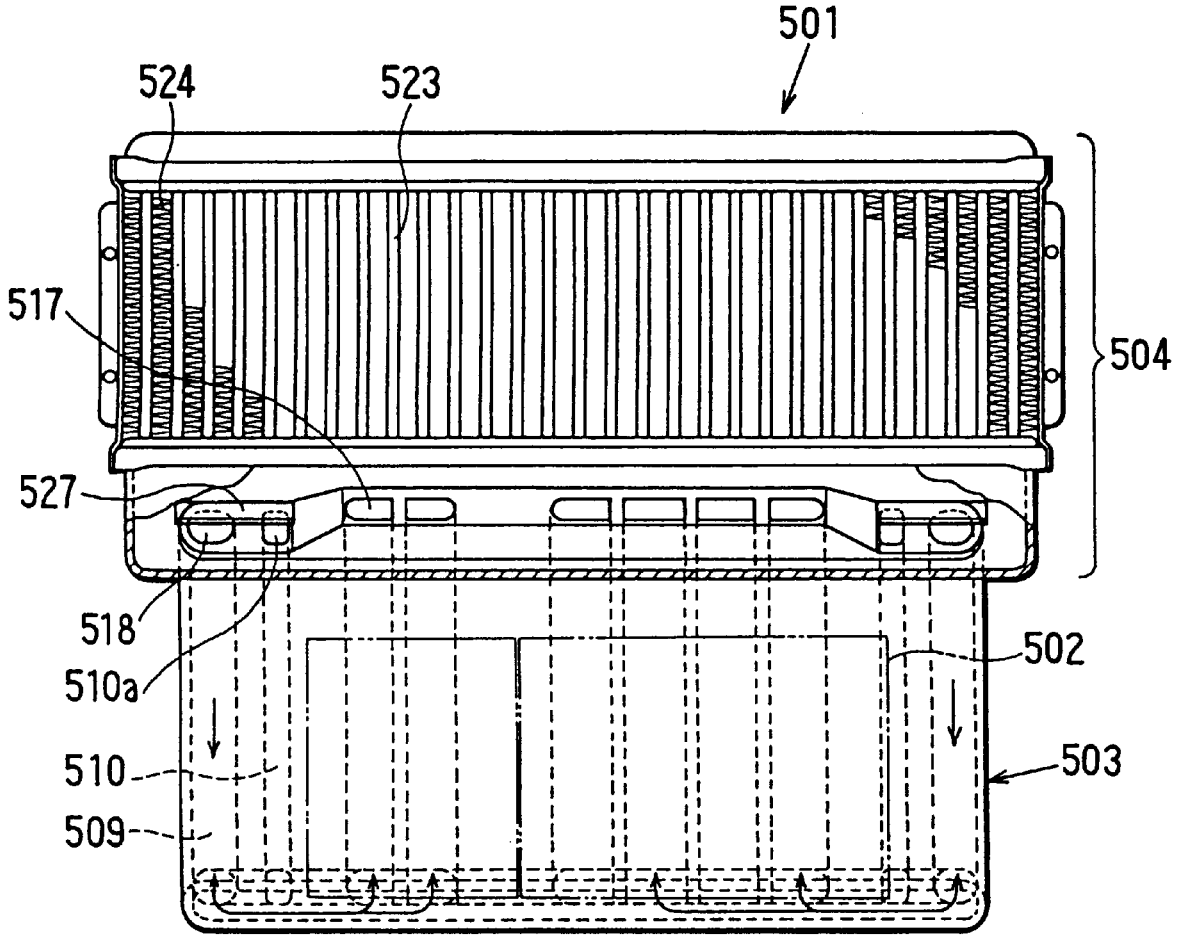
FIG. 52 is a plan view of a cooling apparatus (Sixteenth Embodiment)

FIG. 52 is a plan view of a cooling apparatus.

In this embodiment, an upper side of an upper end openings 510*a* of the liquid inlet 518 and the thermal insulation passage 510 are covered by a back flow prevention plate 527. In this case, it can prevent liquid refrigerant in the refrigerant tank from spilling from the upper end openings 510*a* of the liquid inlet 518 and the thermal insulation passage 510 when the vehicle stops suddenly or ascends a hill (uphill) road, and it enable to stably soak the boiling faces of the refrigerant tank 503 in the liquid refrigerant.

Furthermore, since the back flow prevention plate 527 covers the upper side of the liquid inlet 518, the back flow prevention plate 527 does not prevent the condensed refrigerant in the lower tank 521 from flowing into the liquid inlet 518 so that the condensed refrigerant can recycle from the lower side of the liquid inlet 518.

[Seventeenth Embodiment]

Figure 53:
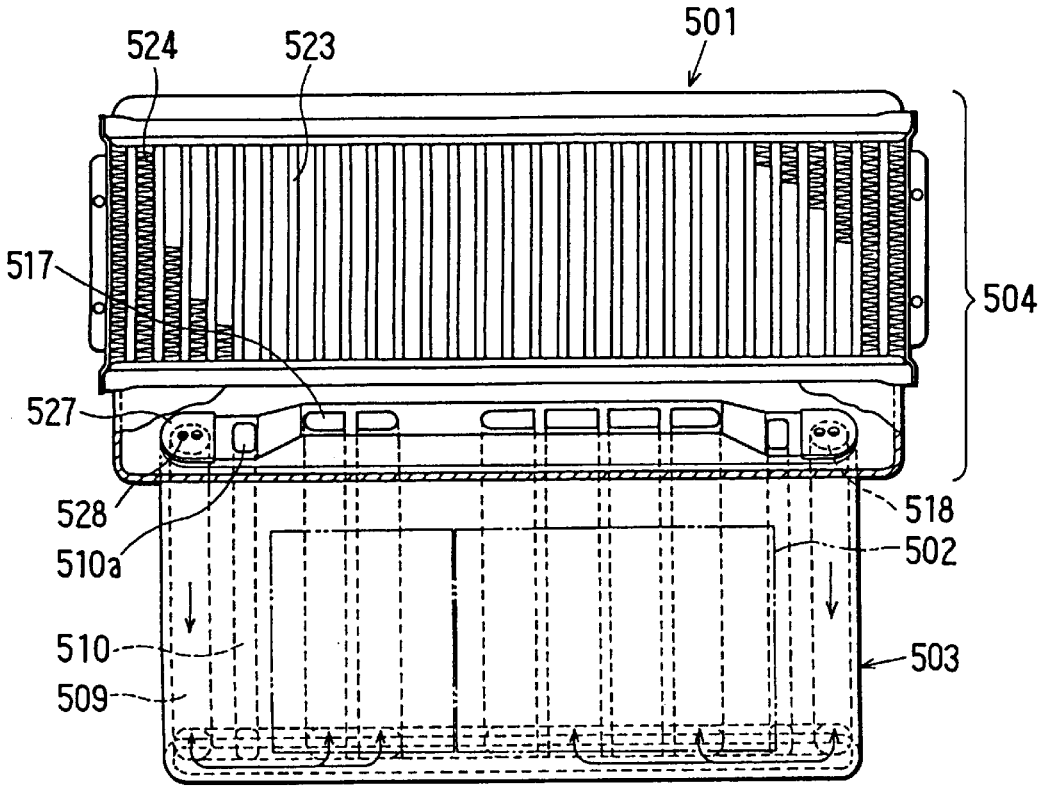
FIG. 53 is a plan view of a cooling apparatus (Seventeenth Embodiment)

FIG. 53 is a plan view of a cooling apparatus 501.

In this embodiment, whole of the liquid inlet 518 is covered with a back flow prevention plate 527 having a plurality of small holes 528. In this case, it can prevent liquid refrigerant in the refrigerant tank 503 from spilling from the liquid inlet 518 when the vehicle stops suddenly or ascends a hill (uphill) road, and it enable to stably soak the boiling faces of the refrigerant tank 503 in the liquid refrigerant.

Here, the back flow prevention plate 527 may extend to the upper end opening 510*a* of the thermal insulation passage 510 so as to cover the upper end opening 510*a* of the thermal insulation passage 510 as well as the liquid inlet 518. That is, the small holes 528 may be formed with the back flow prevention plate 527 at the region where just above the vapor outlet.

[Eighteenth Embodiment]

Figure 54:
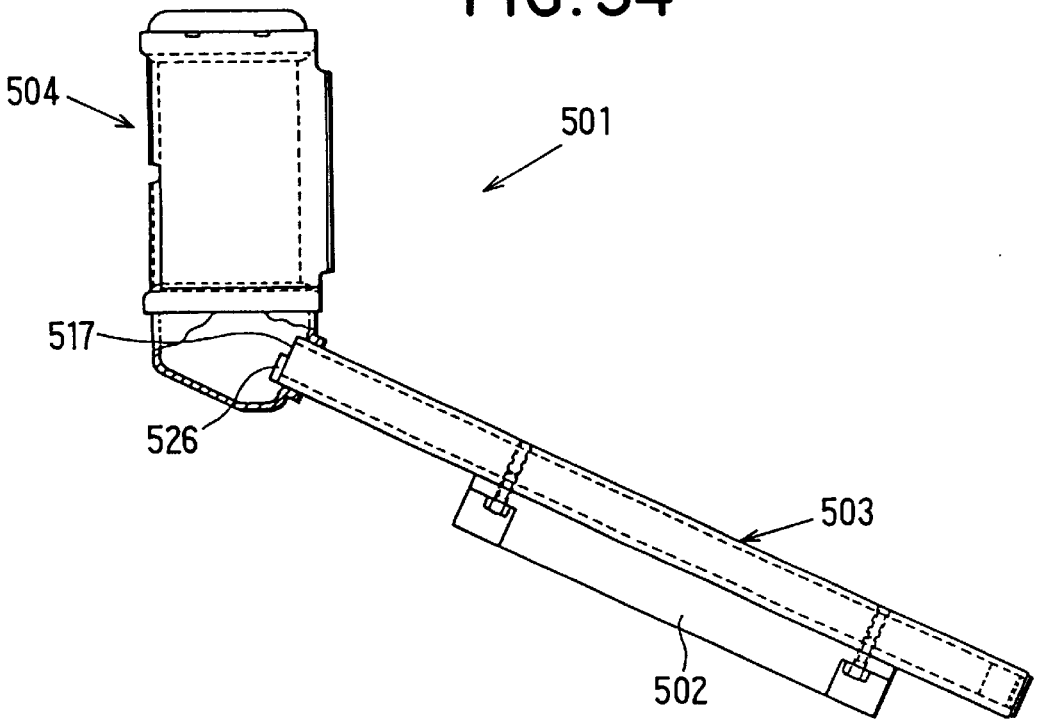
FIG. 54 is a side view of a cooling apparatus (Eighteenth Embodiment)

FIG. 54 is a side view of a cooling apparatus 501.

In this embodiment, an upper end surface of the refrigerant 503 is set to same height (the vapor outlet 517 and the upper end openings 510*a* of the liquid inlet 518 and the thermal insulation passage 510 are set to same height each other), and the lower side of the vapor outlet 517 is covered by a back flow prevention plate 526.

In this case, it can prevent liquid refrigerant in the refrigerant chamber 508 from spilling from the vapor outlet 517 when the vehicle stops suddenly or ascends a hill (uphill) road, and it enable to stably soak the boiling faces of the refrigerant tank 503 in the liquid refrigerant.

[Nineteenth Embodiment]

Figure 55:
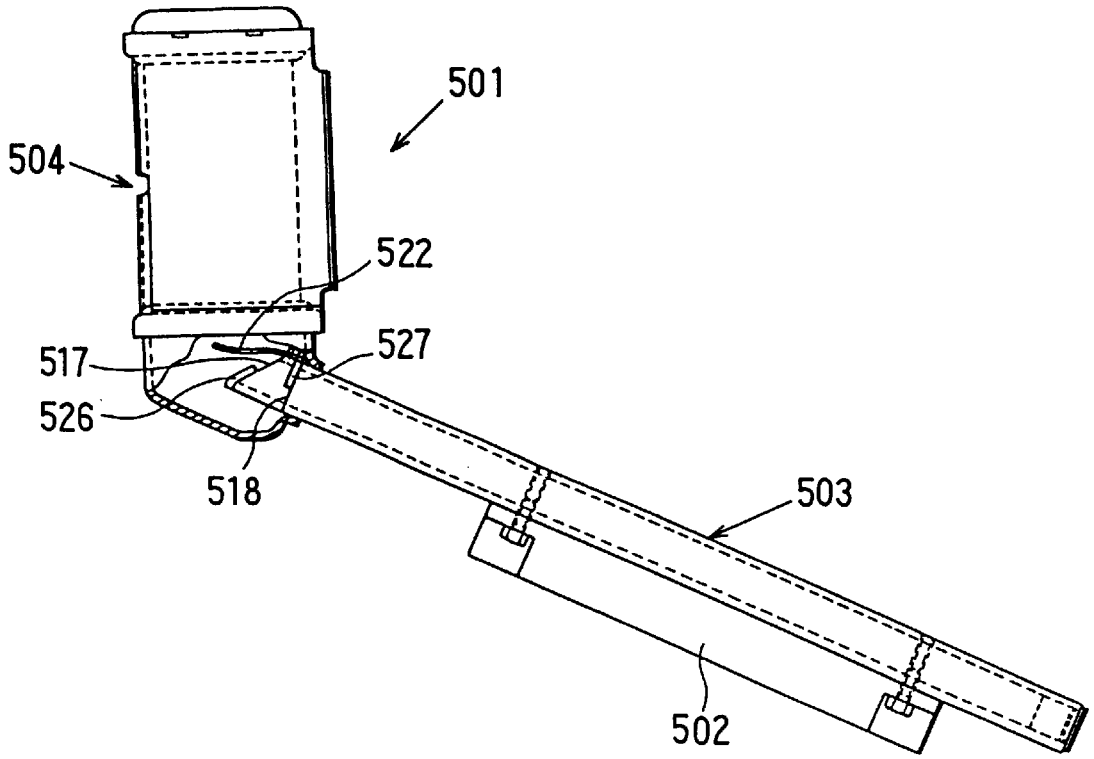
FIG. 55 is a side view of a cooling apparatus (Nineteenth Embodiment)
Figure 56:
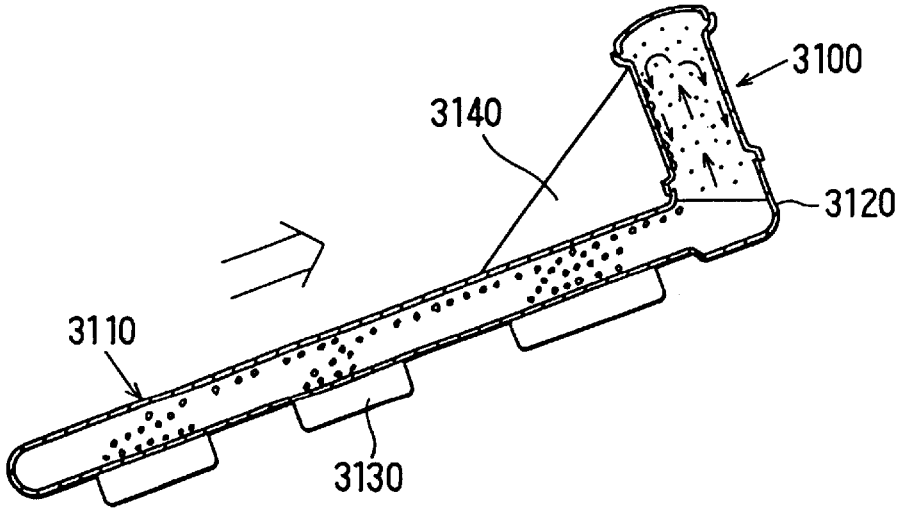
FIG. 56 PRIOR ART
FIG. 56 is a sectional view of a conventional cooling apparatus.

FIG. 55 is a side view of a cooling apparatus 501.

In this embodiment, the back flow prevention plates 526, 527 are adopted to the cooling apparatus 501 of the First Embodiment. The lower side of the vapor outlet 517 is covered by the back flow prevention plates 526, and the upper side of the liquid inlet 518 is covered by the back flow prevention plates 527.

In this case, it can prevent liquid refrigerant in the refrigerant tank 503 from spilling from the vapor outlet 517 and the liquid inlet 518 by the back flow prevention plates 526, 527 when the vehicle stops suddenly or ascends a hill (uphill) road, and it enable to stably soak the boiling faces of the refrigerant tank 503 in the liquid refrigerant.

[Twentieth Embodiment]

Figure 57:
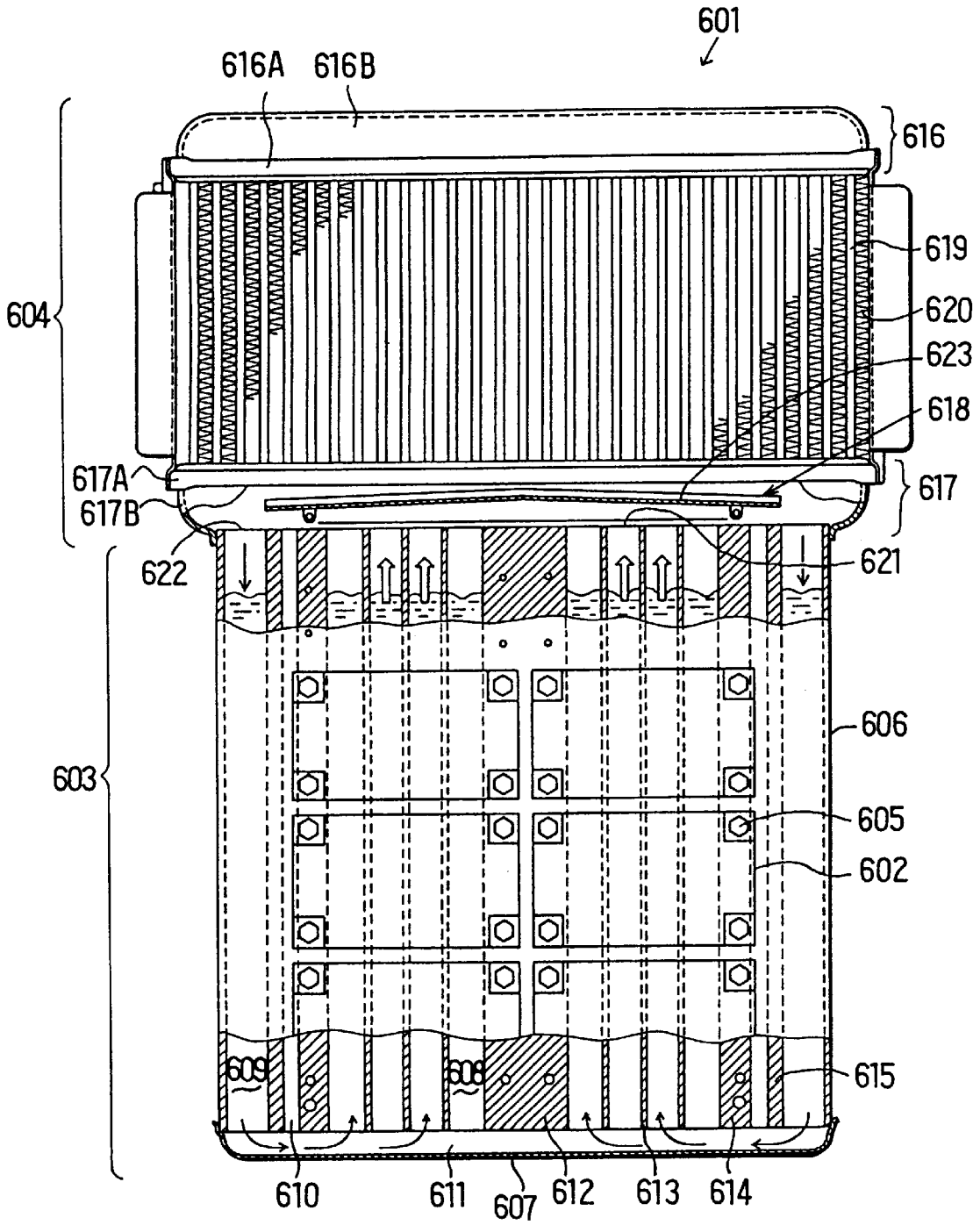
FIG. 57 is a plan view of a cooling apparatus (Twentieth Embodiment)

FIG. 57 is a plan view of a cooling apparatus 601.

The cooling apparatus 601 of this embodiment cools a heating body 602 by boiling and condensing a refrigerant repeatedly and is manufactured, by an integral soldering, of a refrigerant tank 603 for reserving a liquid refrigerant therein and a radiator 604 assembled over the refrigerant tank 603.

Figure 58:
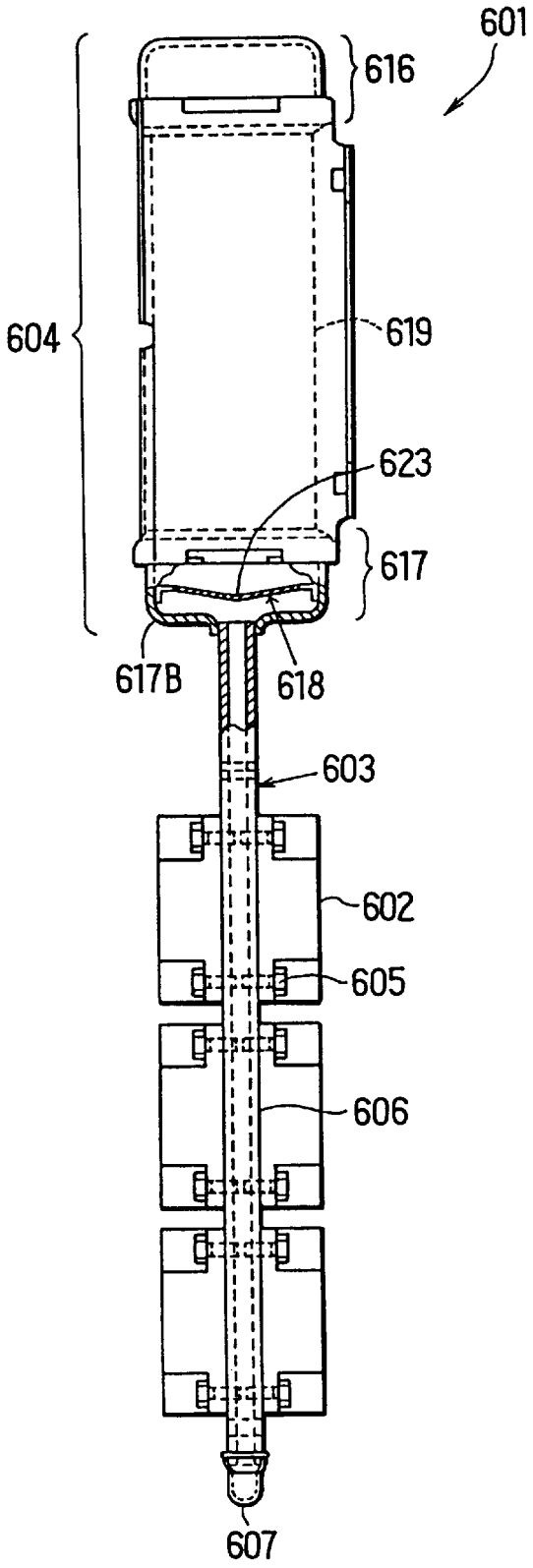
FIG. 58 is a side view of the cooling apparatus.

The heating body 602 is exemplified by an IGBT module constructing the inverter circuit of an electric vehicle and is fixed in close contact on the both surface of the refrigerant tank 603 by such as bolts 605, as shown in FIG. 58.

The refrigerant tank 603 is composed of a hollow member 606 and an end plate 607 and is provided therein with refrigerant chambers 608, liquid returning passages 609, thermal insulation passages 610 and a communication passage 611.

The hollow member 606 is an extrusion molding made of a metallic material having an excellent thermal conductivity such as aluminum and is formed into a thin shape having a smaller thickness than the width. The hollow member 606 is provided therein with a plurality of partition walls of different thicknesses (i.e., a first partition wall 612, second partition walls 613, third partition walls 614 and fourth partition walls 615).

The end cap 607 is made of aluminum, for example, like the hollow member 606 and is caused to plug the lower end opening of the hollow member 606 so that a predetermined spacing is retained between a lower end surface of the hollow member 606 and the end cap 607.

The refrigerant chambers 608 are formed on the both side of the first partition wall 612 located on the central portion of the hollow member 606, and are partitioned into a plurality of passages by the individual second partition walls 613. This refrigerant chambers 608 form chambers for boiling a liquid refrigerant reserved therein when they receives the heat of the heating body 602.

The liquid returning passages 609 are passages into which the condensed liquid cooled and liquefied by the radiator 604 flows, and are disposed at the two most left and right sides of the hollow member 606.

The thermal insulation passages 610 are passages for the thermal insulation between the refrigerant chambers 608 and the liquid returning passages 609 and are partitioned from the refrigerant chambers 608 by the third partition walls 614 and from the liquid returning passages 609 by the fourth partition walls 615.

The communication passage 611 is a passage for feeding the refrigerant chambers 608 with the condensed liquid having flown into the liquid returning passages 609, and is formed inside space of the end cap 607, to provide communication between the liquid returning passages 609, the refrigerant chambers 608 and the thermal insulation passages 610.

The radiator 604 is constructed of a core portion (described after), an upper tank 616 and a lower tank 617 (or a connecting tank of the invention), and a refrigerant control plate 618 is disposed in the lower tank 617.

The core portion is a radiating portion of the invention for cooling the vaporized refrigerant, as boiled by the heat of the heating body 602, by the heat exchange with an external fluid (e.g., air), and is composed of a plurality of radiating tubes 619 and radiating fins 620 interposed between the individual radiating tubes 619.

The radiating tubes 619 form refrigerant passages for the refrigerant to flow therethrough and are made up with plurality of flat tubes made up such as an aluminum and being cut to a predetermined length, and disposed between the lower tank 617 and the upper tank 616 to provide the communication between the lower tank 617 and the upper tank 616.

The radiating fins 620 are formed into the corrugated shape by alternately folding a thin metal sheet (e.g., an aluminum sheet) having an excellent thermal conductivity and are joined to the surfaces of the radiating tubes 619.

The upper tank 616 is constructed by combining a shallow dish shaped core plate 616A and a deep dish shaped tank plate 616B, and the upper end portions of the radiating tubes 619 are individually inserted into a plurality of (not-shown) slots formed in the core plate 616A.

The lower tank 617 is constructed like the upper tank 616 by combining a shallow dish shaped core plate 617A and a deep dish shaped tank plate 617B. The lower end portions of the radiating tubes 619 are individually inserted into a plurality of (not-shown) slots formed in the core plate 617A, and the upper end portion of the hollow member 606 is inserted (as referred to FIG. 57) into an opening formed in the tank plate 617B. In this way, upper end opening portions of each the refrigerant chamber 608, the liquid returning passages 609, and the thermal insulation passages 610 is opened into the lower tank 617. Here, the upper end opening portion of the refrigerant chamber 608 is a vapor outlet 621 through which a boiled refrigerant in the refrigerant chamber 608 flows out, the upper end opening portion of the liquid returning passages 609 is a liquid inlet 622 through which a condensed refrigerant in the radiator flows in.

Figure 59A:
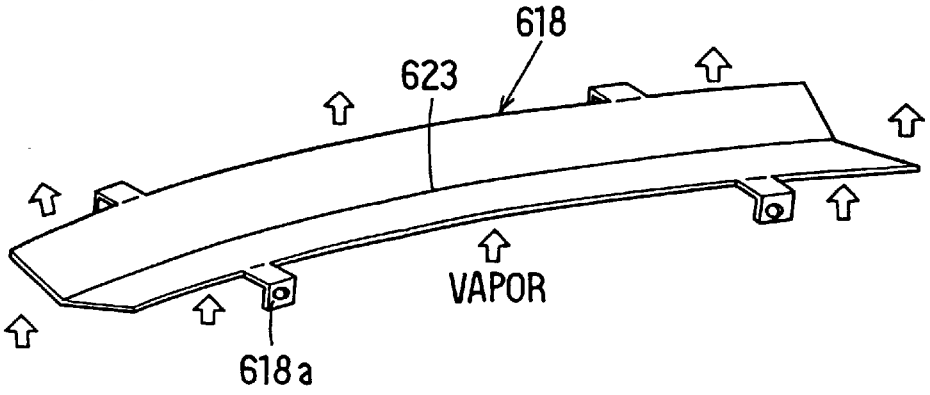
FIG. 59A is a perspective view of a refrigerant control plate.
Figure 59B:
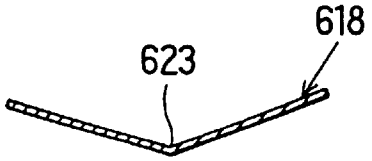
FIG. 59B is a sectional view of the refrigerant control plate.

As shown in FIG. 59A, the refrigerant control plate 618 is formed long in a transverse direction, and its both sides are lower than center portion so that it forms curving surface as a whole. As shown in FIG. 59B, in a back-and-forth direction, the refrigerant control plate 618 having an oblique surface in which a height of a center portion is lowest, and is gradually elevated toward to both peripheral portions in the back-and-forth direction. Stays 618*a* are integrally provided at both of back-and-forth direction of the refrigerant control plate 618 to connect the refrigerant control plate 618 to the lower tank 617.

The refrigerant control plate 618 is connected to the lower tank 617 by fixing the stays 618 to both sides in a back-and-forth direction of the lower tank 617. As shown in FIG. 57, the both ends in the transverse direction of the refrigerant control plate 618 reach above the fourth partition walls 615 in the lower tank 617 to cover above the vapor outlets 621 and above the thermal insulation passages 610. Furthermore, as shown in FIG. 58, the both ends in the back-and-forth direction approach the side surfaces of the lower tank 617 to secure a predetermined gap between the side surfaces of the lower tank 617.

Here, the refrigerant control plate 618 shown in FIG. 57 has the oblique surface in which the height of the center portion is lowest, and is gradually elevated toward to both peripheral portions in the back-and-forth direction, however, has the same function as that of the refrigerant control plate 618 shown in FIG. 59A.

Here, operations of this embodiment will be described.

The vaporized refrigerant, as boiled in the refrigerant chambers 608 by heat of the heating body 602, flows from the vapor outlets 621 into the lower tank 617 and further from the lower tank 617 into the individual radiating tubes 619 through the gap secured around the refrigerant control plate 618 in the lower tank 617. The vaporized refrigerant flowing through the radiating tubes 619 are cooled by the heat exchange with the external fluid passing through the core portion so that it releases the latent heat and condenses in the radiating tubes 619. The latent heat thus released is transferred from the wall faces of the radiating tubes 619 to the radiating fins 620 and is released through the radiating fins 620 to the external fluid.

On the other hand, the condensed liquid, as condensed into droplets, falls on the inner faces of the radiating tubes 619 by its own weight so that it drips from the radiating tubes 619 into the lower tank 617.

In the lower tank 617, the vapor outlets 621 are covered thereover with the refrigerant control plate 618 and the thermal insulation passages 610 so that the condensed liquid having dropped from the radiating tubes 619 can be prevented from flowing directly into the vapor outlets 621.

Since the refrigerant control plate 618 is formed so that its both sides are lower than the center portion in the transverse direction, and that its center portion is lower than the both sides in the back-and-forth direction, the upper surface of the refrigerant control plate 618 is provided with a condensed refrigerant passage 623 which slopes to the center portion in the back-and-forth direction and slopes to the both side in the transverse direction. Accordingly, the condensed liquid having dropped from the radiating tubes 619 onto the upper face of the refrigerant control plate 618 can stably flow to the left and right of the refrigerant control plate 618 along the condensed refrigerant passage 623, to the liquid returning passage 609 via the liquid inlet 622 opened to the lower tank 617, and further to the refrigerant chamber 608 through the communication passage 611.

(Effects of the Twentieth Embodiment)

In this embodiment, the refrigerant control plate 618 is arranged in the lower tank 617 so that the condensed liquid having dropped from the radiating tubes 619 can be prevented from flowing directly into the vapor outlets 621. Furthermore, the condensed liquid having dropped from the radiating tubes 619 can flow into the liquid inlet 622 along the condensed refrigerant passage 623 provided on the upper surface of the refrigerant control plate 618.

Therefore, it can reduce the interference between the condensed liquid and the vaporized refrigerant in the refrigerant chambers 608, and the condensed liquid is not blown up in the lower tank 617 by the vaporized refrigerant flowing out from the vapor outlets 621, but can be efficiently recycled into the refrigerant chambers 608 so that the circulating efficiency of the refrigerant can be improved to suppress the burnout of the boiling faces.

Especially when the boiling surface of the refrigerant chamber 608 becomes the more reluctant to be soaked in the liquid refrigerant enough to boil as the refrigerant tank 603 is thinned the more, the radiation performance is likely to decrease due to the burnout of the boiling faces. Hence, in the thinned refrigerant tank 603, the improvement of circulating of the refrigerant by the refrigerant control plate 618 is highly effective for easy return of the condensed liquid to the refrigerant chambers 608.

Furthermore, since it can prevent the condensed refrigerant from flowing into the refrigerant chamber 608 through the vapor outlet 621 and can form the condensed refrigerant passage 623 that guides the condensed liquid refrigerant to the liquid inlet 622 by one refrigerant control plate 618, the effects of this embodiment (it can reduce the interference between the condensed liquid and the vaporized refrigerant in the refrigerant chambers 608, and can improve the circulating of the refrigerant) can be realized by simple structure and at low cost.

Figure 60A:
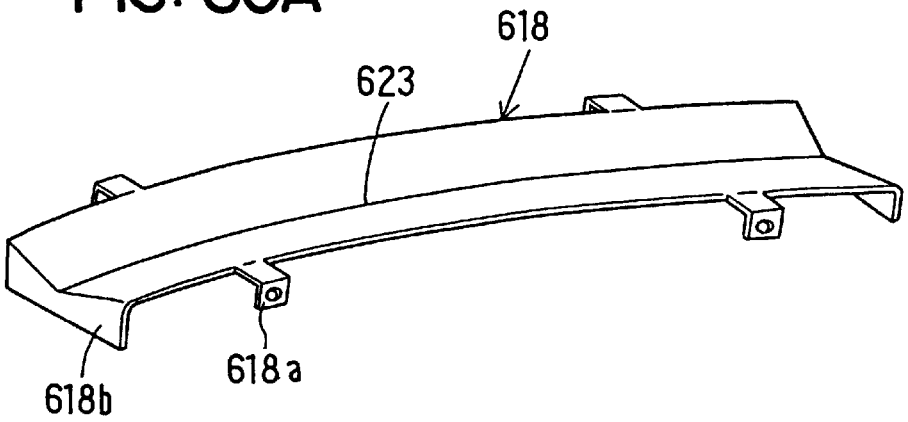
FIG. 60A is a perspective view of a refrigerant control plate.
Figure 60B:
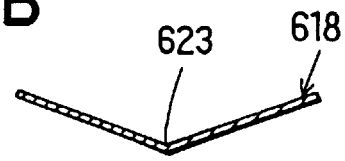
FIG. 60B is a sectional view of the refrigerant control plate.
Figure 61A:
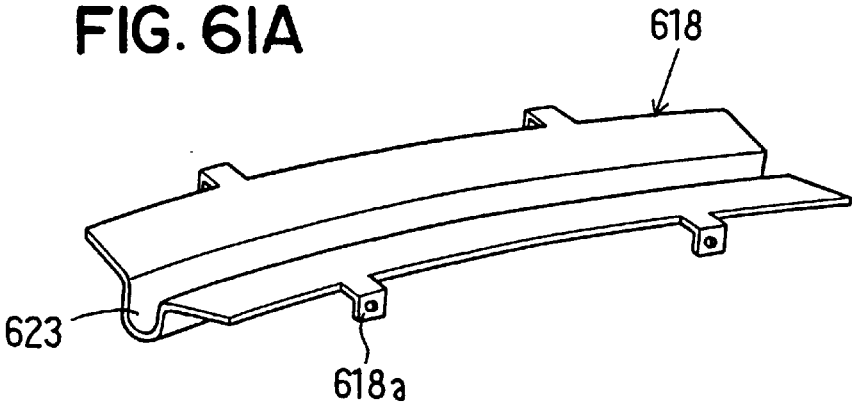
FIG. 61A is a perspective view of a refrigerant control plate.
Figure 61B:
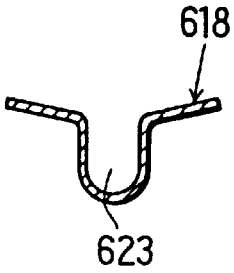
FIG. 61B is a sectional view of the refrigerant control plate.
Figure 62A:
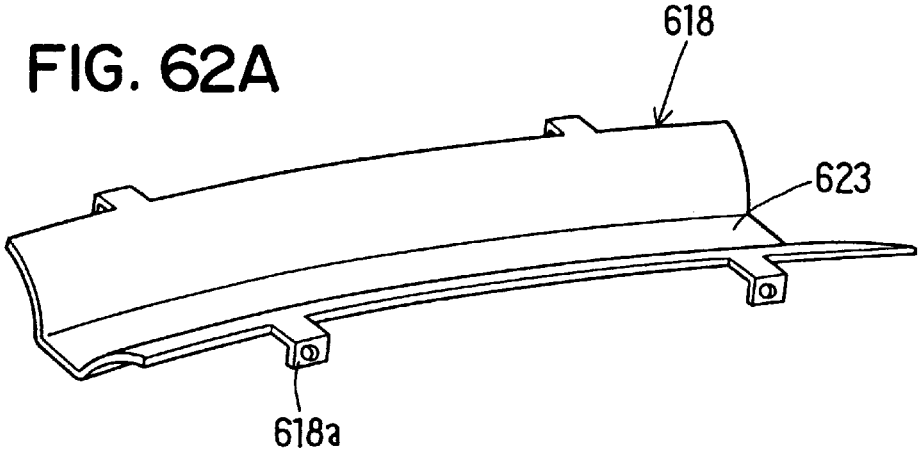
FIG. 62A is a perspective view of a refrigerant control plate.
Figure 62B:
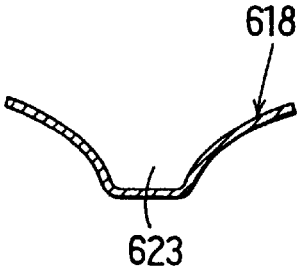
FIG. 62B is a sectional view of the refrigerant control plate.
Figure 63A:
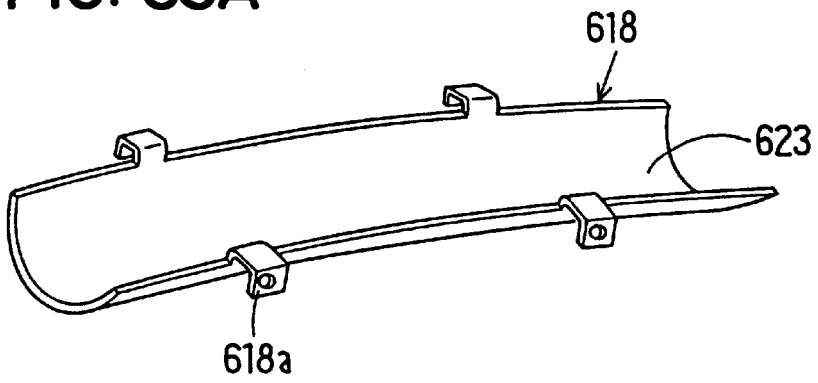
FIG. 63A is a perspective view of a refrigerant control plate.
Figure 63B:
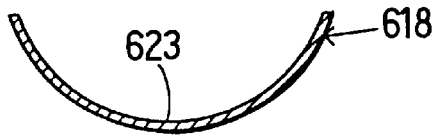
FIG. 63B is a sectional view of the refrigerant control plate.
Figure 64A:
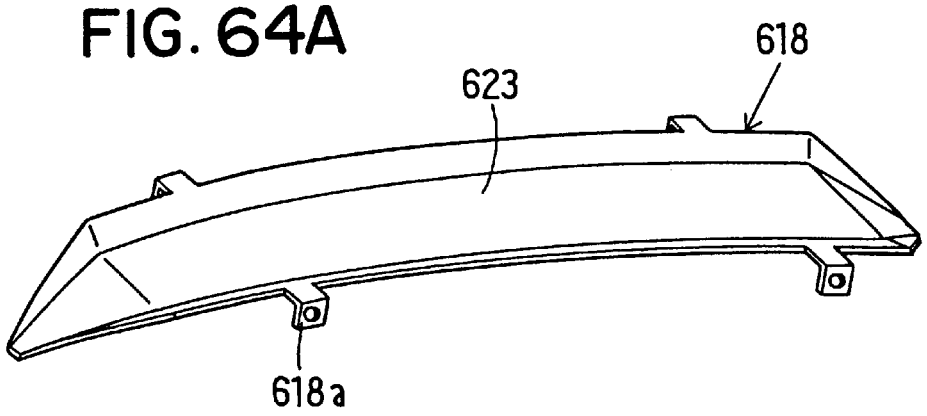
FIG. 64A is a perspective view of a refrigerant control plate.
Figure 64B:
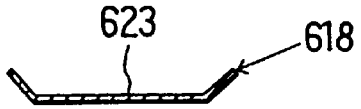
FIG. 64B is a sectional view of the refrigerant control plate.
Figure 65A:
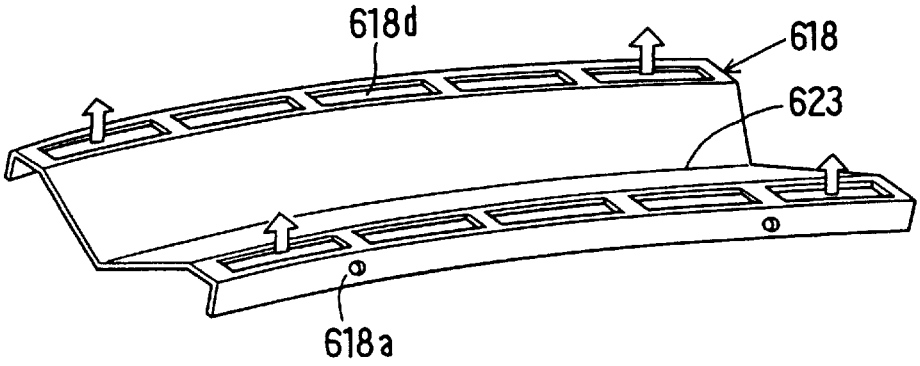
FIG. 65A is a perspective view of a refrigerant control plate.
Figure 65B:
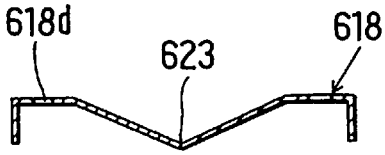
FIG. 65B is a sectional view of the refrigerant control plate.
Figure 66:
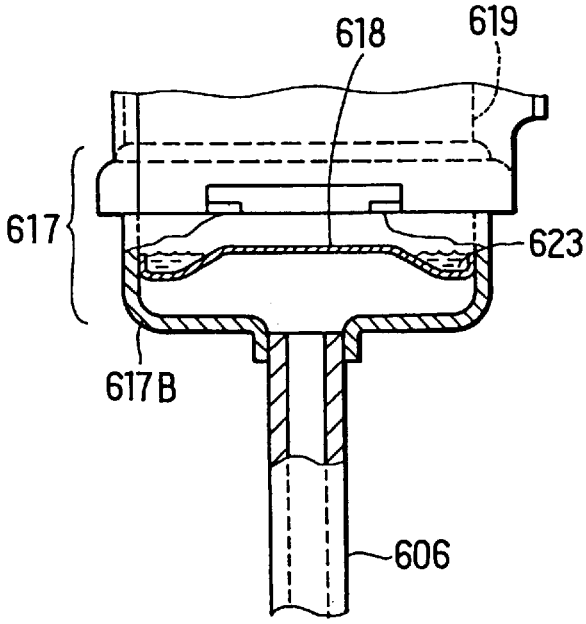
FIG. 66 is a sectional view illustrating inside of a lower tank.

Modifications of the refrigerant control plate 618 will be explained hereinafter.

a) A refrigerant control plate 618 shown in FIGS. 60A–60B is provided with end plates 18*b* extending to lower direction at both ends of the refrigerant control plate 618, and secures gaps between a bottom end of the end plate 618*b* and a top end of the fourth partition walls 615 to flow out the vapor refrigerant. In this case, the condensed refrigerant having flown along the condensed refrigerant passage 623 of the refrigerant control plate 618 can be precisely guided to the liquid inlet 622 along the end plates 618*b*.

b) A refrigerant control plate 618 shown in FIGS. 61A–61B forms the condensed refrigerant passage 623 by denting the center portion in the back-and-forth direction in a ditch shape.

c) A refrigerant control plate 618 shown in FIGS. 62A–62B forms the condensed refrigerant passage 623 by denting the center portion in the back-and-forth direction with a predetermined width.

d) A refrigerant control plate 618 shown in FIGS. 63A–63B forms the condensed refrigerant passage 623 by curving its whole shape in a circle-arc shape.

e) A refrigerant control plate 618 shown in FIGS. 64A–64B forms the condensed refrigerant passage 623 broader and the width of the condensed refrigerant passage 623 gradually narrows toward both sides in the transverse direction. Therefore, the condensed refrigerant having flown from the condensed refrigerant passage 623 can easily flow into the liquid inlet 622.

f) A refrigerant control plate 618 shown in FIGS. 65A–65B is provided with openings 618*d* at both sides in the back-and-forth direction to flow the vapor.

g) A refrigerant control plate 618 shown in FIG. 66 forms the condensed refrigerant passage 623 by lowering the both side in the back-and-forth direction than the center portion.

[Twenty-first Embodiment]

Figure 67A:
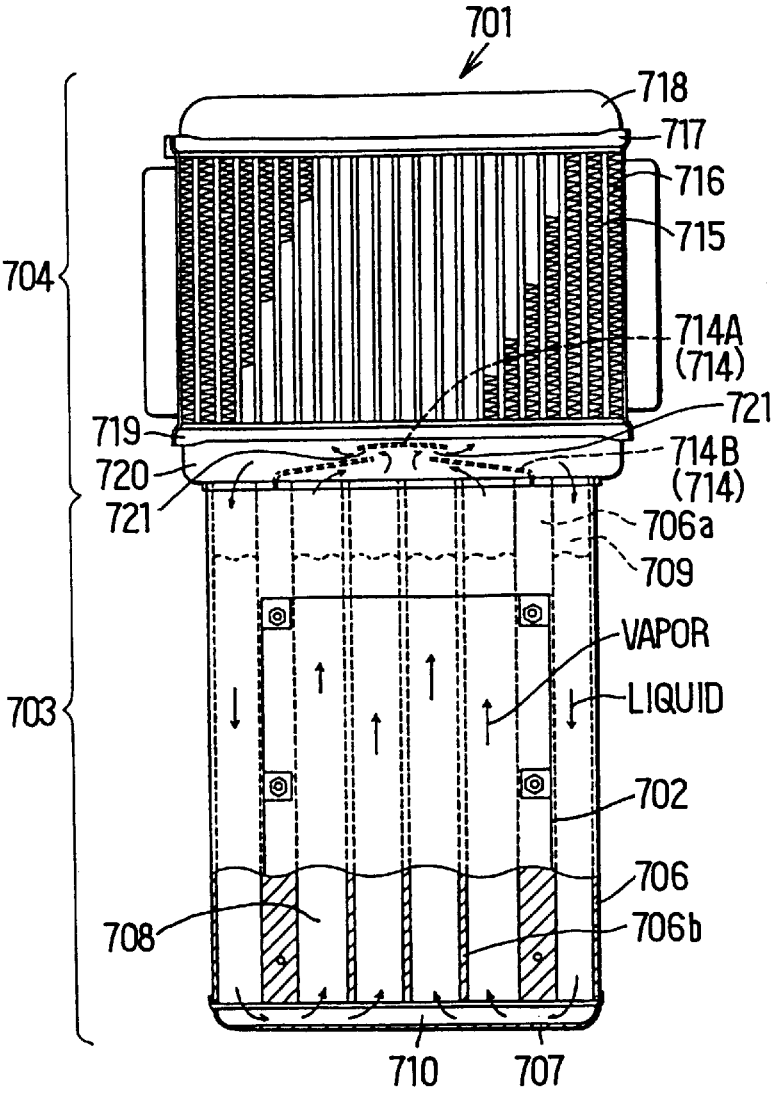
FIG. 67A is a plan view of a cooling apparatus (Twenty-first Embodiment)
Figure 67B:
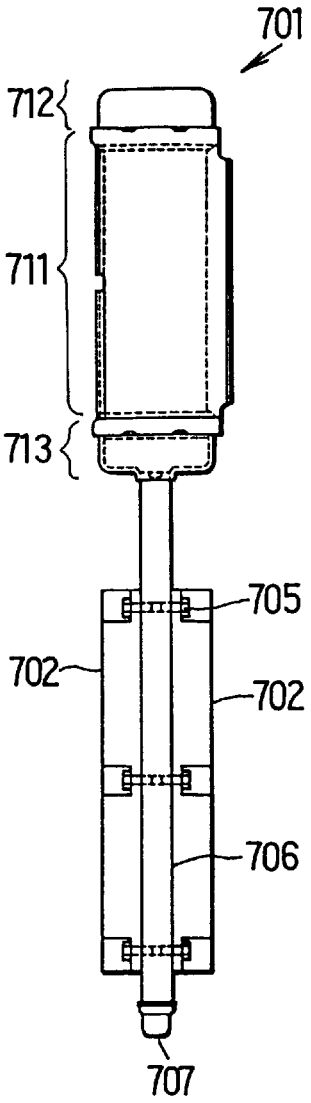
FIG. 67B is a side view of the cooling apparatus.

FIG. 67A is a plan view of a cooling apparatus 701 and FIG. 67B is a side view of the cooling apparatus 701.

The cooling apparatus 701 cools a heating body 702 by making use of the boiling and condensing actions of a refrigerant and is provided with a refrigerant tank 703 for reserving the refrigerant therein, and a radiator 704 disposed over the refrigerant tank 703.

The heating body 702 is an IGBT module constructing an inverter circuit of an electric vehicle, for example, and is fixed in close contact with the two side surfaces of the refrigerant tank 703 by fastening bolts 705.

The refrigerant tank 703 includes a hollow tank 706 made of a metallic material having an excellent thermal conductivity such as aluminum, and an end tank 707 covering the lower end portion of the hollow tank 706, and is provided therein with refrigerant chambers 708, liquid returning passages 709 and a circulating passage 710.

The hollow tank 706 is formed of an extruding molding, for example, into a thin flattened shape having a smaller thickness (i.e., a transverse size of FIG. 67B) than the width (i.e., a transverse size of FIG. 67A). The tank is provided therein with a pair of supporting members 6a and a plurality of partition walls 706*b* extending in the extruding direction (or in the vertical direction of FIG. 67A). Here in the pair of supporting members 706*a*, there are formed threaded holes for fastening the bolts 705.

Figure 68A:
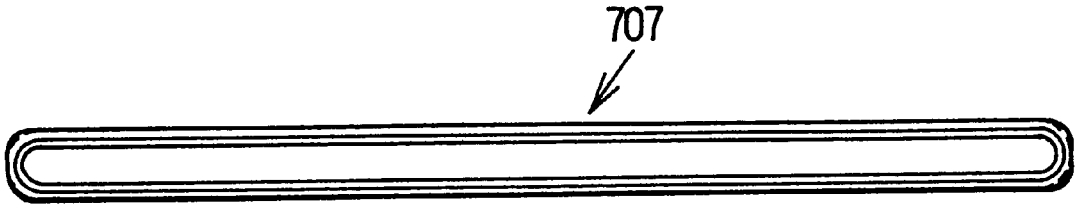
FIGS. 68A–68C are diagrams illustrating an end tank.
Figure 68B:
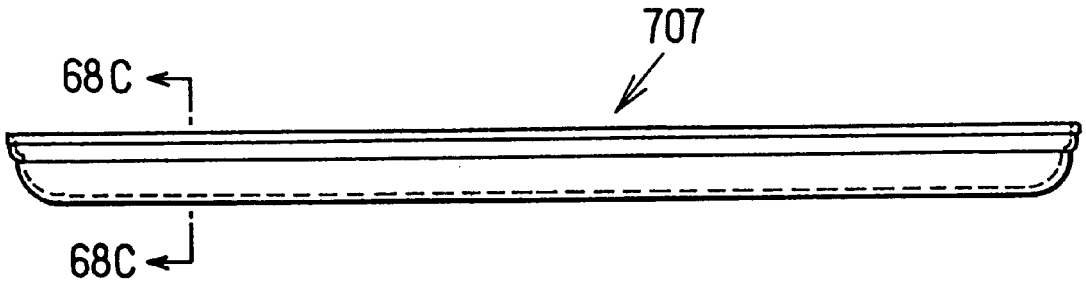
Figure 68C:
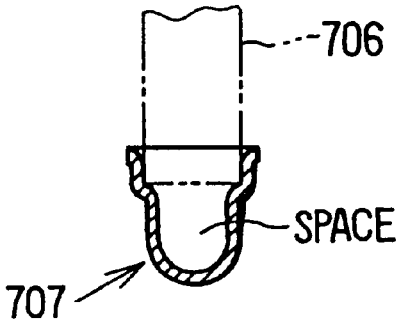

The end tank 707 is made of an aluminum, for example, like the hollow tank 706 and has such a shape as is shown in FIGS. 68A–68C. Here, FIG. 68A is a top plan view; FIG. 68B is a side view; and FIG. 68C is a sectional view taken along line 68C–68C in FIG. 68A. This end tank 707 is joined to the lower end portion of the hollow tank 706 by a soldering method or the like to plug the lower end side of the hollow tank 706. However, a space is retained between the inner side of the end tank 707 and the lower end face of the hollow tank 706, as shown in FIG. 68C.

The refrigerant chambers 708 are formed between the pair of supporting members 706*a* which are disposed close to the two left and right sides of the hollow tank 706 and are partitioned therein into a plurality of passages by the plurality of partition walls 706*b*. These refrigerant chambers 708 form boiling regions in which the refrigerant reserved therein is boiled by the heat of the heating body 702.

The liquid returning passages 709 are passages into which the condensed liquid condensed in the radiator 704 flows and which are formed on the outer sides of the two supporting members 706*a*.

The circulating passage 710 is a passage for feeding the refrigerant chambers 708 with the condensed liquid having flown into the liquid returning passages 709, and is formed by the inner space of the end tank 707 to provide communication at the lower end portion of the refrigerant tank 703 between the passages 709 and the refrigerant chambers 708.

The radiator 704 is composed of a core portion 711, an upper tank 712 and a lower tank 713, and a refrigerant control plate 714 is disposed in the lower tank 713.

The core portion 711 is the radiating portion of the present invention for condensing and liquefying the vaporized refrigerant, as boiled by the heat of the heating body 702, by the heat exchange with an external fluid (such as air). The core portion 711 is constructed by arranging a plurality of radiating tubes 715 and radiating fins 716 alternately and is used with the individual radiating tubes 715 being upright.

The radiating tubes 715 use flat tubes made of aluminum, for example. The not-shown inner fins may be inserted into the radiating tubes 715.

The radiating fins 716 are the corrugated fins, which are formed by folding a thin metal sheet (e.g., an aluminum sheet) having an excellent thermal conductivity alternately into the corrugated shape, and are joined to the outer wall faces of the radiating tubes 715 by a soldering method or the like.

Figure 69A:
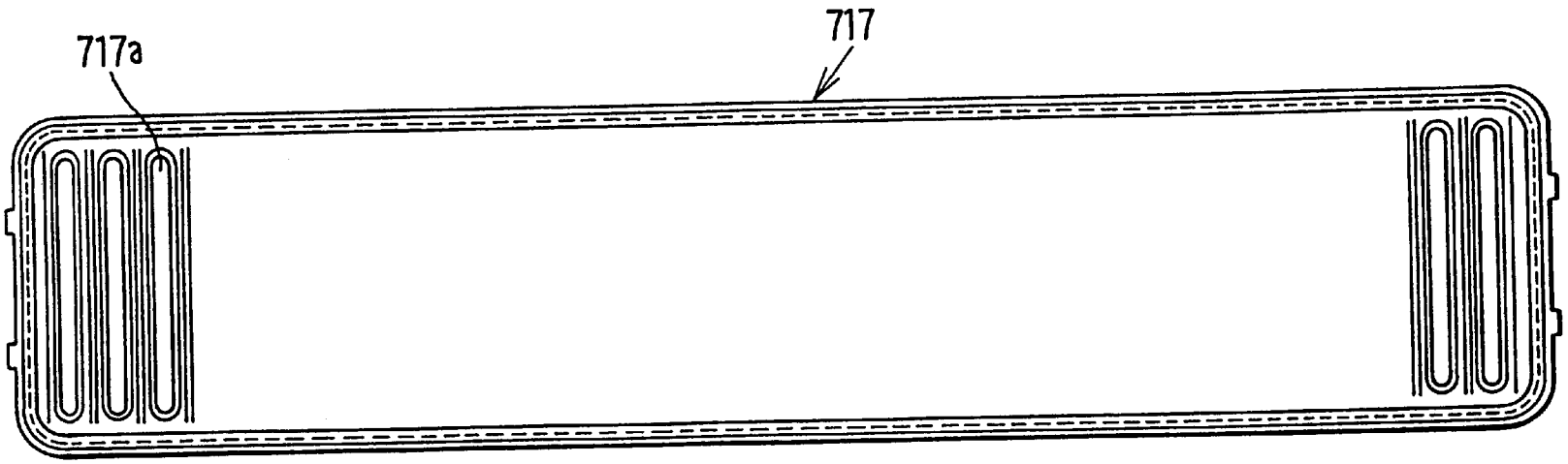
FIGS. 69A–69B are diagrams illustrating a core plate of an upper tank.
Figure 69B:
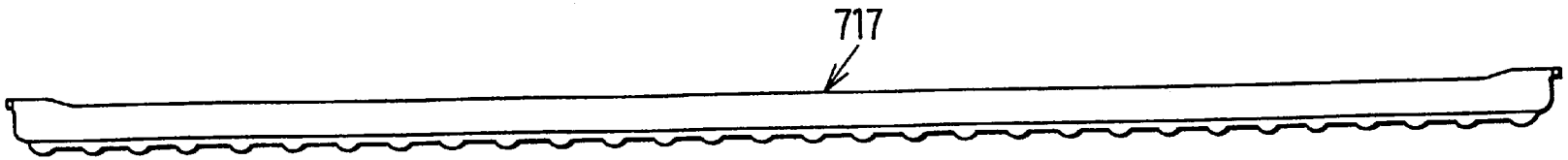
Figure 70A:
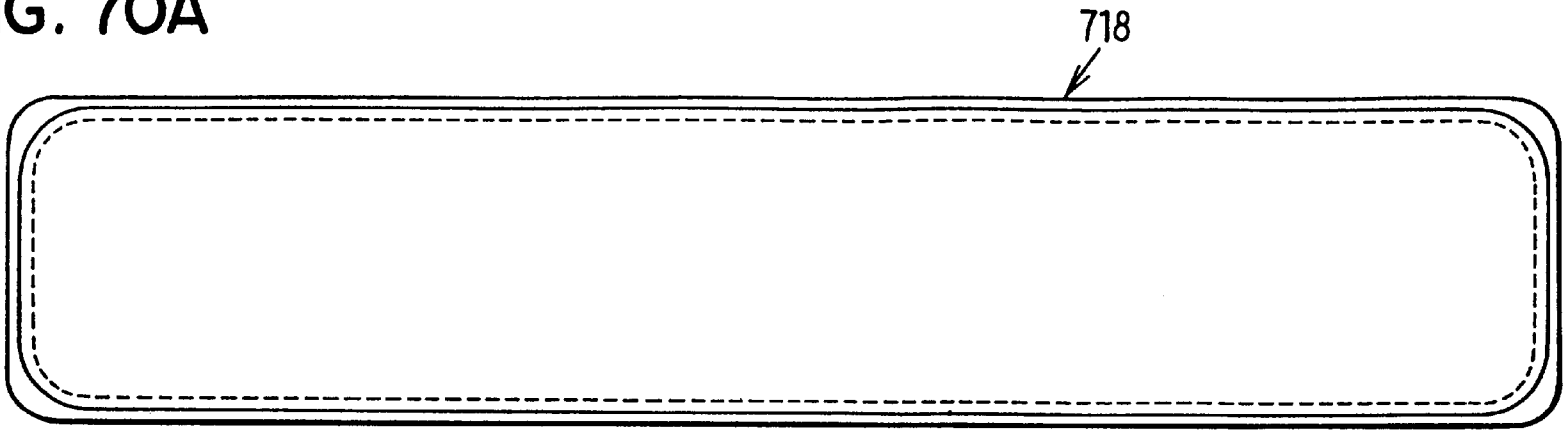
FIGS. 70A–70C are diagrams illustrating a tank plate of an upper tank.
Figure 70B:
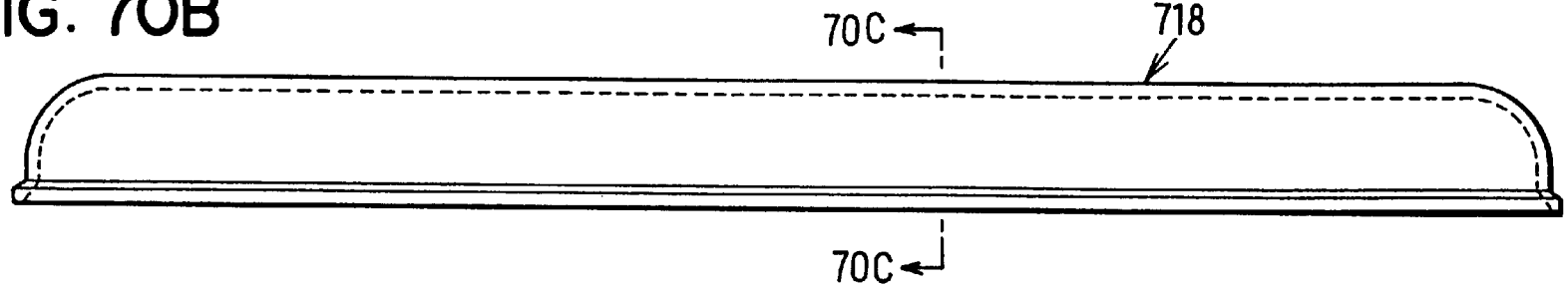
Figure 70C:
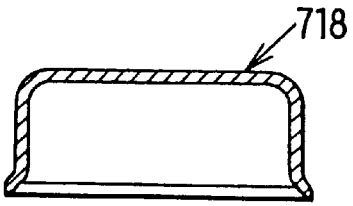

The upper tank 712 is constructed by combining a core plate 717 and a tank plate 718 made of aluminum, for example, and is connected to the upper end portions of the individual radiating tubes 715. The shape of the core plate 717 is shown in FIGS. 69A, 69B, and the shape of the tank plate 718 is shown in FIGS. 70A–70C. Here, FIG. 69A is a top plan view, and FIG. 69B is a side view. FIG. 70A is a top plan view, FIG. 70B is a side view, and FIG. 70C is a sectional view taken along line 70C–70C in FIG. 70A. In the core plate 717, there are formed a number of slots 717*a* into which the end portions of the radiating tubes 715 are inserted.

Figure 71A:
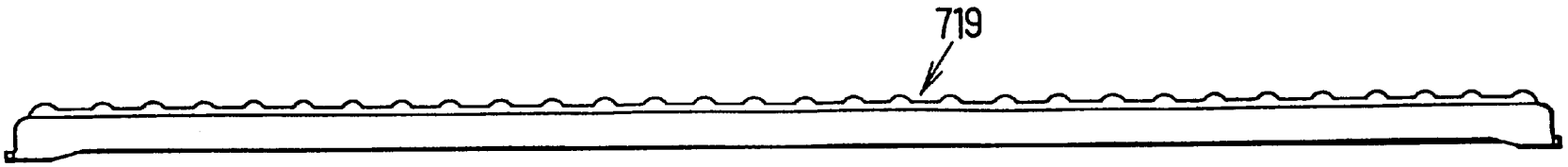
FIGS. 71A–71B are diagrams illustrating a core plate of a lower tank.
Figure 71B:
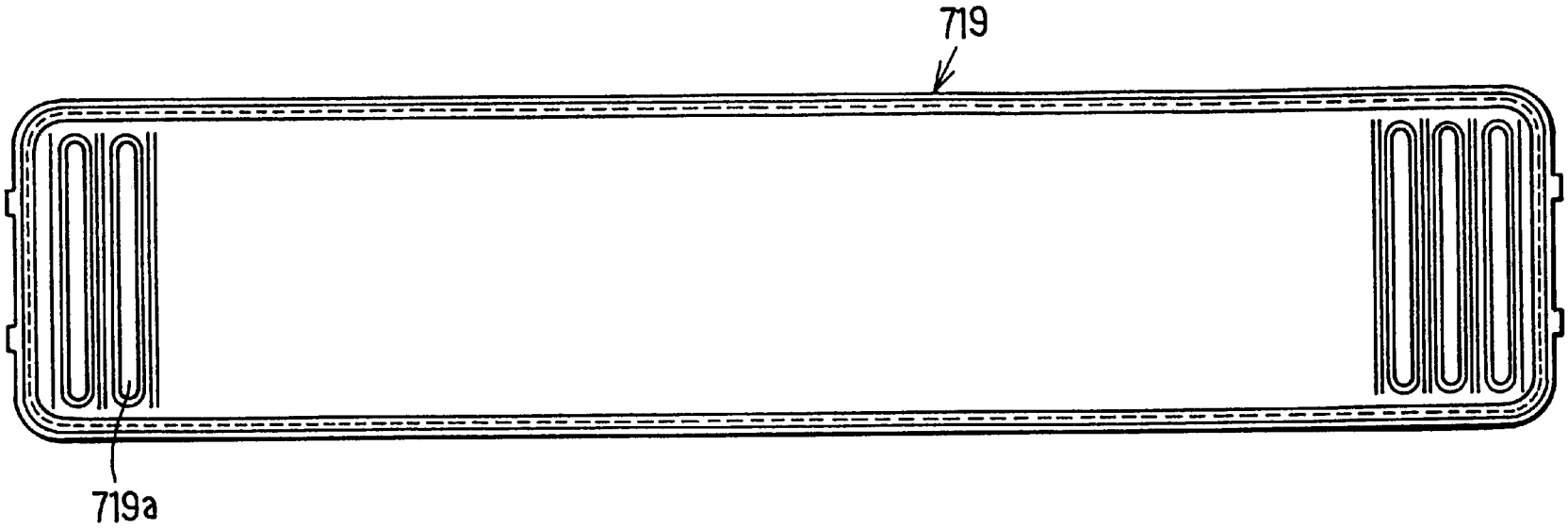
Figure 72A:
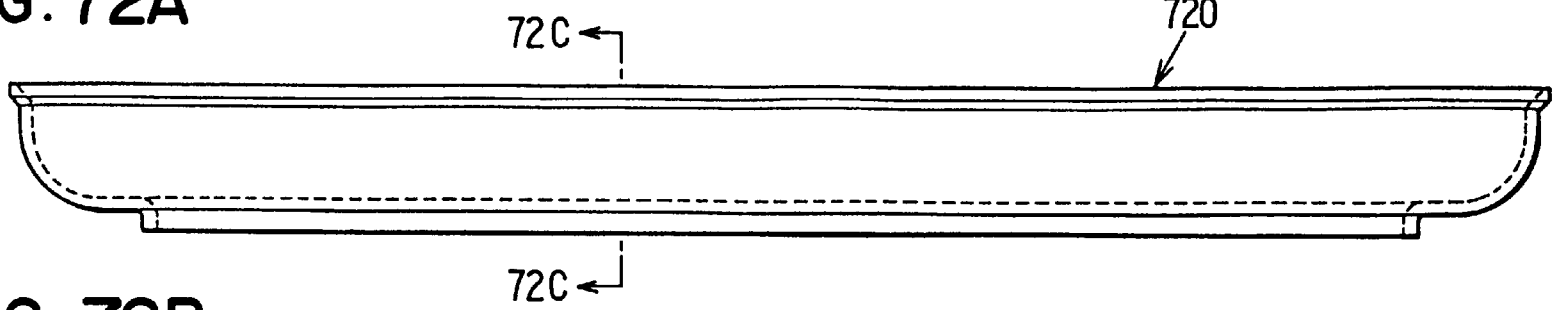
FIGS. 72A–72C are diagrams illustrating a tank plate of a lower tank.
Figure 72B:
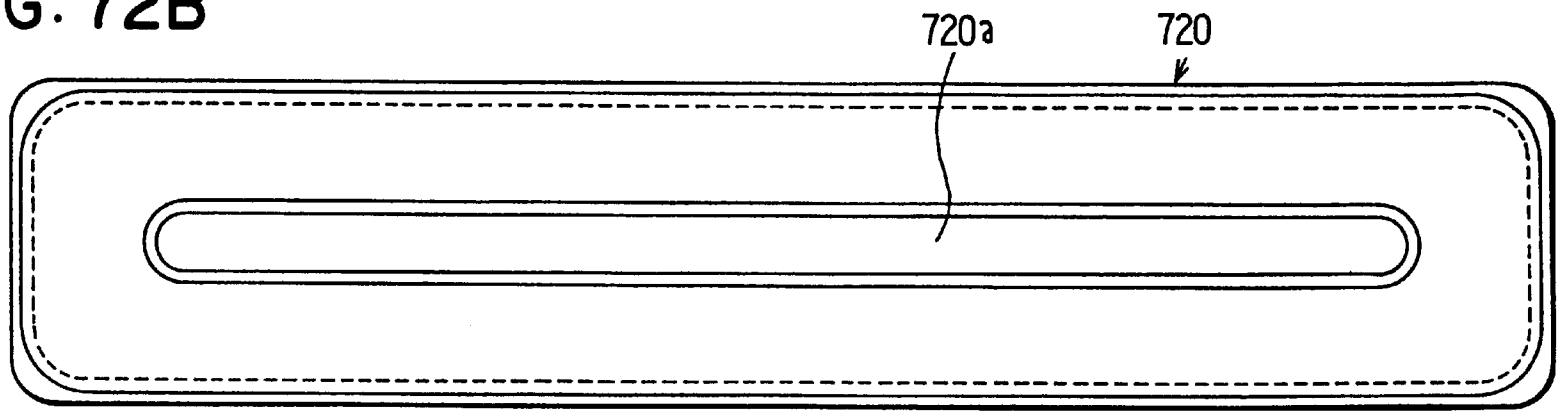
Figure 72C:
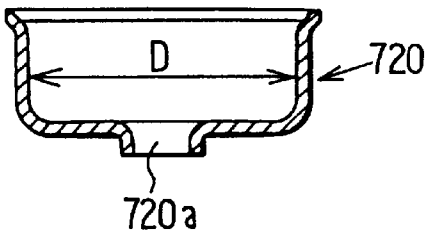

The lower tank 713 is constructed by combining a core plate 719 and a tank plate 720 made of aluminum, for example, and is connected to the lower end portions of the individual radiating tubes 715. The shape of the core plate 719 is shown in FIGS. 71A, 71B. Here, FIG. 71A is a side view, and FIG. 71B is a top plan view. The shape of the tank plate 720 is shown FIGS. 72A–72C. Here, FIG. 72A is a side view, FIG. 72B is a bottom view, and FIG. 72C is a sectional view taken along line 72C–72C in FIG. 72A. Here, the core plate 719 has a shape identical to that of the core plate 717 of the upper tank 712 and has a number of slots 719*a* formed therein for receiving the end portions of the radiating tubes 715. In the tank plate 720, on the other hand, there is formed a slot 720*a* for receiving the upper end portion of the refrigerant tank 703 (or the hollow tank 706).

The refrigerant control plate 714 prevents the interference in the refrigerant chambers 708 between the vaporized refrigerant and the condensed liquid and is composed of a first refrigerant control plate 714A and one pair of second refrigerant control plates 714B.

Figure 73A:
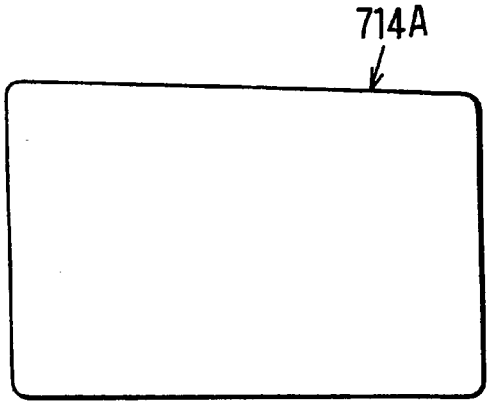
FIGS. 73A–73C are diagrams illustrating a first refrigerant control plate.
Figure 73C:
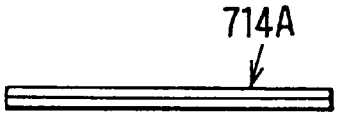
Figure 73B:
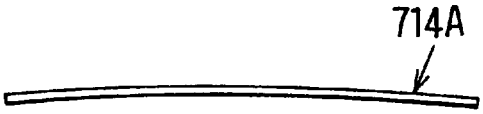

The first refrigerant control plate 714A is disposed in the upper side of the lower tank 713 and at the generally central portion of the longitudinal direction of the tank and covers over the refrigerant chambers 708 partially (e.g., one third or more of their width). This first refrigerant control plate 714A is arranged entirely of the width D in the lower tank 713, as shown in FIG. 72C, and is joined to the inner wall face of the tank plate 720 by a soldering method or the like. Here, the first refrigerant control plate 714A may be gently curved to allow the condensed liquid having dripped on its upper face to flow easily. The shape of this first refrigerant flow control plate 714A is shown in FIGS. 73A–73C. Here, FIG. 73A is a top plan view, FIG. 73B is a side view, and FIG. 73C is a plan view.

Figure 74A:
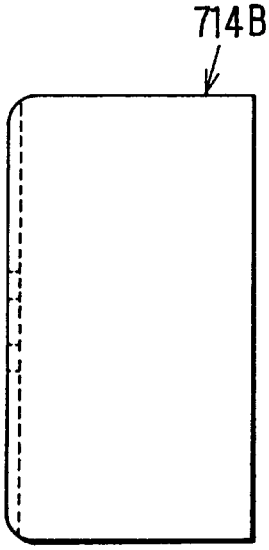
FIGS. 74A–74C are diagrams illustrating a second refrigerant control plate.
Figure 74C:
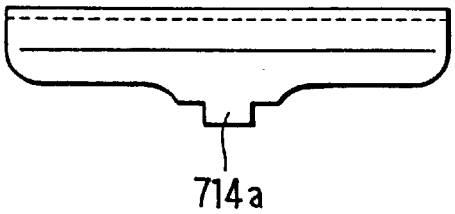
Figure 74B:
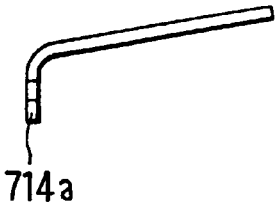

The pair of second refrigerant control plates 714B are arranged at a lower position than that of the first refrigerant control plate 714A on the two sides of the first refrigerant control plate 714A, and covers all over the refrigerant chambers 708 together with the first refrigerant control plate 714A. The second refrigerant control plates 714B are arranged like the first refrigerant control plate 714A all over the width D in the lower tank 713, as shown in FIG. 72C, and are joined to the inner wall faces of the tank plate 720. Moreover, the second refrigerant control plates 714B are supported on the supporting members 706*a* by inserting protrusions 714*a*, as protruded from the central portions of their lower end faces, into the slits which are formed in the upper end faces of the supporting members 706*a* of the hollow tank 706. On the other hand, the second refrigerant control plates 714B are mounted in an inclined state so that the condensed liquid having dripped onto their upper faces may easily flow to the liquid returning passages 709. The shape of these second refrigerant control plates 714B is shown in FIGS. 74A–74C. Here, FIG. 74A is a top plan view, FIG. 74B is a side view, and FIG. 74C is a plan view.

The first refrigerant control plate 714A and the second refrigerant control plates 714B are arranged with their individual end portions vertically overlapping each other, as shown in FIG. 67, to retain spaces, as formed between the vertically confronting end portions, for vapor outlets 721.

Next, the operations of this embodiment will be described.

The heat, as generated from the heating body 702, is transferred through the wall faces of the refrigerant tank 703 (or the hollow tank 706) to the refrigerant reserved in the refrigerant chambers 708, to boil the refrigerant. The refrigerant thus boiled rises as a vapor in the refrigerant chambers 708 and flows from the refrigerant chambers 708 into the lower tank 713. After this, the vaporized refrigerant flows in the lower tank 713 via the vapor outlets 721, which are formed by the first refrigerant control plate 714A and the second refrigerant control plates 714B, into the individual radiating tubes 715 of the core portion 711. The vaporized refrigerant having flown into the radiating tubes 715 is cooled, while flowing in the radiating tubes 715, by the heat exchange with the ambient air so that it is condensed, while releasing its latent heat, on the inner wall faces of the radiating tubes 715. The latent heat, as released when the vaporized refrigerant is condensed, is transferred from the wall faces of the individual radiating tubes 715 to the radiating fins 716, through which it is released to the ambient air.

On the other hand, the condensed liquid, as condensed in the radiating tubes 715 into droplets, flows downward along the inner wall faces of the radiating tubes 715. A part of the condensed liquid drips from the radiating tubes 715 directly into the liquid returning passages 709 of the refrigerant tank 703, whereas the remainder of the condensed liquid drips on the upper faces of the first refrigerant control plate 714A and the second refrigerant control plates 714B in the lower tank 713 until it flows on the upper faces of the individual control plates 714A and 14B into the liquid returning passages 709. The refrigerant in the liquid returning passages 709 is fed to the refrigerant chambers 708 via the circulating passage 710 which is formed in the end tank 707.

(Effects of the Twenty-first Embodiment)

According to the cooling apparatus 701 of this embodiment, the condensed liquid having dripped from the radiating tubes 715 can be led to the liquid returning passages 709 by the first refrigerant control plate 714A and the pair of second refrigerant control plates 714B covering all over the refrigerant chambers 708. By forming the spaces, which are formed between the vertically confronting end portions of the first refrigerant control plate 714A and the second refrigerant control plates 714B, into the vapor outlets 721, the condensed liquid having dripped from the radiating tubes 715 can be prevented from flowing via the vapor outlets 721 into the refrigerant chambers 708. Since the second refrigerant control plates 714B are disposed in the inclined state, moreover, the condensed liquid having dripped onto the upper faces of the second refrigerant control plates 714B does not flow on the upper faces of the second refrigerant control plates 714B to the vapor outlets 721. As a result, the condensed liquid can be prevented from flowing via the vapor outlets 721 into the refrigerant chambers 708 so that the interference in the refrigerant chambers 708 between the vaporized refrigerant and the condensed liquid can be prevented to circulate the refrigerant satisfactorily in the refrigerant tank 703.

On the other hand, the vaporized refrigerant, as boiled in the refrigerant chambers 708, is dispersed while flowing out from the vapor outlets 721 on the two sides, so that the vapor diffusion in the core portion 711 can be homogenized to improve the radiation performance.

[Twenty-second Embodiment]

Figure 75:
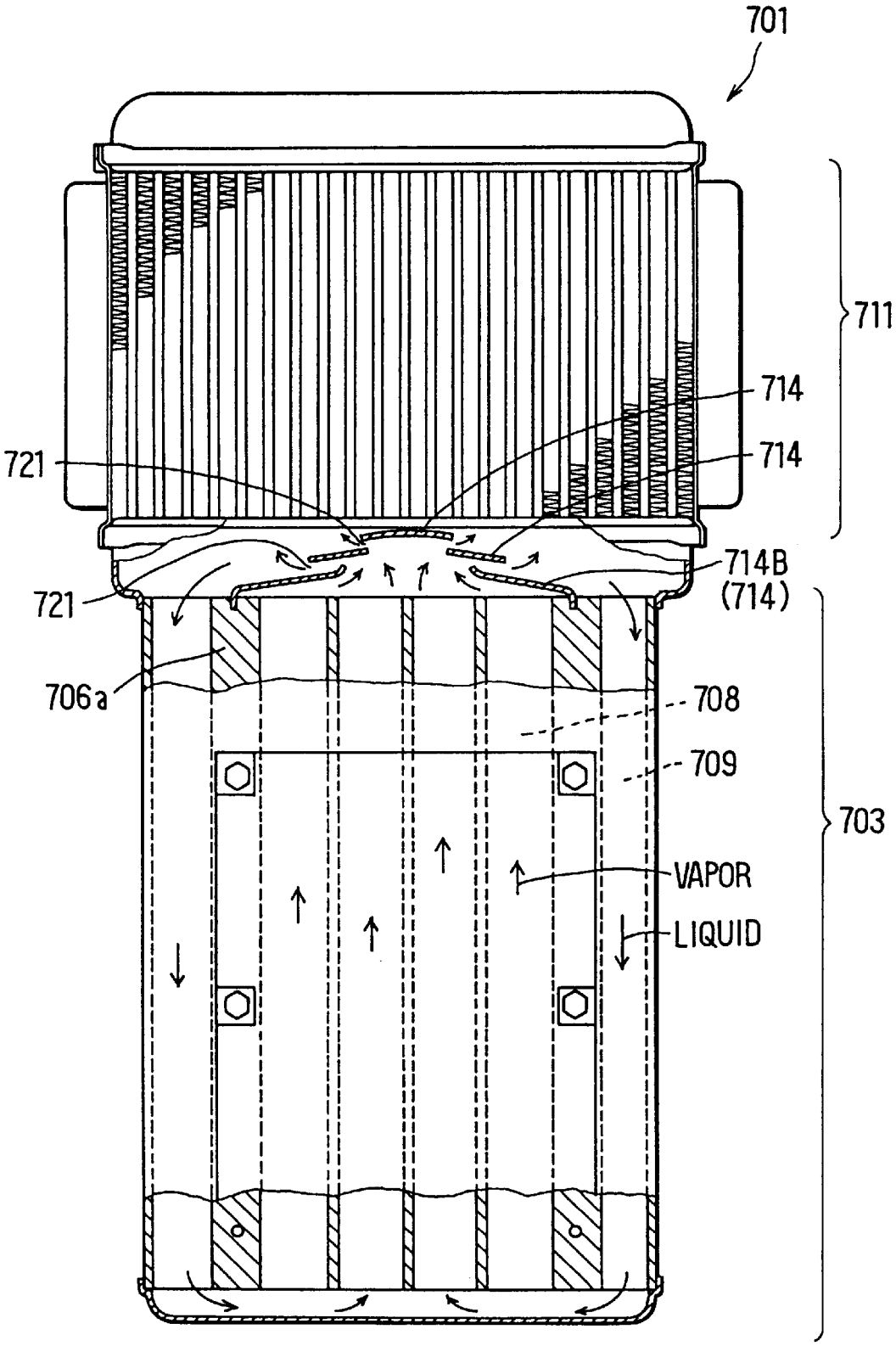
FIG. 75 is a plan view of a cooling apparatus (Twenty-second Embodiment)

FIG. 75 is a plan view of a cooling apparatus 701.

The cooling apparatus 701 of this embodiment shows one example in which refrigerant control plates 714 are arranged at three stages, as shown in FIG. 75. In this case, too, the condensed liquid can be prevented as in the Twenty-first Embodiment from flowing via the vapor outlets 721 into the refrigerant chambers 708, so that the interference in the refrigerant chambers 708 between the vaporized refrigerant and the condensed liquid can be prevented to circulate the refrigerant satisfactorily in the refrigerant tank 703. Since the refrigerant control plates 714 are arranged at the three stages, the number of vapor outlets 721 can be made more than that of the Twenty-first Embodiment. As a result, the vaporized refrigerant can be dispersed so that the vapor dispersion in the core portion 711 can be more homogenized to realize a better improvement in the radiation performance.

Figure 76A:
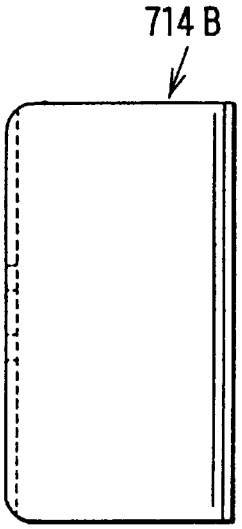
FIGS. 76A–76C are diagrams illustrating a refrigerant control plate.
Figure 76C:
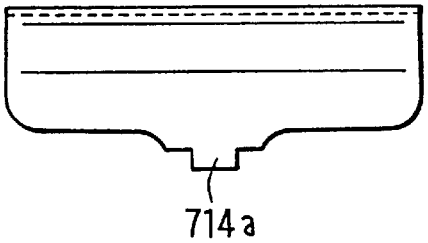
Figure 76B:
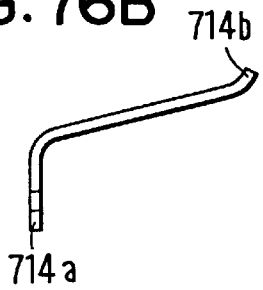
Figure 81:
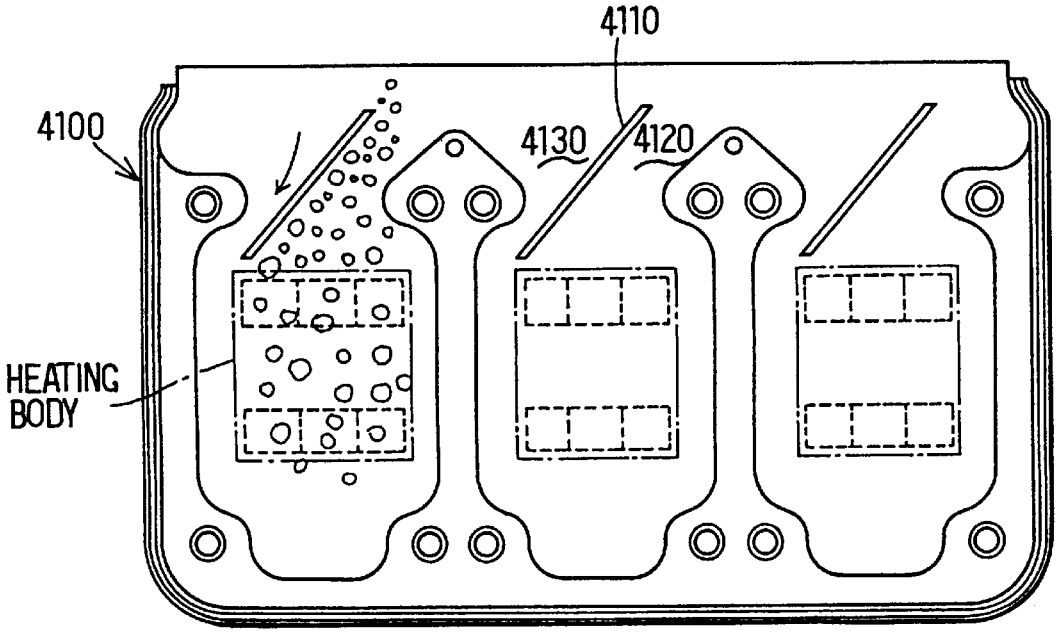
FIG. 81 PRIOR ART
FIG. 81 is a diagram illustrating an internal structure of a conventional refrigerant tank.

By bending the upper end portions 714*b* (as referred to FIGS. 76A–76C) of the refrigerant control plates 714B, as supported by the supporting members 706*a* of the hollow tank 706, upward, moreover, the flow direction of the vaporized refrigerant having flown along the refrigerant control plates 714B can be gently changed. As a result, the vaporized refrigerant becomes likely to flow toward the vapor outlets 721 so that the pressure loss resulting from the circulation of the vapor flow can be reduced to improve the radiation performance. The shape of the refrigerant control plates 714B is shown in FIGS. 76A–76C. Here, FIG. 76A is a top plan view, FIG. 76B is a side view, and FIG. 76C is a plan view.

Here in this embodiment, the refrigerant control plates 714 are arranged at the three stages but may be arranged at four or more stages, if possible.

[Twenty-third Embodiment]

Figure 77A:
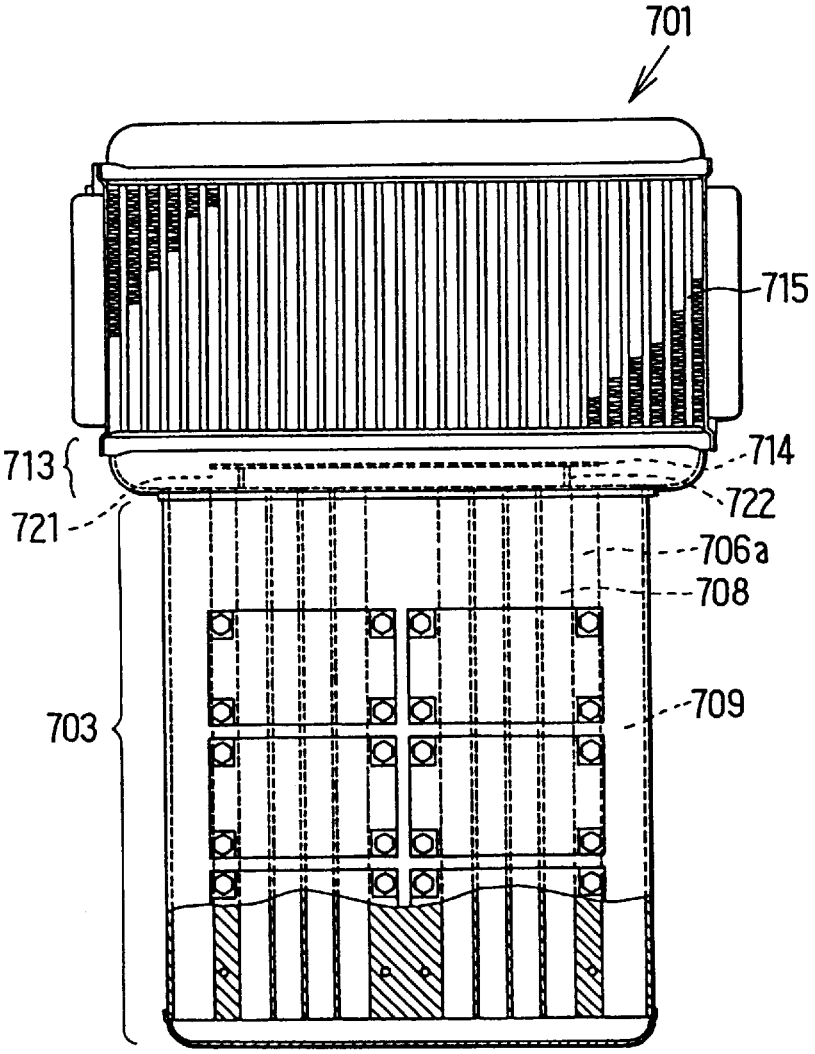
FIG. 77A is a plan view of a cooling apparatus (Twenty-third Embodiment)
Figure 77B:
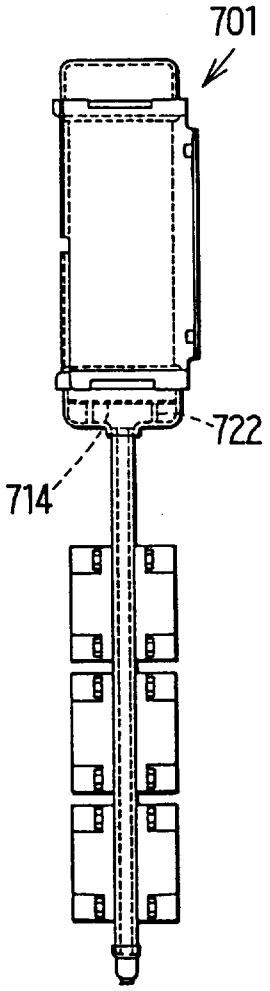
FIG. 77B is a side view of the cooling apparatus.

FIG. 77A is a plan view of a cooling apparatus 701, and FIG. 77B is a side view.

Figure 78A:
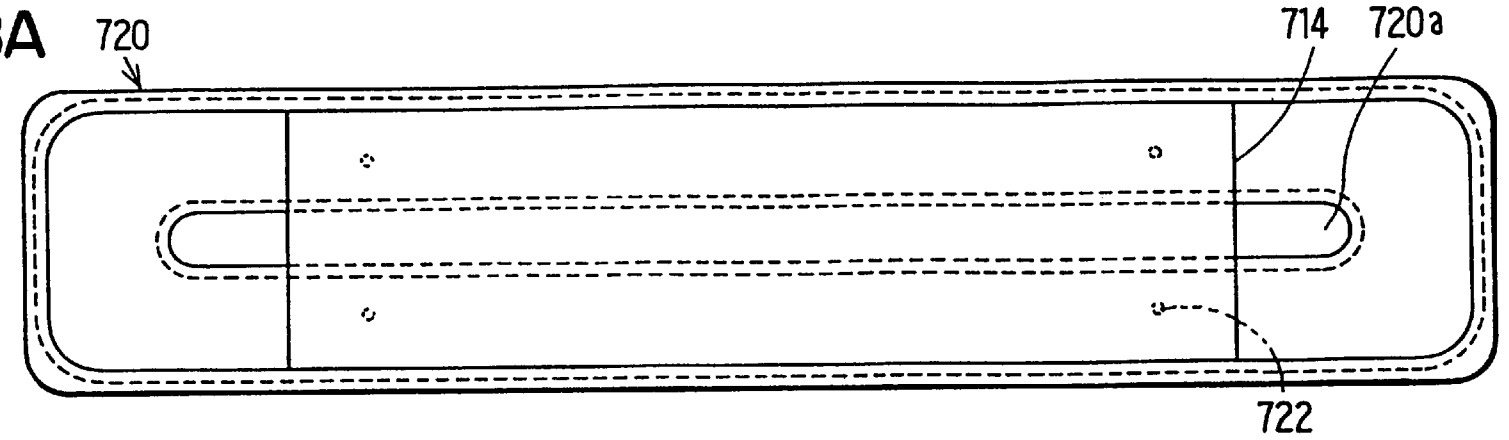
FIGS. 78A–78C are diagrams illustrating a lower tank plate in which a refrigerant control plate is arranged.
Figure 78B:
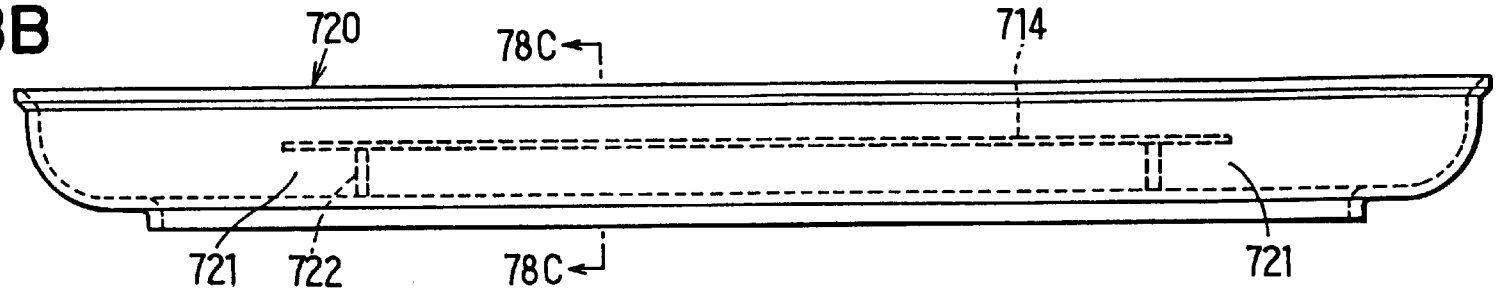
Figure 78C:
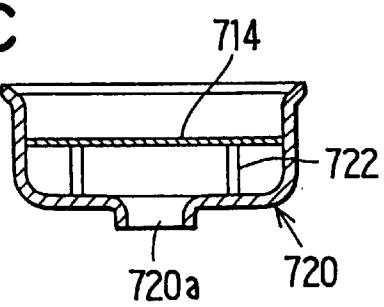

The cooling apparatus 701 of this embodiment is exemplified by arranging one refrigerant control plate 714, as shown in FIGS. 77A, 77B. This refrigerant control plate 714 is given such a length as to cover all over the refrigerant chambers 708 (or as to hide the supporting members 706*a* preferably, as viewed from above the refrigerant control plate), and is supported at a substantially intermediate level of the lower tank 713 by four supports 722, as shown in FIGS. 78A–78C. Here, FIG. 78A is a top plan view, FIG. 78B is a side view, and FIG. 78C is a sectional view 78C–78C in FIG. 78A.

In this construction, the vapor outlets 721 are formed below the two ends of the refrigerant control plate 714, and the liquid returning passages 709 are formed on the outer sides of the vapor outlets 721. As a result, the condensed liquid having dripped from the radiating tubes 715 flows not into the refrigerant chambers 708 via the vapor outlets 721 but into the liquid returning passages 709 so that the interference in the refrigerant chambers 708 between the vaporized refrigerant and the condensed liquid can be prevented to circulate the refrigerant satisfactorily in the refrigerant tank 703.

Figure 79A:
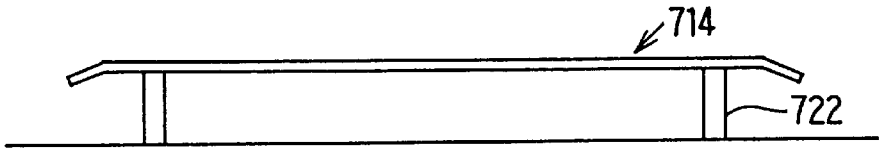
FIGS. 79A–79C are side views of a refrigerant control plate.
Figure 79B:
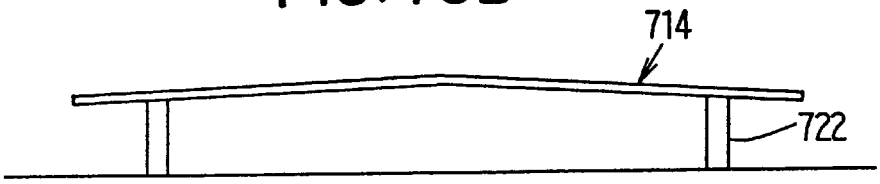
Figure 79C:
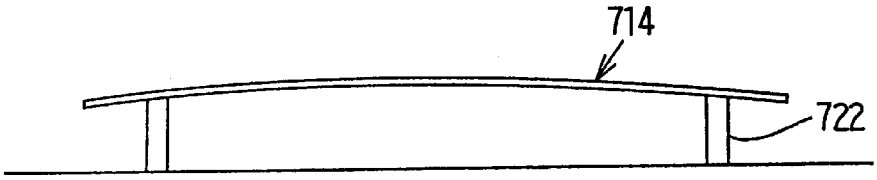
Figure 80:
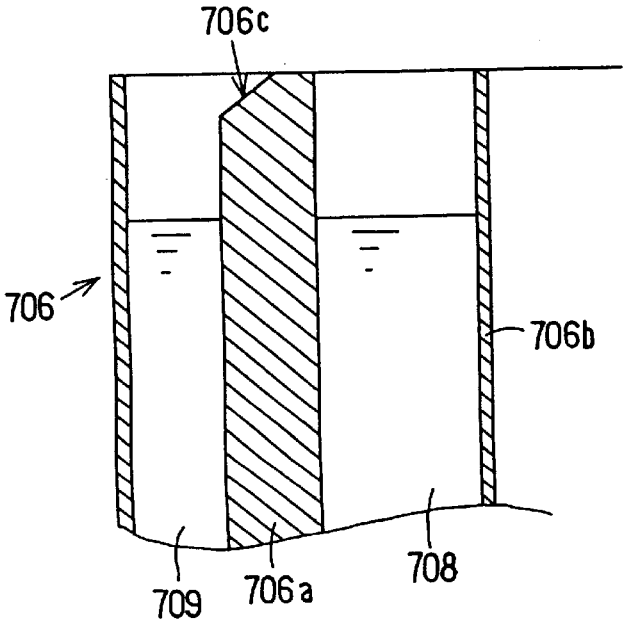
FIG. 80 is a diagram illustrating a shape of a supporting member of a hollow tank.

Here, in order to facilitate the flow of the condensed liquid having dripped onto the upper face of the refrigerant control plate 714 to the liquid returning passages 709, the refrigerant control plate 714 may be shaped, as shown in FIGS. 79A–79C. Alternatively, slopes 6c may be formed on the upper end faces of the supporting members 706*a,* as shown in FIG. 80.

[Twenty-fourth Embodiment]

Figure 82:
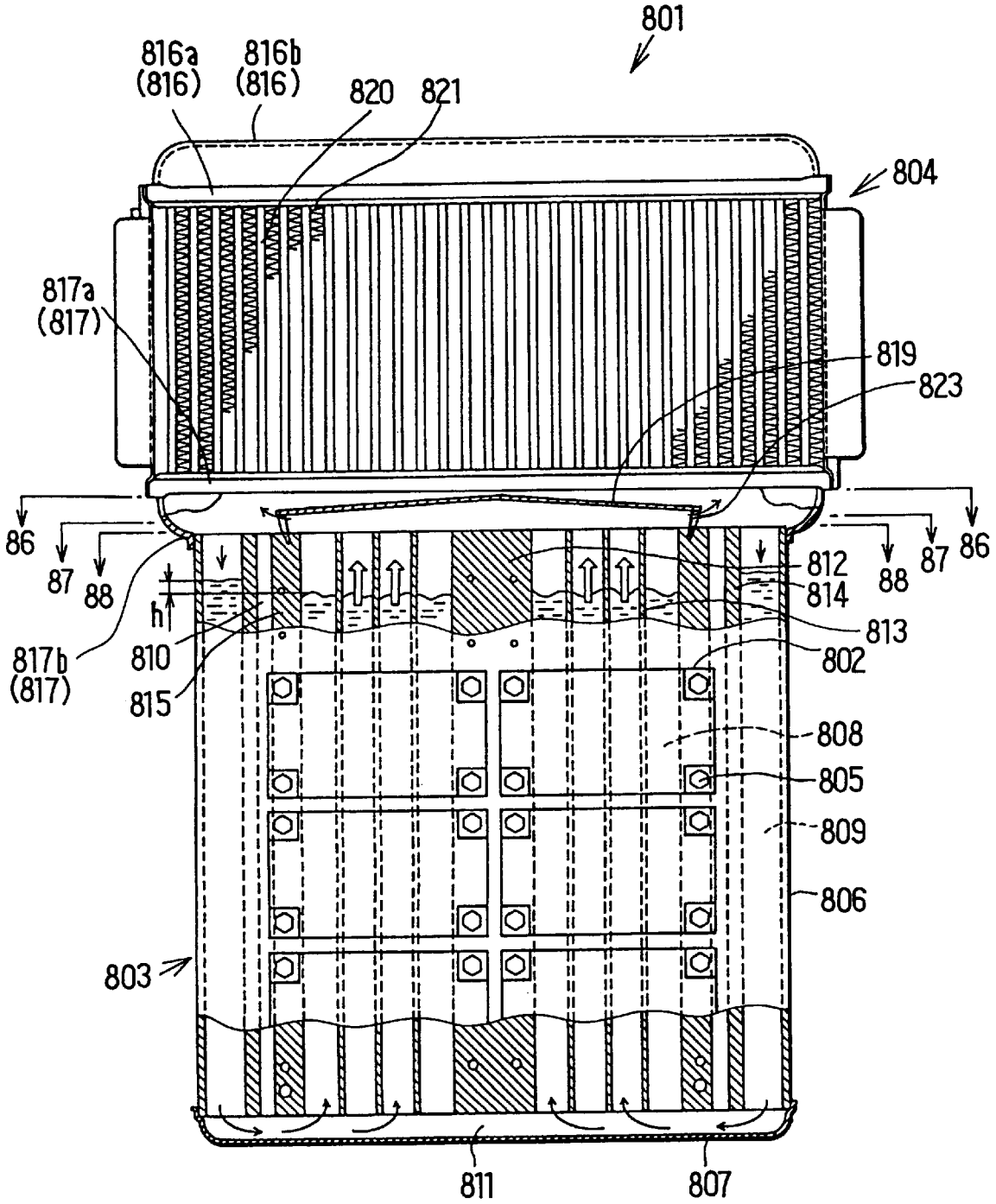
FIG. 82 is a plan view of a cooling apparatus (Twenty-fourth Embodiment)

FIG. 82 is a plan view of a cooling apparatus 801.

The cooling apparatus 801 of this embodiment cools a heating body 802 by making use of the boiling and condensing actions of a refrigerant and is provided with a refrigerant tank 803 for reserving the refrigerant therein, and a radiator 804 disposed over the refrigerant tank 803.

Figure 83:
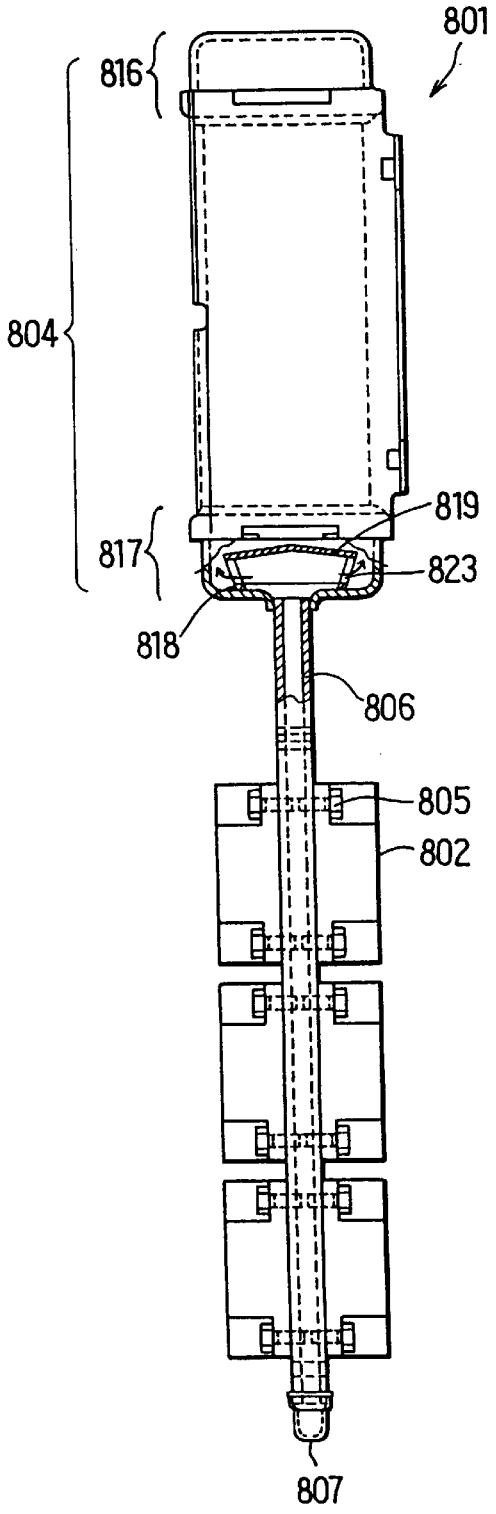
FIG. 83 is a side view of the cooling apparatus.

The heating body 802 is an IGBT module constructing an inverter circuit of an electric vehicle, for example, and is fixed in close contact with the two side surfaces of the refrigerant tank 803 by fastening bolts 805 (as referred to FIG. 83).

The refrigerant tank 803 is includes a hollow member 806 made of a metallic material such as aluminum having an excellent thermal conductivity, and an end tank 807 covering the lower end portion of the hollow member 806, and is provided therein with refrigerant chambers 808, liquid returning passages 809, thermal insulation passages 810 and a circulating passage 811.

The hollow member 806 is formed of an extruding molding, for example, into a thin flattened shape having a smaller thickness (i.e., a transverse size of FIG. 83) than the width (i.e., a transverse size of FIG. 82), and is provided therein with a plurality of passage walls (a first passage wall 812, second passages wall 813, third passage walls 814 and fourth passage walls 815).

Figure 84:
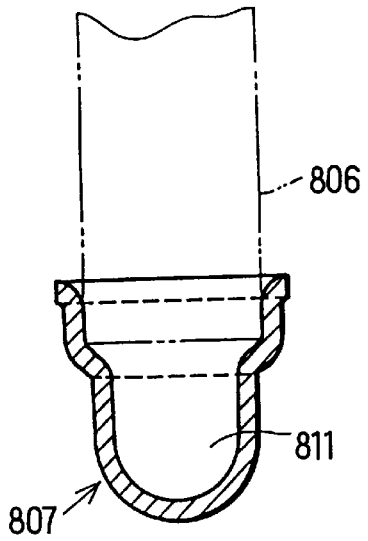
FIG. 84 is a sectional view of an end tank.

The end tank 807 is made of aluminum, for example, like the hollow member 806 and is joined by a soldering method or the like to the lower end portion of the hollow member 806. However, a space is retained between the inner side of the end tank 807 and the lower end face of the hollow member 806, as shown in FIG. 84.

The refrigerant chambers 808 are formed on the two left and right sides of the first passage wall 812 disposed at the central portion of the hollow member 806 and are partitioned therein into a plurality passages by the second passage walls 813. These refrigerant chambers 808 form boiling regions in which the refrigerant reserved therein is boiled by the heat of the heating body 802.

The liquid returning passages 809 are passages into which the condensed liquid condensed in the radiator 804 flows back, and are formed on the two outer sides of the third passage walls 814 disposed on the two left and right sides of the hollow member 806.

The thermal insulation passages 810 are provided for thermal insulation between the refrigerant chambers 808 and the liquid returning passages 809 and are formed between the third passage walls 813 and the fourth passage walls 814.

The circulating passage 811 is a passage for feeding the refrigerant chambers 808 with the condensed liquid having flown into the liquid returning passages 809 and is formed by the inner space (as referred to FIG. 84) of the end tank 807 to provide communication between the liquid returning passages 809, and the refrigerant chambers 808 and the thermal insulation passages 810.

The radiator 804 is composed of a core portion (as will be described in the following), an upper tank 816 and a lower tank 817, and refrigerant flow control plates (composed of a side control plate 818 and an upper control plate 819) is disposed in the lower tank 817.

The core portion is the radiating portion of the invention for condensing and liquefying the vaporized refrigerant, as boiled by the heat of the heating body 802, by the heat exchange with an external fluid (such as air). The core portion is composed of pluralities of radiating tubes 820 juxtaposed vertically and radiating fins 821 interposed between the individual radiating tubes 820. Here, the core portion is cooled by receiving the air flown by a not-shown cooling fan.

Figure 85:
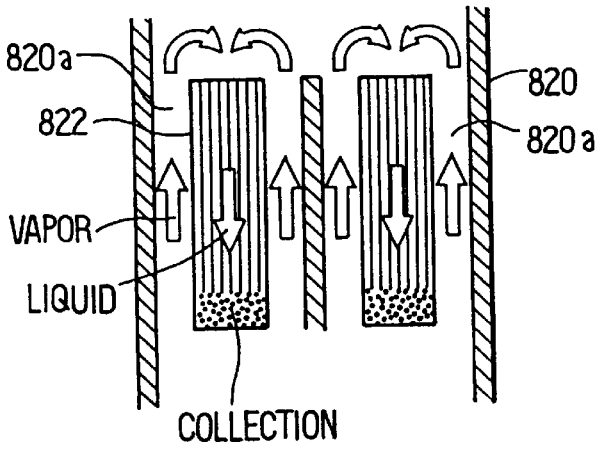
FIG. 85 is a sectional view illustrating an inside of a radiating tube.

The radiating tubes 820 form passages in which the refrigerant flows and are used by cutting flat tubes made of an aluminum, for example, to a predetermined length. Corrugated inner fins 822 may be inserted into the radiating tubes 820, as shown in FIG. 85.

When the inner fins 822 are to be inserted into the radiating tubes 820, they are arranged to extend their crests and valleys in the direction of the passages (or vertical in FIG. 85) of the radiating tubes 820 while leaving gaps 820*a* for coolant passages on the two sides of the inner fins 822.

On the other hand, the inner fins 822 are fixed in the radiating tubes 820 by bringing their folded crest and valley portions into contact with the inner wall faces of the radiating tubes 820 and by joining the contacting portions by the soldering method or the like.

The radiating fins 821 are formed into the corrugated shape by alternating folding a thin metal sheet (e.g., an aluminum sheet) having an excellent thermal conductivity and are jointed on the outer wall faces of the radiating tubes 820 by the soldering method or the like.

The upper tank 816 is constructed by combining a shallow dish shaped core plate 816*a* and a deep dish shaped tank plate 816*b,* for example, and is connected to the upper end portions of the individual radiating tubes 820 to provide communication of the individual radiating tubes 820. In the core plate 816*a,* there are formed a number of (not-shown) slots into which the upper end portions of the radiating tubes 820 are inserted.

The lower tank 817 is constructed by combining a shallow dish shaped core plate 817*a* and a deep dish shaped tank plate 817*b,* similarly with the upper tank 816, and is connected to the lower end portions of the individual radiating tubes 820 to provide communication of the individual radiating tubes 820. In the core plate 817*a,* there are formed a number of (not-shown) slots into which the lower end portions of the radiating tubes 820 are inserted. In the tank plate 817*b,* on the other hand, there is formed a (not-shown) slot into which the upper end portion of the refrigerant tank 803 (or the hollow member 806) is inserted.

The refrigerant flow control plates prevent the condensed liquid, as liquefied in the core portion, from flowing directly into the refrigerant chambers 808 thereby to prevent interference in the refrigerant chambers 808 between the vaporized refrigerant and the condensed liquid.

This refrigerant flow control plates are composed of the side control plate 818 and the upper control plate 819, and vapor outlets 823 are opened in the side control plate 818.

Figure 88:
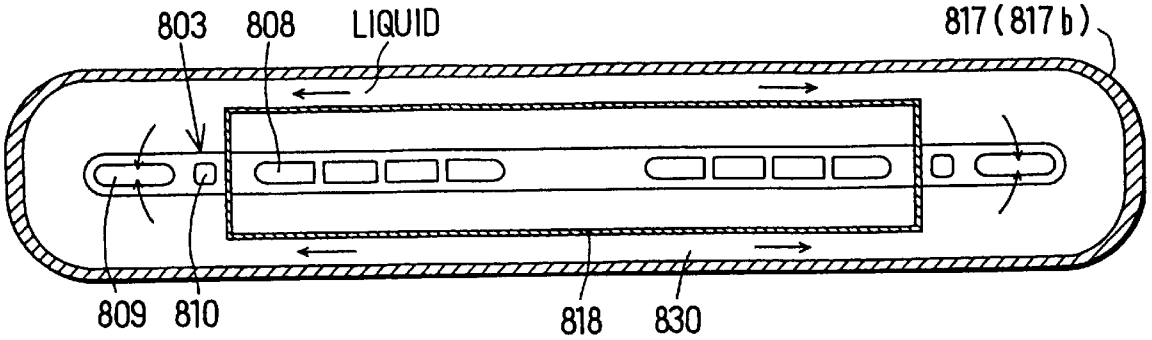
FIG. 88 is a sectional view taken along line 88—88 in FIG. 82.

The side control plate 818 is disposed at a predetermined level around (on the four sides of) the refrigerant chambers 808 opened into the lower tank 817, and its individual (four) faces are inclined outward, as shown in FIGS. 82 and 83. By disposing the side control plate 818 in the lower tank 817, on the other hand, there is formed an annular condensed liquid passage around the side control plate 818 in the lower tank 817, as shown in FIG. 88, and the liquid returning passages 809 and the thermal insulation passages 810 are individually opened in the two left and right sides of the condensed liquid passage.

Figure 86:
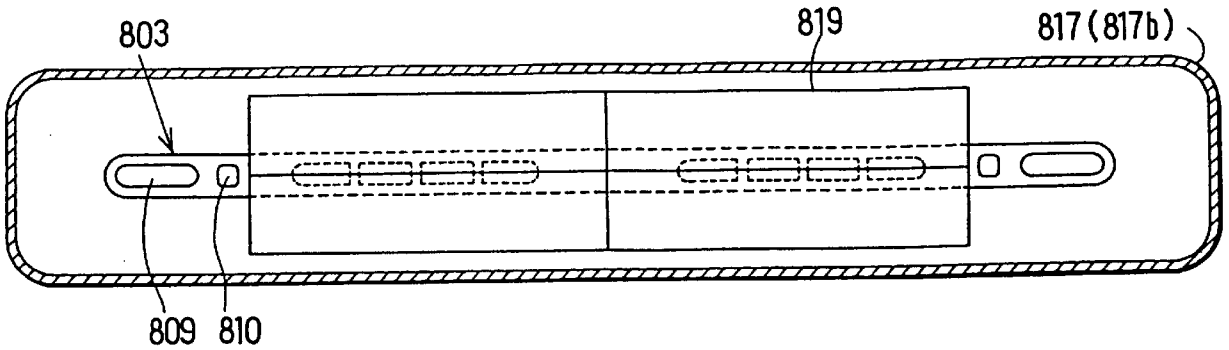
FIG. 86 is a sectional view taken along line 86—86 in FIG. 82.

The upper control plate 819 covers all over the refrigerant chambers 808 (as referred to FIG. 86) which are enclosed by the side control plate 818. Here, this upper control plate 819 is the highest in the transverse direction and in the longitudinal direction as in the gable roof and sloped downhill toward the two left and right sides and the two front and rear sides of the side control plate 818, as shown in FIGS. 82 and 83.

Figure 87:
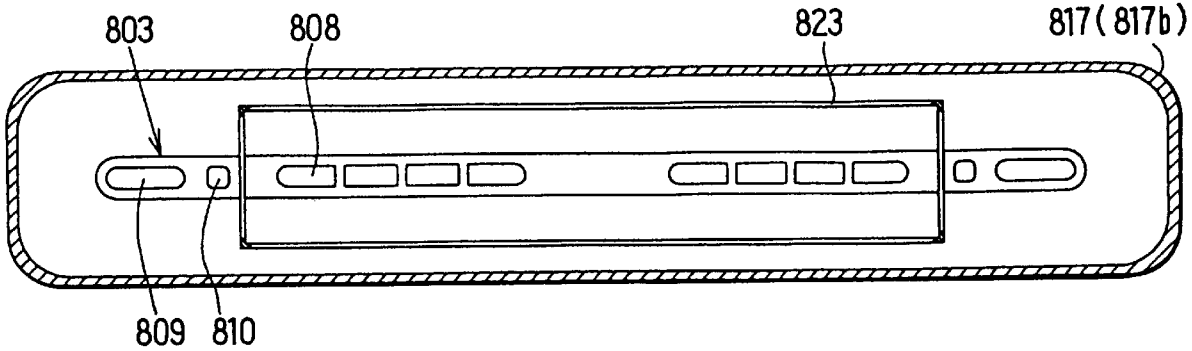
FIG. 87 is a sectional view taken along line 87—87 in FIG. 82.

The vapor outlets 823 are openings for the vaporized refrigerant, as boiled in the refrigerant chambers 808, to flow out, and are individually opened fully to the width in the individual faces of the side control plate 818, as shown in FIG. 87. However, the vapor outlets 823 are opened (as referred to FIGS. 82 and 83) at such a higher position than the bottom face of the lower tank 817 that the condensed liquid flowing in the aforementioned condensed liquid passage may not flow thereinto. On the other hand, the upper ends of the vapor outlets 823 are opened along the upper control plate 819 up to the uppermost end of the side control plate 818.

Next, the operations of this embodiment will be described.

The vaporized refrigerant, as boiled in the refrigerant chambers 808 by the heat of the heating body 802, flows from the refrigerant chambers 808 into the space, which is enclosed by the refrigerant control plates in the lower tank 817. After this, the vaporized refrigerant flows out from the vapor outlets 823 which are opened in the side control plate 818, and further from the lower tank 817 into the individual radiating tubes 820. The vaporized refrigerant flowing in the radiating tubes 820 is cooled by the heat exchange with the external fluid blown to the core portion, so that it is condensed in the radiating tubes 820. The refrigerant thus condensed is partially retained in the lower portions of the inner fins 822 by the surface tension to form liquid trapping portions (as referred to FIG. 85). On the other hand, these liquid trapping portions are also formed as a result that the vaporized refrigerant, as rising, impinges upon the lower faces of the inner fins 822 so that the bubble liquid film is trapped in the lower portions of the inner fins 822 by the surface tension.

The condensed liquid, as trapped in the liquid trapping portions of the inner fins 822, is forced to drip from the liquid trapping portions into the lower tank 817 by the pressure of the vaporized refrigerant rising in the gaps 820*a* (or refrigerant passages) formed on the two sides of the inner fins 822. At this time, most of the condensed liquid dripping from the radiating tubes 820 drops on the upper face of the upper control plate 819 and then flows on the slopes of the upper control plate 819 so that it flows down to the condensed liquid passage which is formed around the side control plate 818. The remaining condensed liquid partially drips directly to the liquid returning passages 809 or the thermal insulation passages 810 whereas the remainder flows down into the condensed liquid passage. The condensed liquid that resides in the condensed liquid passage flows into the liquid returning passages 809 and the thermal insulation passages 810 and is then recycled via the circulating passage 811 into the refrigerant chambers 808.

(Effects of the Twenty-fourth Embodiment)

In the cooling apparatus 801 of this embodiment, the vapor outlets 823 are opened in the side control plate 818, the individual faces of which are sloped to the outside, so that the condensed liquid having dripped from the radiating tubes 820 can be prevented from flowing from the vapor outlets 823 into the inner space (which is enclosed by the side control plate 818 and the upper control plate 819) of the refrigerant flow control plates. As a result, no condensed liquid flows directly into the refrigerant chambers 808 to prevent the interference in the refrigerant chambers 808 between the vaporized refrigerant and the condensed liquid so that a high radiation performance can be kept even when the radiation increases.

Even when the cooling apparatus 801 is inclined, on the other hand, the condensed liquid can be prevented from flowing into the vapor outlets 823 as in the aforementioned case if the inclination is within the angle of inclination of the side control plate 818, so that the radiation performance can be kept.

Moreover, the upper control plate 819 is the highest at its central portion and has the slopes inclined downward toward the two left and right sides and the two front and rear sides of the side control plate 818 so that the condensed liquid having dripped on the upper control plate 819 can reliably flow into the liquid returning passages 809 without residing as it is on the upper control plate 819. On the other hand, the liquid returning passages 809 are disposed on the two left and right sides of the refrigerant chambers 808 so that the condensed liquid having dripped from the radiating tubes 820 can be recycled from the liquid returning passages 809 on the two sides into the refrigerant chambers 808. As a result, a head difference h (i.e., the level of the liquid in the liquid returning passages 809—the level of the liquid in the refrigerant chambers 808, as referred to FIG. 82) necessary for circulating the refrigerant in the refrigerant tank 803 can be made smaller to retain the stable radiation performance.

The vapor outlets 823 are opening in the individual (four) faces of the side control plate 818 so that the vaporized refrigerant can be diffused in four directions in the lower tank 817 to flow homogeneously in the individual radiating tubes 820. As a result, the deviation of the vaporized refrigerant can be eliminated to make effective use of the entire core portion thereby to exhibit a sufficient radiation performance.

On the other hand, the vapor outlets 823 are opened along the upper control plate 819 up to the uppermost end of the side control plate 818 so that the vaporized refrigerant can smoothly flow out from the vapor outlets 823 without residing in the upper portion of the inner space of the refrigerant flow control plates.

Since the liquid returning passages 809 are disposed on the two sides of the refrigerant chambers 808, moreover, the condensed liquid can flow into the liquid returning passages 809 no matter which of leftward or rightward the cooling apparatus 801 might be inclined. As a result, the condensed liquid can be stably recycled to the refrigerant chambers 808.

Since the annular condensed liquid passage is formed around the side control plate 818 in the lower tank 817, on the other hand, the condensed liquid that resides in the condensed liquid passage can flow into the liquid returning passages 809 even when the cooling apparatus 801 is inclined not only to the left or right but also to the front or back.

[Twenty-fifth Embodiment]

Figure 89:
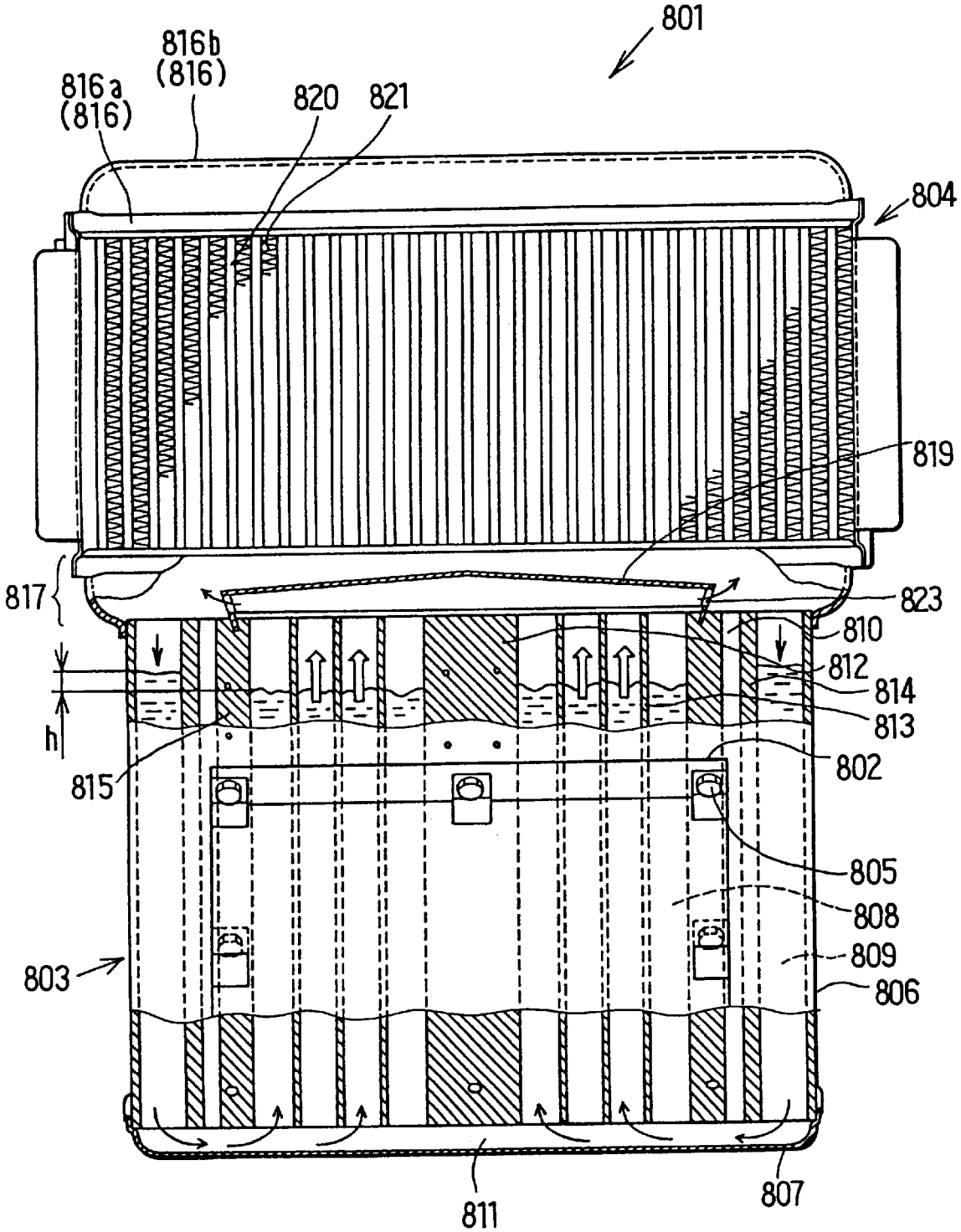
FIG. 89 is a plan view of a cooling apparatus (Twenty-fifth Embodiment)
Figure 90:
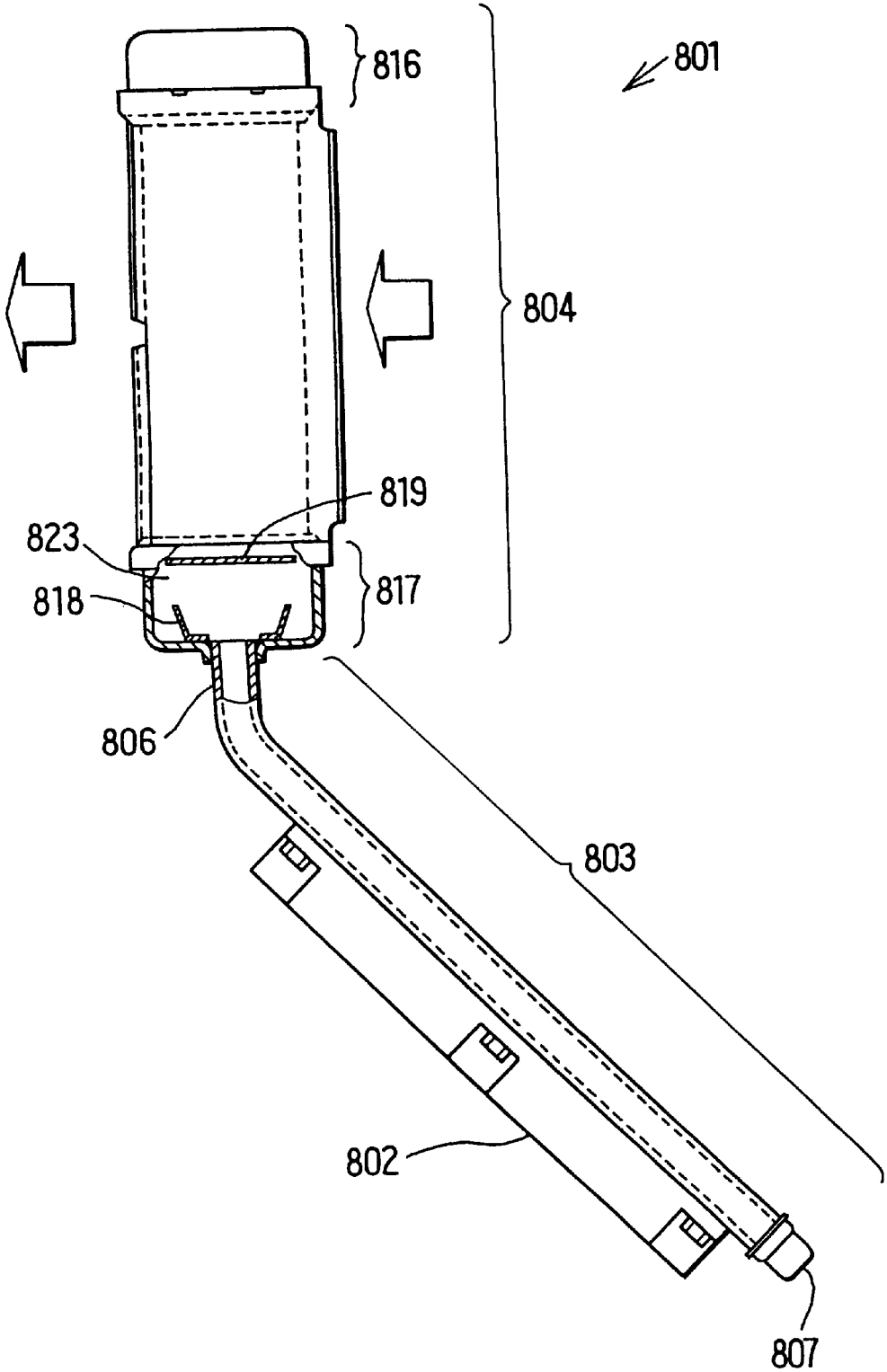
FIG. 90 is a side view of the cooling apparatus.

FIG. 89 is a plan view of a cooling apparatus 801, and FIG. 90 is a side view of the cooling apparatus 801.

In this embodiment, the slopes of the upper control plate 819 are provided only in the transverse direction, as shown in FIG. 89. In the case of this embodiment, too, the condensed liquid having dripped on the upper control plate 819 can flow down on the slopes to the condensed liquid passages which are formed around (mainly at the two left and right sides) of the side control plate 818. As a result, the condensed liquid having dripped on the upper control plate 819 does not reside as it is on the upper control plate 819 but can flow without fail into the liquid returning passages 809 and can be recycled to the refrigerant chambers 808.

On the other hand, the condensed liquid having dripped on the upper control plate 819 is separated to the left and right to flow on the individual slopes so that the separated flows can be recycled from the liquid returning passages 809 on the left and right sides to the refrigerant chambers 808.

As a result, the head difference h (i.e., the level of the liquid in the liquid returning passages 809—the level of the liquid in the refrigerant chambers 808, as referred to FIG. 89) necessary for circulating the refrigerant in the refrigerant tank 803 can be made smaller as in the case of the Twenty-fourth Embodiment to retain the stable radiation performance.

In this embodiment, the refrigerant tank 803 is attached at an inclination to the radiator 804, as shown in FIG. 90. This attachment is exemplified by the case in which when the cooling apparatus 801 is mounted on an electric vehicle, the mounting space on the vehicle side is so restricted that the cooling apparatus 801 cannot be mounted in the upright position (i.e., the position shown in FIGS. 82 and 83). In this case, the cooling apparatus 801 can be easily mounted even in the small mounting space of the electric vehicle by attaching the refrigerant tank 803 at an inclination, as shown in FIG. 90.

[Twenty-sixth Embodiment]

Figure 91:
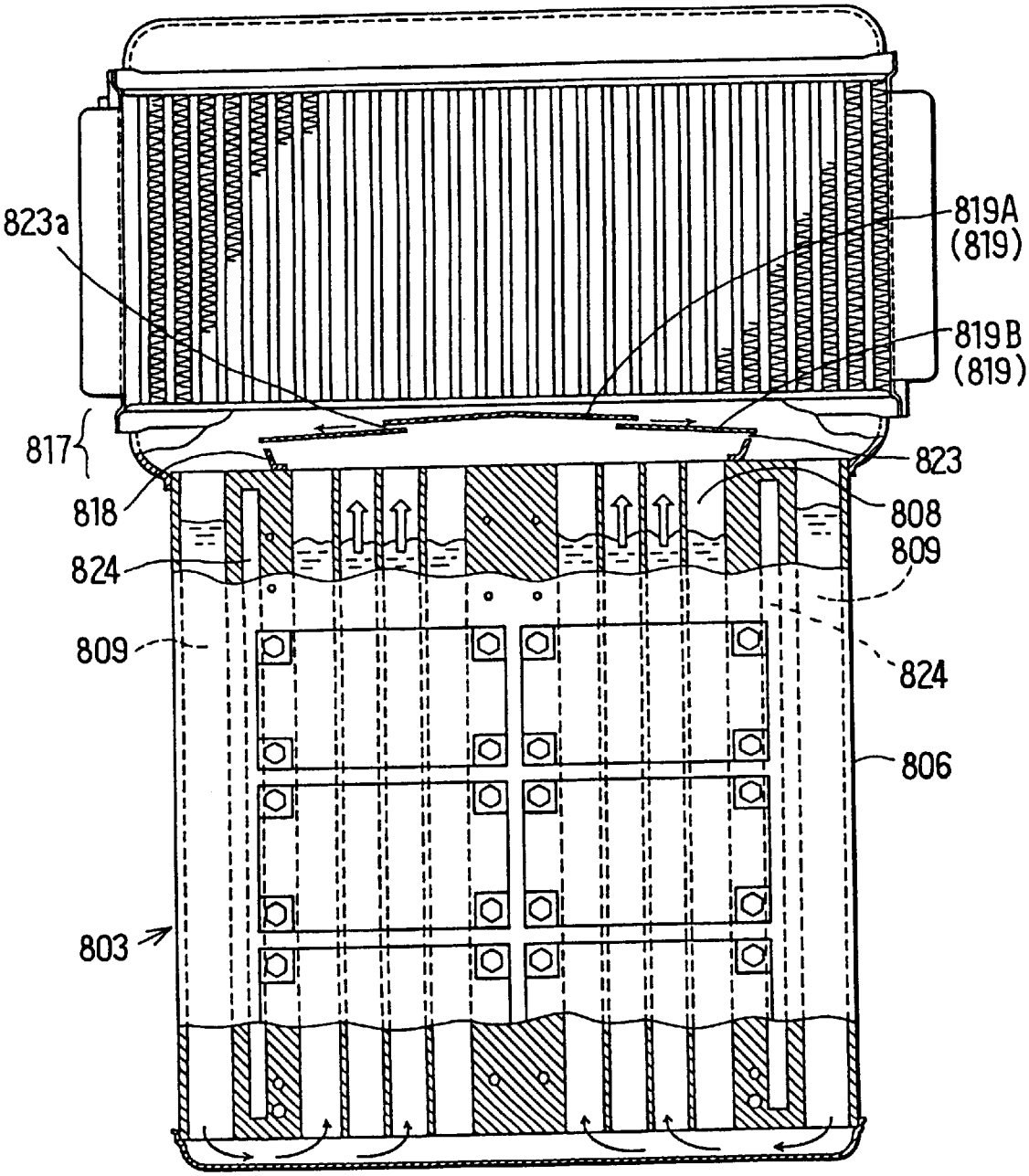
FIG. 91 is a plan view of a cooling apparatus (Twenty-sixth Embodiment)

FIG. 91 is a plan view of a cooling apparatus 801.

This embodiment is exemplified by dividing the upper control plate 819 into a plurality (i.e., two in FIG. 91). The upper control plate 819 is composed of a first upper control plate 819A and second upper control plates 819B.

The first upper control plate 819A is arranged generally at the central portion in the lower tank 817 and over the second upper control plates 819B to cover over portions of the refrigerant chambers 808. This first upper control plate 819A is the highest at its central portion and is inclined downward on its two sides so that the condensed liquid having dripped on its upper face may easily flow.

The second upper control plates 819B are arranged on the two sides of the first upper control plate 819A to cover together with the first upper control plate 819A all over the refrigerant chambers 808. These second upper control plates 819B are arranged in such an inclined state as to facilitate easy flow of the condensed liquid having dripped thereon to the outer sides.

The first upper control plate 819A and the second upper control plates 819B are arranged to overlap their individual end portions vertically to form second vapor outlets 823a between the vertically confronting end portions. Here, the vapor outlets 823 are opened in the side control plate 818 as in the Twenty-fourth Embodiment and the Twenty-fifth Embodiment.

According to the construction of this embodiment, the effective area of the vapor outlets 823 (including 823*a*) can be retained so large that the vaporized refrigerant can flow smoothly without any stagnation even if the radiation rises, thereby to keep a high radiation performance.

In this embodiment, on the other hand, thermal insulation slits 824 are formed between the refrigerant chambers 808 and the liquid returning passages 809. These thermal insulation slits 824 are formed through the hollow member 806 in the thickness direction and are closed at its two upper and lower end sides. These thermal insulation slits 824 can raise the thermal insulation effect more than the case in which the thermal insulation passages 810 of the Twenty-fourth Embodiment are formed between the refrigerant chambers 808 and the liquid returning passages 809. As a result, the refrigerant circulation in the refrigerant tank 803 to provide a merit that the radiation performance can be improved.

[Twenty-seventh Embodiment]

Figure 92:
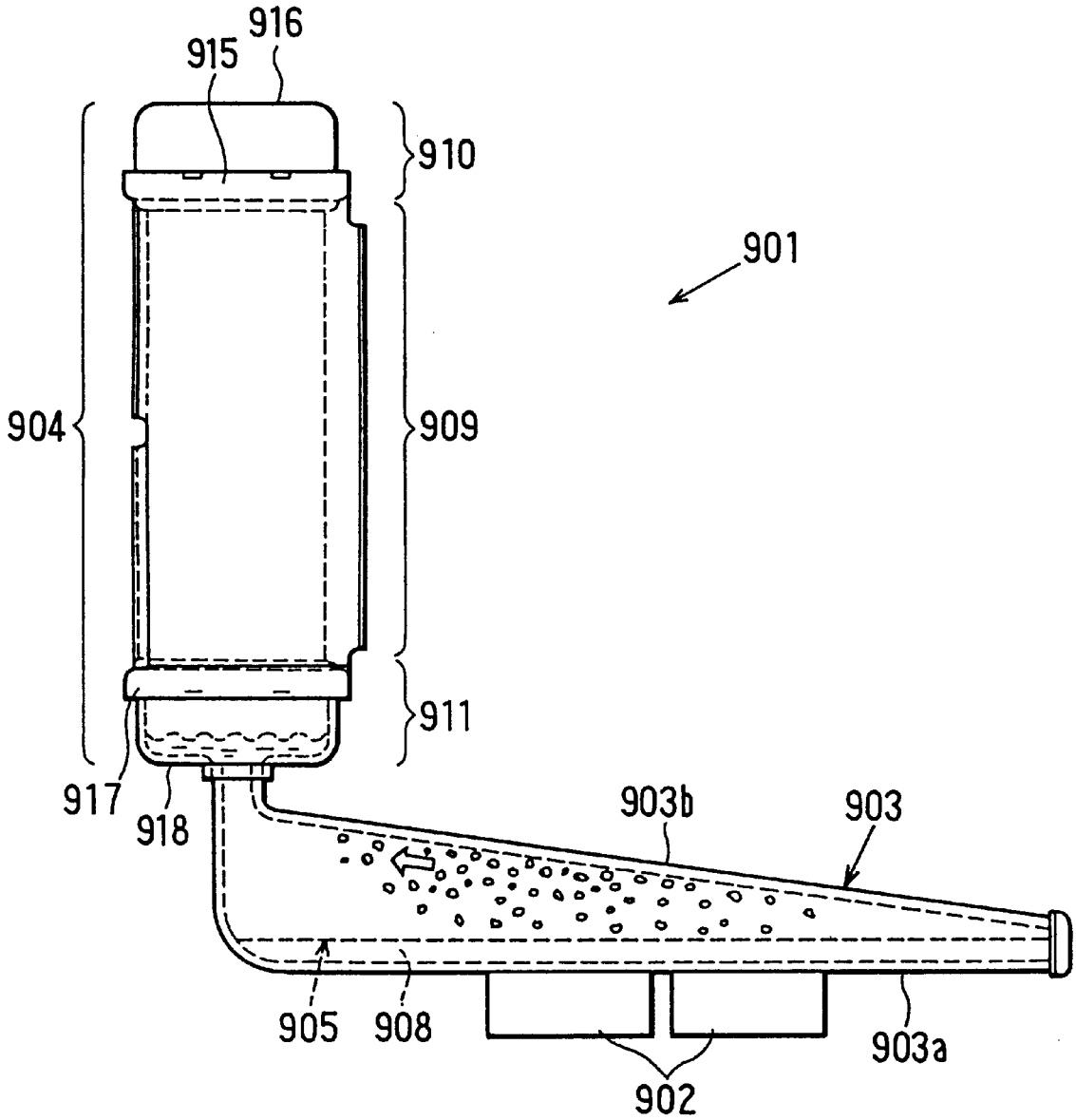
FIG. 92 is a side view of a cooling apparatus (Twenty-seventh Embodiment)
Figure 93:
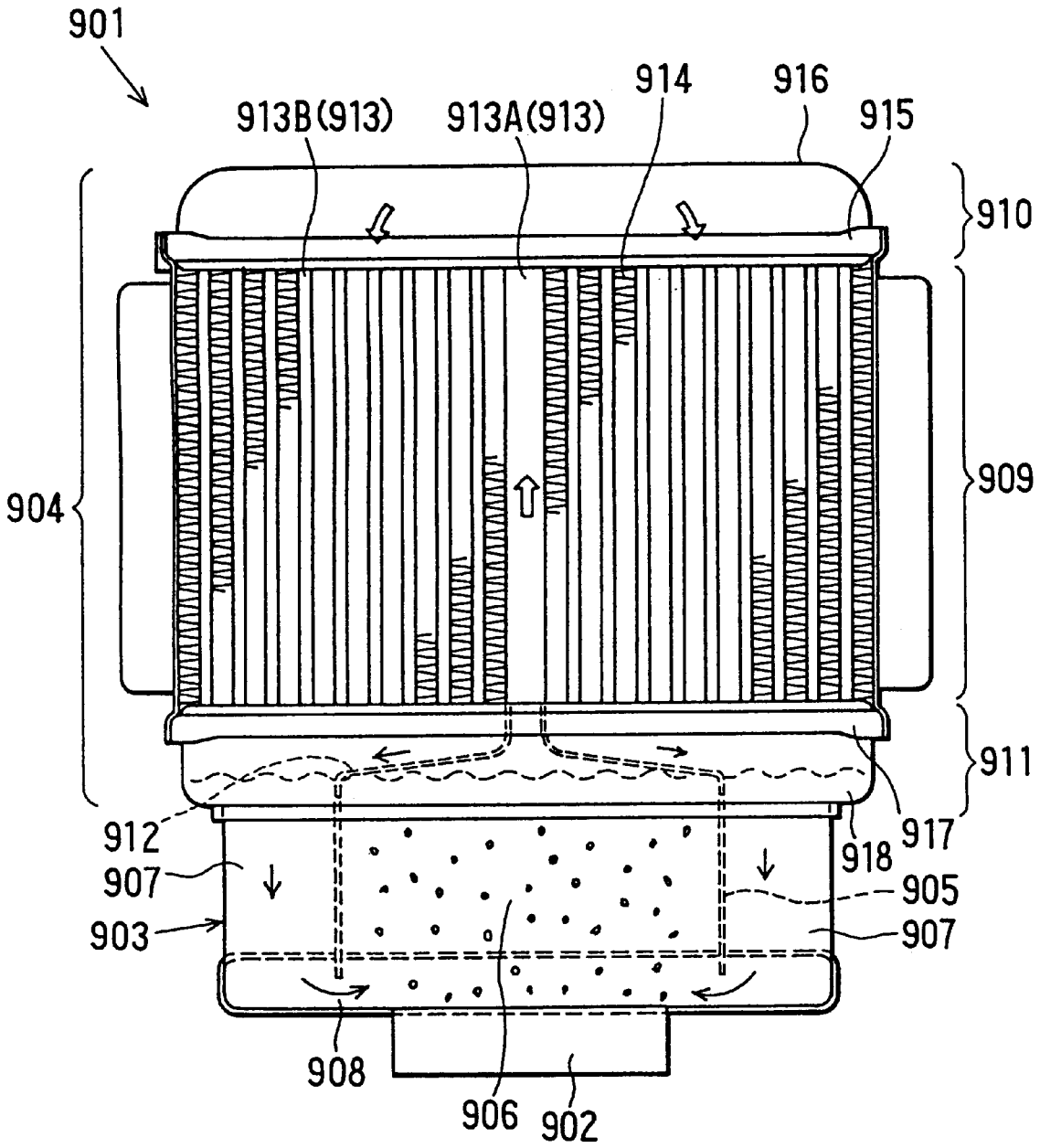
FIG. 93 is a plan view of the cooling apparatus.

FIG. 92 is a side view of a cooling apparatus 901, and FIG. 93 is a front view of the cooling apparatus 901.

The cooling apparatus 901 cools a heating body 902 by making use of the boiling and condensing actions of a refrigerant and is provided with a refrigerant tank 903 for reserving the refrigerant therein, and a radiator 904 disposed over the refrigerant tank 903, as shown in FIGS. 92 and 93.

The heating body 902 is an IGBT module constructing an inverter circuit of an electric vehicle, for example, and is fixed in close contact with the lower side wall face 903*a* of the refrigerant tank 903.

The refrigerant tank 903 is formed into a flat shape having a smaller thickness size (or a vertical size of FIG. 92) than the width size (or a horizontal size of FIG. 93) and is assembled at an inclination generally in a horizontal direction with respect to the radiator 904. On the other hand, this refrigerant tank 903 is formed into a inclined face that an upper side wall 903*b* in the thickness direction is sloped in the longitudinal direction (or in the transverse direction of FIG. 92) of the refrigerant tank 903 to uphill on the side of the radiator 904 and is formed into such a taper shape that the distance (i.e., the thickness size of the refrigerant tank 903) from the generally horizontal lower side wall face 903*a* becomes gradually larger from the leading end side of the refrigerant tank 903 to the side of the radiator 904.

Figure 94A:
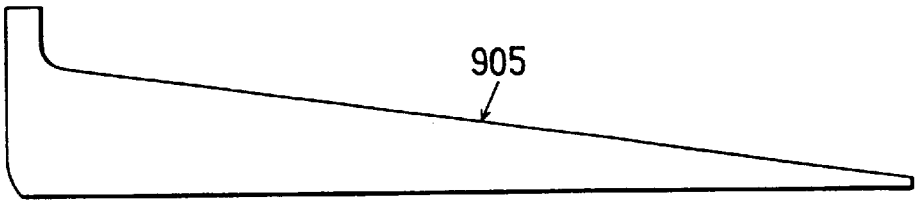
Figure 94B:
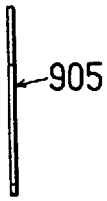

The inside of the refrigerant tank 903 is partitioned by two partition plates 905 into a refrigerant chamber 906 and liquid returning passages 907, as shown in FIG. 93. The two partition plates 905 are disposed on the two outer sides of the heating body 902 attached to the lower side wall face 903*a* of the refrigerant tank 903, and are formed generally into a triangular shape matching the side face shape (or the shape shown in FIG. 92) of the refrigerant tank 903. Here, a predetermined gap 908 is retained between the partition plates 905 and the bottom face of the refrigerant tank 903. The shape of the partition plates 905 is shown in FIGS. 94A, 94B. Here, FIG. 94A is a side view, and FIG. 94B is a front view.

The refrigerant chamber 906 is defined between the two partition plates 905 to form a boiling region in which a refrigerant reserved therein is boiled by receiving the heat of the heating body 902. The liquid returning passages 907 are passages into which the condensed liquid condensed in the radiator 904 flows, and are formed on the two left and right sides of the refrigerant chamber 906 (as referred to FIG. 93). Here, the refrigerant chamber 906 and the liquid returning passages 907 are made to communicate through the lower gap 908 of the partition plates 905.

The radiator 904 is composed of a core portion 909, an upper tank 910 and a lower tank 911, and a refrigerant flow control plate 912 is disposed in the lower tank 911.

The core portion 909 is a radiating portion for condensing and liquefying the vaporized refrigerant, as boiled by the heat of the heating body 902, by the heat exchange with an external fluid (such as air). The core portion 909 is used by arranging a plurality of flat tubes 913 (913A, 913B) and radiating fins 914 alternately and with the individual radiating tubes 914 being erected upright, as shown in FIG. 93.

The flat tubes 913 are composed of one vaporizing tube 913A and a plurality of condensing tubes 913B and are used by cutting the individual flat tubes of aluminum to a predetermined length.

The vaporizing tube 913A is arranged at the central portion of the core portion 909 to receive the vaporized refrigerant, which is boiled in the refrigerant tank 903 (or the refrigerant chamber 906). The condensing tubes 913B are arranged on the two sides of the vaporizing tube 913A to communicate with the vaporizing tube 913A through the upper tank 910. However, the vaporizing tube 913A is made wider (horizontal in FIG. 92) than the condensing tubes 913B and is formed to have a large passage area. Here, in order to enlarge the condensation area, (not-shown) inner fins may be inserted into the condensing tubes 913B. If the inner fins are inserted into the vaporizing tube 913A for the passage of the vaporized refrigerant, however, the pressure loss increases, and it is advisable not to insert the inner fins into the vaporizing tube 913A.

The radiating fins 914 are the corrugated fins which are formed by folding a thin metallic sheet (e.g., an aluminum sheet) having an excellent thermal conductivity alternately into a corrugated shape and are joined to the outer surfaces of the individual condensing tubes 913B by a soldering method or the like.

The upper tank 910 is constructed by combining a core plate 915 and a tank plate 916 made of aluminum or the like, and is connected to the upper end portions of the individual flat tubes 913 to provide communication among individual flat tubes 913 in the upper tank 910.

The lower tank 911 is constructed like the upper tank 910 by combining a core plate 917 and a tank plate 918 made of aluminum, for example, and is connected to the lower end portions of the individual flat tubes 913 to provide communication among the individual flat tubes 913 in the lower tank 911.

Figure 95A:
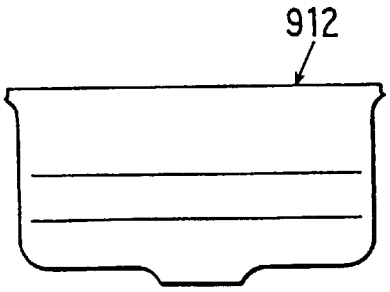
Figure 95B:
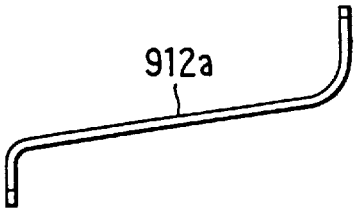

The refrigerant flow control plate 912 introduces the vaporized refrigerant, as boiled in the refrigerant chamber 906, into the vaporizing tubes 913A of the core portion 909 and the condensed liquid, as cooled and liquefied in the core portion 909, into the liquid returning passages 907 of the refrigerant tank 903. As shown in FIG. 92, the refrigerant flow control plate 912 is constructed of one set of two plates and arranged to cover over the refrigerant chamber 906 from the two sides. The shape the refrigerant flow control plate 912 is shown in FIGS. 95A, 95B. Here, FIG. 95A is a front view, and FIG. 95B is a side view. Here, this refrigerant flow control plate 912 has a slope face 912*a* for guiding the condensed liquid having dripped from the core portion 909 into the liquid returning passages 907. On the other hand, the refrigerant flow control plate 912 and the partition plates 905 may be formed integrally with each other.

Next, the operations of this embodiment will be described.

The heat, as generated from the heating body 902, is transferred to boil the refrigerant of the refrigerant chamber 906. The refrigerant thus boiled rises as a vapor in the refrigerant chamber 906 and along the upper side wall faces 903*b* of the refrigerant tank 903 and flows to the side of the radiator 904. The vaporized refrigerant having flown from the refrigerant chamber 906 into the lower tank 911 of the radiator 904 flows along the two refrigerant flow control plates 912 into the vaporizing tube 913A of the core portion 909. The vaporized refrigerant passes through the vaporizing tube 913A and is then distributed through the upper tank 910 into the individual condensing tubes 913B. The vaporized refrigerant flowing via the condensing tubes 913B is cooled by the heat exchange with the ambient air and is condensed on the inner wall faces of the condensing tubes 913B while releasing its latent heat. The latent heat thus released when the vaporized refrigerant is condensed is transferred from the wall faces of the condensing tubes 913B to the radiating fins 914 so that it is released to the ambient air through the radiating fins 914.

On the other hand, the condensed liquid, as condensed in the condensing tubes 913B into droplets, flows downward on the inner wall faces of the condensing tubes 913B so that a portion of the condensed liquid drips from the condensing tubes 913B directly into the liquid returning passages 907 of the refrigerant tank 903. The remaining condensed liquid drips onto the refrigerant flow control plates 912 arranged in the lower tank 911, and then drops on the inclined faces 912*a* of the refrigerant flow control plates 912 into the liquid returning passages 907. The condensed liquid having flown into the liquid returning passages 907 is fed to the refrigerant chamber 906 through the lower gap 908 of the partition plates 905 arranged in the refrigerant tank 903, as indicated by arrows in FIG. 93.

(Effects of the Twenty-seventh Embodiment)

In the cooling apparatus 901 of this embodiment, when a plurality of heating bodies 902 are attached in the longitudinal direction of the refrigerant tank 903, for example, the thickness size of the refrigerant tank 903 grows gradually large toward the side of the radiator 904 so that bubbles can be prevented from filling the vicinity of the heating body closer to the radiator 904, even if the bubbles generated on the individual heating body mounting faces sequentially flow toward the radiator 904. Even in the case of one heating body, moreover, the bubbles become more downstream (i.e., closer to the radiator 904) of the heating body mounting face than upstream (i.e., farther from the radiator 904) so that effects similar to those of the aforementioned case of a plurality of heating bodies 902 are achieved.

On the other hand, the refrigerant tank 903 of this embodiment is assembled at the inclination generally in the horizontal direction with respect to the radiator 904, so that the bubbles flow more gently and become reluctant to come out, as compared with the case in which the generated bubbles rise vertically (when the refrigerant tank 903 is arranged upright) in the refrigerant tank 903. If the thickness size of the refrigerant tank 903 is constant as in the prior art, therefore, the bubbles are liable to fill up the vicinity of the heating body mounting face of the refrigerant tank 903. By increasing the thickness size of the refrigerant tank 903 gradually toward the radiator 904, however, the bubbles can be made to come out thereby to prevent the burnout on the heating body mounting face.

Since the bubbles can be made less apart from the radiator 904, moreover, the quantity of the refrigerant can be optimized by making the thickness size of the refrigerant tank 903 (into the taper shape) smaller apart from the radiator 904 than close to the radiator 904, thereby to prevent a rise in the cost, as might otherwise be caused by filling an excessive amount of refrigerant.

[Twenty-eight Embodiment]

Figure 96:
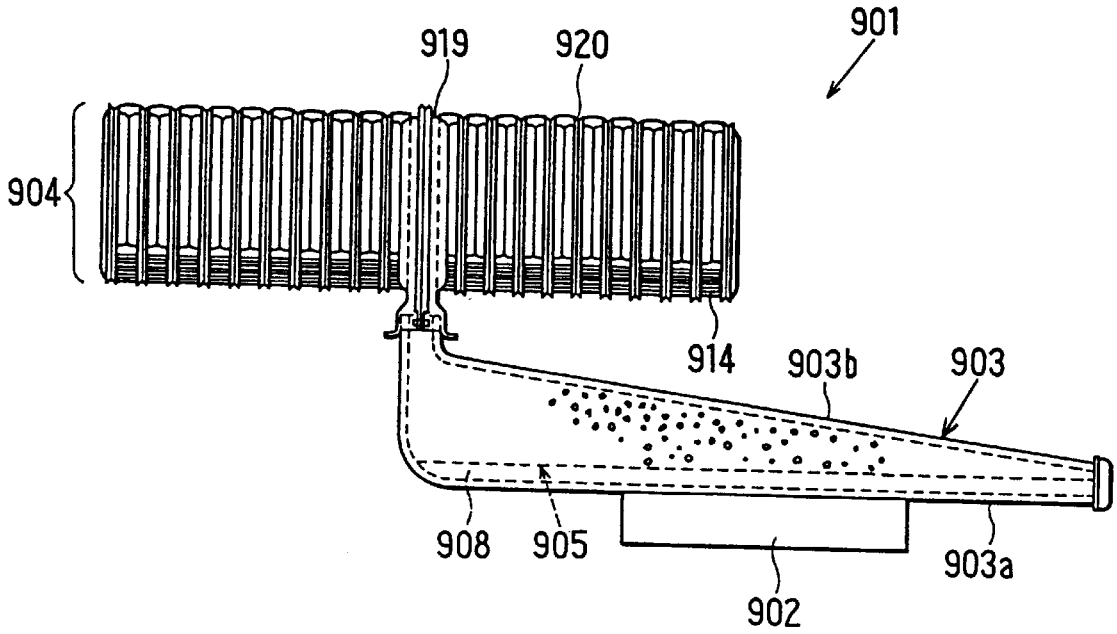
Figure 97:
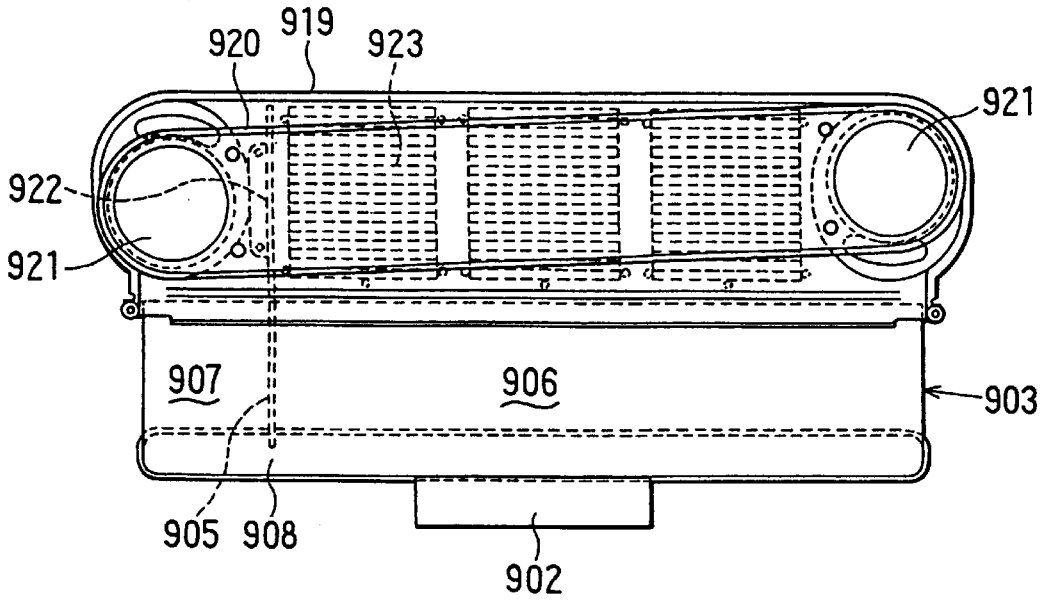

FIG. 96 is a side view of a cooling apparatus 901, and FIG. 97 is a front view of the cooling apparatus 901.

This embodiment exemplifies one example of the case in which the structure of the radiator 904 is different from that of the Twenty-seventh Embodiment.

The radiator 904 of the Twenty-seventh Embodiment is constructed to match the horizontal flow (in which the air flow is horizontal with respect to the radiator 904). On the contrary, the radiator 904 of this embodiment is constructed to match the vertical flow.

The refrigerant tank 903 is assembled generally horizontally with the radiator 904 as in the Twenty-seventh Embodiment, and its inside is partitioned by the single partition plate 905 into the refrigerant chamber 906 and the liquid returning passage 907, as shown in FIG. 97, which communicates with the each other through the lower gap 908 of the partition plate 905. The shape of the partition plate 905 is identical to that of the Twenty-seventh Embodiment.

The construction of the radiator 904 will be briefly described in the following.

The radiator 904 is the so-called "drawn cup type" heat exchanger, which is composed of a connecting chamber 919, a radiating tube 920 and radiating fins 914 as shown in FIG. 96.

The connecting chamber 919 is a joint to the refrigerant tank 903 and is assembled with the upper opening of the refrigerant tank 903. This connecting chamber 919 is formed by joining two pressed sheets to each other at their outer peripheral edge portions while opening round communication ports 921 in the two end portions in the longitudinal direction (or in the horizontal direction of FIG. 97). In the connecting chamber 919, there is arranged a partition plate 922, by which the inside of the connecting chamber 919 is partitioned into a first communication chamber (as located on the right side of the partition plate 922 in FIG. 97) communicating with the refrigerant chamber 906 of the refrigerant tank 903 and a second communication chamber (as located on the left side of the partition plate 922 in FIG. 97) communicating with the liquid returning passage 907 of the refrigerant tank 903. On the other hand, inner fins 923 are inserted into the first communication chamber.

The radiating tubes 920 are formed into flat hollow tubes by joining two pressed sheets at their outer peripheral edge portions, and the circular communication ports 921 are opened in the two end portions in the longitudinal direction (or in the horizontal direction of FIG. 97). A plurality of radiating tubes 920 are stacked on the two sides of the connecting chamber 919, respectively, as shown in FIG. 96, to have communication with each other via their mutual communication ports 921. The radiating tubes 920 are assembled with the connecting chamber 919 in such a slightly inclined state (as referred to FIG. 97) as to facilitate easy flow of the condensed liquid.

The radiating fins 914 are interposed between the connecting chamber 919 and the radiating tubes 920 and between the individual laminated radiating tubes 920 and are joined to the surfaces of the connecting chamber 919 and the radiating tubes 920 by the soldering method or the like.

Next, the operations of this embodiment will be described.

The vaporized refrigerant, as boiled by the heat of the radiating body 902, flows from the refrigerant chamber 906 via the first communication chamber of the connecting chamber 919 into the individual radiating tubes 920 and is cooled while flowing in the radiating tubes 920 by the heat exchange with the ambient air so that it is condensed on the inner wall faces of the radiating tubes 920. The condensed liquid condensed into droplets flows in the direction of inclination (from the right to the left of FIG. 97) in the radiating tubes 920 and drips through the second communication chamber of the connecting chamber 919 into the liquid returning passage 907 of the refrigerant chamber 906. After this, the condensed liquid is recycled from the liquid returning passage 907 through the lower gap 908 of the partition plate 905 into the refrigerant chamber 906.

In the cooling apparatus 901 of this embodiment, too, the thickness size of the refrigerant tank 903 becomes gradually larger toward the radiator 904 as in the Twenty-seventh Embodiment, so that the bubbles can be prevented from filling the heating body mounting faces close to the radiator 904. By making the thickness size of the refrigerant tank 903 gradually the larger as the closer to the radiator 904, on the other hand, the bubbles are enabled to easily come out thereby to prevent the burnout on the heating body mounting faces. Moreover, the quantity of refrigerant can be optimized to prevent a rise in the cost, as might otherwise be caused by filling an excessive quantity of refrigerant.

[Twenty-ninth Embodiment]

Figure 98:
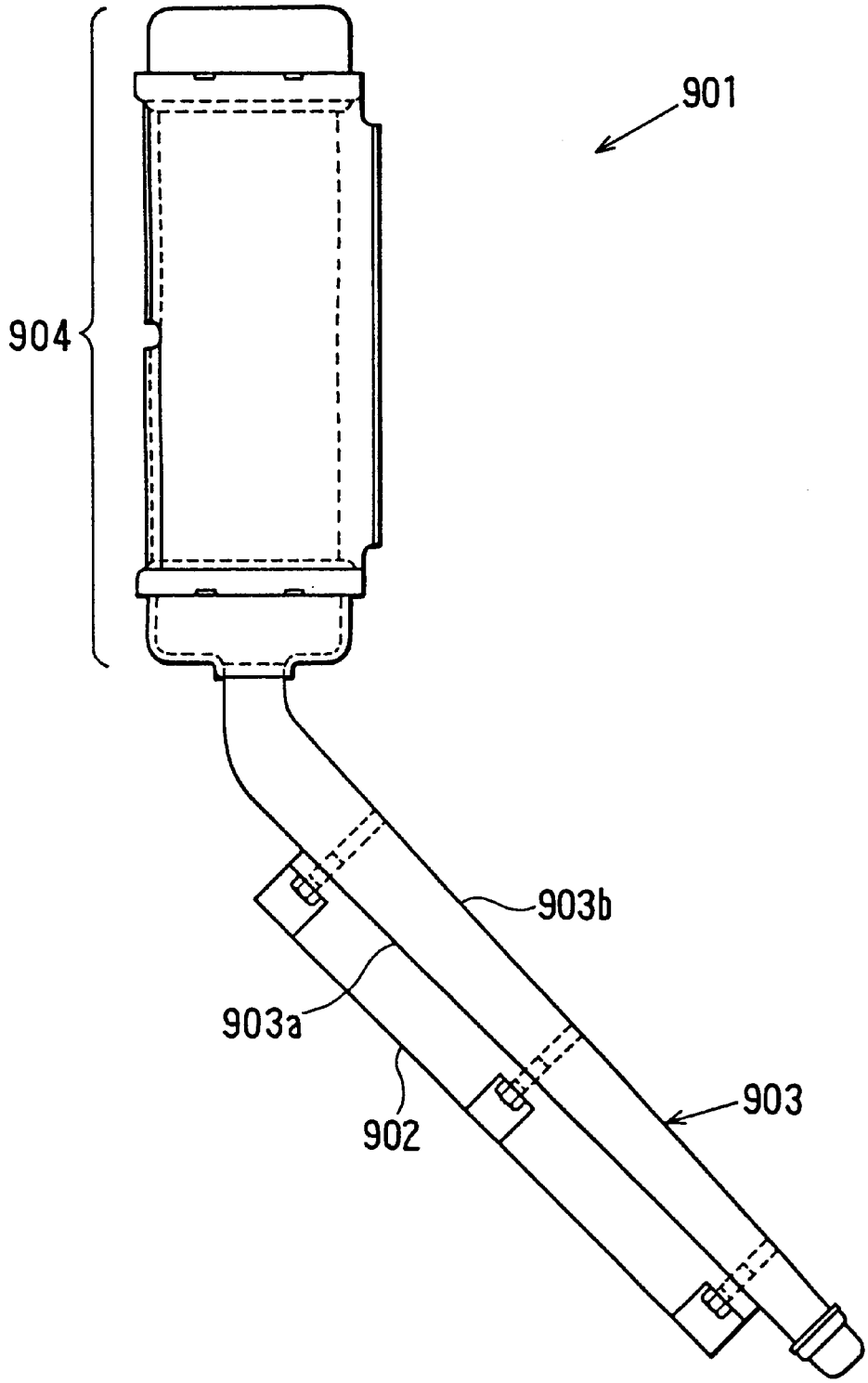
Figure 99:
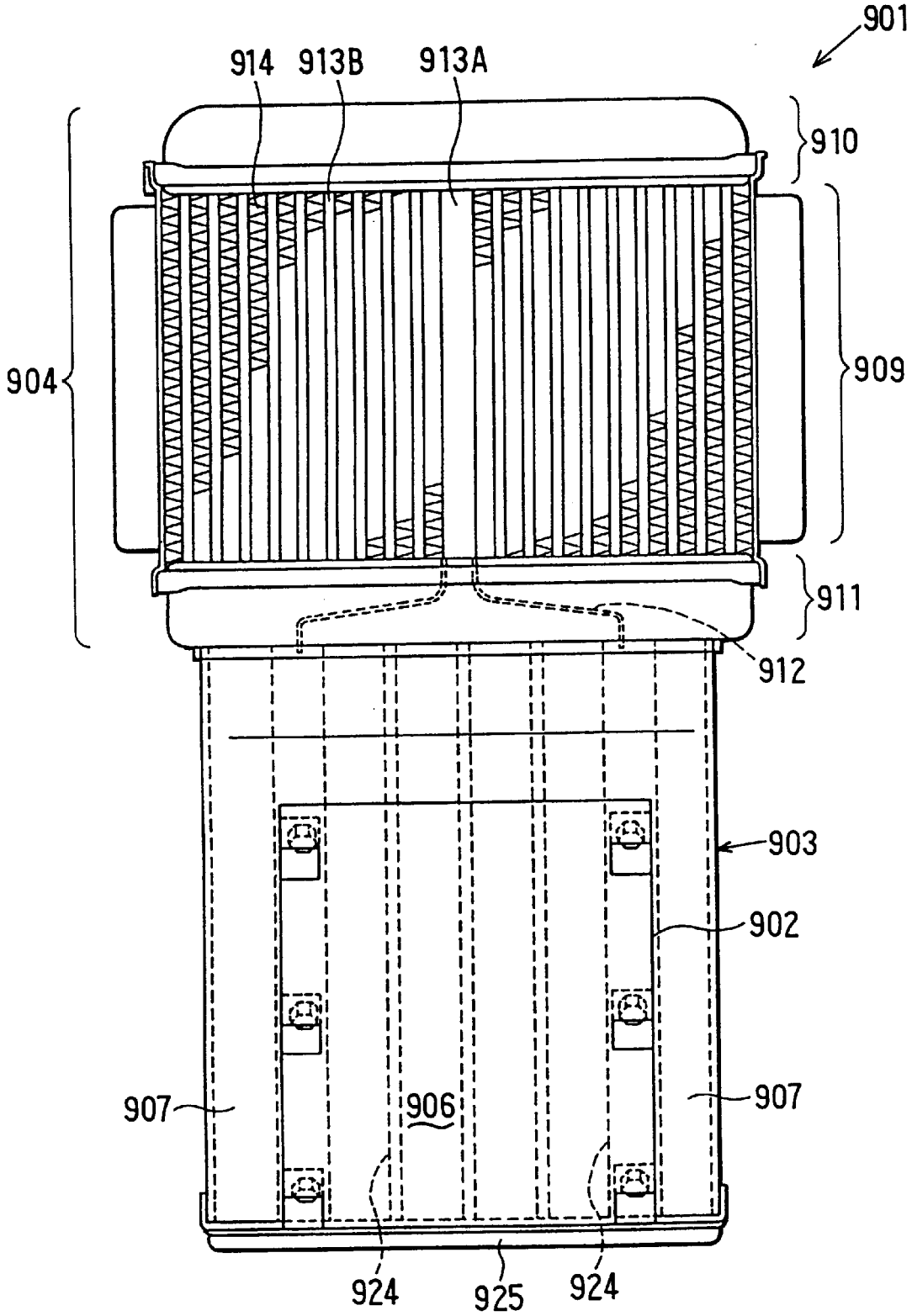

FIG. 98 is a side view of a cooling apparatus 901, and FIG. 99 is a front view of the cooling apparatus 901.

As shown in FIG. 92, the refrigerant tank 903 of this embodiment is assembled in an obliquely inclined state with respect to the radiator 904, and is formed into such a taper shape that its thickness size becomes gradually larger from the leading end of the refrigerant tank 903 toward the radiator 904. In this case, too, the radiating body 902 is attached to the lower side wall face 903*a* of the refrigerant tank 903.

On the other hand, the inside of the refrigerant tank 903 is formed by a plurality of supporting members 924 into the refrigerant chamber 906 and the liquid returning passages 907, and a circulating passage 925 is formed in the bottom portion of the refrigerant tank 903 to provide communication between the refrigerant chamber 906 and the liquid returning passages 907. As a result, the condensed liquid having flown from the radiator 904 into the liquid returning passages 907 is fed via the circulating passage 925 to the refrigerant chamber 906.

The radiator 904 is made to have the same structure as that of the Twenty-seventh Embodiment (or may have the structure as that of the Twenty-eighth Embodiment).

This embodiment can also achieve effects similar to those of the Twenty-seventh Embodiment.

What is claimed is:

1. A cooling apparatus comprising:

a refrigerant chamber for reserving a refrigerant to be boiled by heat of a heating body;

a vapor outlet from which a vaporized refrigerant boiled in said refrigerant chamber flows out;

a radiating portion having a refrigerant passage, into which the vaporized refrigerant having flown out from said vapor outlet flows, for cooling the vaporized refrigerant flowing through said refrigerant passage by the heat exchange with an external fluid;

a liquid inlet into which a condensed refrigerant cooled and liquefied in said radiating portion flows;

a circulating passage for circulating the condensed refrigerant from said liquid inlet to said refrigerant chamber;

a connecting tank disposed between said radiating portion, and said refrigerant chamber and said circulating passage for communicating between said refrigerant passage, and said refrigerant chamber and said circulating passage;

refrigerant control means disposed in said connecting tank, for controlling flow of said condensed refrigerant dropped from said radiating portion;

a refrigerant tank including said refrigerant chamber and said circulating passage therein and using the upper end opening of said refrigerant chamber as said vapor outlet and the upper end opening of said circulating passage as said liquid inlet, wherein said refrigerant tank is attached at an inclination to said connecting tank; and in that the lowermost portion of said vapor outlet is positioned over the lowermost portion of said liquid inlet, and wherein said refrigerant tank is constructed such that said vapor outlet is opened obliquely upward and protruded more forward than said liquid inlet.

2. A cooling apparatus according to claim 1, wherein said vapor outlet and said liquid inlet are opened in said connecting tank; and said refrigerant control means includes a structure that said liquid inlet is opened at a lower position than that of said vapor outlet.

3. A cooling apparatus according to claim 2, wherein:

said refrigerant chamber is thinned in a back-and-forth direction with respect to the width in a transverse direction and said heating body is attached to both or one of front and rear surfaces of said refrigerant chamber; and said liquid inlet and said circulating passage are disposed on both sides of said refrigerant chamber.

4. A cooling apparatus according to claim 1, wherein said refrigerant tank has a plug member to plug a lower side of said vapor outlet.

5. A cooling apparatus according to claim 1, wherein said refrigerant tank is made of an extrusion member.

6. A cooling apparatus according to claim 2, further comprising a refrigerant control plate covering said vapor outlet thereover in said connecting tank.

7. A cooling apparatus according to claim 1, wherein said connecting tank is disposed below said radiating portion and connected to an upper end portion of said refrigerant chamber, and an upper end portion of said refrigerant chamber is connected to said connecting tank with said refrigerant chamber inclining, and a part of an upper end opening that opens into said connecting tank is covered by a back flow prevention plate.

8. A cooling apparatus according to claim 1, wherein:

said vapor outlet and said liquid inlet are opened in said connecting tank, and said refrigerant control means covers above said vapor outlet in said connecting tank, and forms a condensed refrigerant passage for guiding said condensed refrigerant from said radiating portion, which is dropped on an upper surface of said refrigerant control means to said liquid inlet.

9. A cooling apparatus according to claim 8, wherein said refrigerant chamber is thinned in a back-and-forth direction with respect to the width in a transverse direction and said heating body is attached to both or one of front and rear surfaces of said refrigerant chamber, and said liquid inlet and said circulating passage are disposed on both sides of said refrigerant chamber.

10. A cooling apparatus according to claim 8, wherein said refrigerant control means forms said condensed refrigerant passage by lowering a center portion in a back-and-forth direction so that its sectional area is formed concave shape.

11. A cooling apparatus according to claim 8, wherein said refrigerant control means including a oblique surface in which a height of a center portion is highest in a transverse direction, and is lowered toward to both peripheral portions in said transverse direction.

12. A cooling apparatus according to claim 1, wherein said refrigerant flow control means covers all over said refrigerant chamber so that the condensed liquid to drip from said radiating portion may flow into said liquid returning chamber, and forms said vapor outlet from which the vaporized refrigerant boiled in said refrigerant chamber flows out and which is opened transversely with respect to said radiating portion.

13. A cooling apparatus according to claim 12, wherein said liquid returning chamber is formed on the two sides of said refrigerant chamber.

14. A cooling apparatus according to claim 12, wherein said refrigerant control means includes one refrigerant control plate arranged all over said refrigerant chamber to form said vapor outlets individually below the two ends of said refrigerant control plate.

15. A cooling apparatus according to claim 12, wherein said refrigerant control means includes a plurality of refrigerant control plates covering partially over said refrigerant chamber and arranged to overlap partially vertically at stepwise different height positions to form said vapor outlets between the vertically confronting refrigerant control plates.

16. A cooling apparatus according to claim 15, wherein said plurality of refrigerant control plates include:

a first refrigerant control plate positioned at an upper central portion of said refrigerant chamber and arranged at the highest position; and a pair of second refrigerant control plates arranged on the two sides of said first refrigerant control plate for forming said vapor outlets between themselves and said first refrigerant control plate.

17. A cooling apparatus according to claim 15, wherein said plurality of refrigerant control plates, at least the refrigerant control plate arranged a low position is so inclined that the condensed liquid having dripped on the upper face of said control plate may easily flow toward said liquid returning chamber, and is bent further upward at the upper end portion of the inclination.

18. A cooling apparatus according to claim 1, wherein said refrigerant flow control means includes:

a side control plate for enclosing the upper end opening of said refrigerant chamber at a predetermined height;

an upper control plate for covering all over said refrigerant chamber enclosed by said side control plate; and a vapor outlet for causing the vaporized refrigerant, as boiled in said refrigerant chamber, to flow out; and wherein said vapor outlet is opened at a higher position of said side control plate than the upper end face of said refrigerant chamber.

19. A cooling apparatus according to claim 18, wherein said liquid returning chamber is formed on the two sides of said refrigerant chamber.

20. A cooling apparatus according to claim 18, wherein said vapor outlet is opened in each of the faces of said side control plate.

21. A cooling apparatus according to claim 18, wherein said side control plate is inclined outward with respect to said refrigerant chamber.

22. A cooling apparatus according to claim 18, wherein said upper control plate has slopes which are the highest at their central portions and which are gradually lowered toward the two sides.

23. A cooling apparatus according to claim 18, wherein:

said upper control plate includes a first upper control plate and a second upper control plate individually covering partially over said refrigerant chamber; and said first and second upper control plates are arranged to overlap partially in the vertical direction at stepwise different positions, so that said vapor outlet is formed between said first and second upper control plates vertically confronting each other.

* * * * *